US008633790B2

(12) United States Patent
Fujii

(10) Patent No.: US 8,633,790 B2
(45) Date of Patent: Jan. 21, 2014

(54) WAVEGUIDE STRUCTURE, ANTENNA APPARATUS THAT USES THAT WAVEGUIDE STRUCTURE, AND VEHICLE RADAR APPARATUS IN WHICH A WAVEGUIDE STRUCTURE OR AN ANTENNA APPARATUS IS USED

(75) Inventor: Yoshiyuki Fujii, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 855 days.

(21) Appl. No.: 12/473,865

(22) Filed: May 28, 2009

(65) Prior Publication Data

US 2010/0164654 A1 Jul. 1, 2010

(30) Foreign Application Priority Data

Dec. 26, 2008 (JP) ..... 2008-333863

(51) Int. Cl.
*H01P 3/12* (2006.01)
*H01Q 13/20* (2006.01)
*H01Q 1/32* (2006.01)

(52) U.S. Cl.
USPC ..... 333/239; 343/713; 343/898; 333/249

(58) Field of Classification Search
USPC ..... 333/239–241, 248, 249; 343/772, 776, 343/898, 711, 713
See application file for complete search history.

(56) References Cited

U.S. PATENT DOCUMENTS 7,014,003 B2 * 3/2006 Polak ..... 180/169
2009/0315796 A1 * 12/2009 Kodama ..... 343/772

FOREIGN PATENT DOCUMENTS

| | | | |
|---|---|---|---|
| DE | 698 35 633 | T2 | 8/2006 |
| DE | 10 2008 056 705 | A1 | 12/2009 |
| EP | 0 874 415 | B1 | 8/2006 |
| JP | 8-186401 | A | 7/1996 |
| JP | 2003-318641 | A | 11/2003 |
| JP | 2005-020147 | A | 1/2005 |
| JP | 3610274 | B2 | 1/2005 |
| JP | 3650083 | B2 | 5/2005 |
| JP | 3843946 | B2 | 11/2006 |

OTHER PUBLICATIONS http://oxforddictionaries.com/definition/english/protrude, a general definition of "protrude",Oxford University Press, 2012.*
German Office Action dated May 24, 2012 issued in German Application No. 10 2009 035 434.4 (with English translation) (15 pages).

* cited by examiner

*Primary Examiner* — Benny Lee
*Assistant Examiner* — Gerald Stevens
(74) *Attorney, Agent, or Firm* — Sughrue Mion, PLLC

(57) ABSTRACT

A waveguide structure including (i) a base that has a mounting surface, (ii) a metal plate member that has elasticity, that is stacked on the mounting surface, and that functions together with the base to constitute a waveguide, (iii) a positioning mechanism that is constituted by a positioning pin that is disposed so as to protrude from the base and an interfitting portion that is formed on the plate member, and that is fitted together with the positioning pin, the positioning mechanism positioning the plate member on the mounting surface of the base and also restricting movement along the mounting surface by fitting together of the positioning pin and the interfitting portion, and (iv) a holder that holds the plate member in a state of close contact with the mounting surface by pressing the plate member so as to generate a reaction force in the plate member.

31 Claims, 22 Drawing Sheets

WAVEGUIDE STRUCTURE, ANTENNA APPARATUS THAT USES THAT WAVEGUIDE STRUCTURE, AND VEHICLE RADAR APPARATUS IN WHICH A WAVEGUIDE STRUCTURE OR AN ANTENNA APPARATUS IS USED

BACKGROUND OF THE INVENTION

1. Field of the Invention

The present invention relates to a waveguide structure that is particularly suitable for transmission of high frequency signals in a microwave band and a millimeter wave band, an antenna apparatus that uses that waveguide structure, and a vehicle radar apparatus in which a waveguide structure or an antenna apparatus is used.

2. Description of the Related Art

Conventional waveguide structures have: a metal first conductive member in which a first groove that has an opening on a flat surface is formed; and a metal second conductive member that is formed so as to have a flat plate shape, that is disposed on the surface of the first conductive member so as to cover the first groove of the first conductive member, and that is fastened to the first conductive member by screws, a waveguide being configured between the first groove of the first conductive member and the second conductive member.

However, when flat first and second conductive members are fastened using screws, the fastening forces from the screws do not act uniformly on the surfaces of the facing first and second conductive members. Thus, buckling may occur in the thin plate-shaped second conductive member, giving rise to gaps between the first and second conductive members that communicate between internal and external portions of the waveguide. In such cases, high frequency signals may leak out through the gaps between the first and second conductive members when propagating through the waveguide, giving rise to problems such as deterioration in energy transmission efficiency of the high frequency signals, etc.

When a plurality of waveguides are configured on the above waveguide structure, because it is necessary to fasten walls that partition off a plurality of first grooves that are formed on the first conductive member and the second conductive member using screws, the waveguides cannot be placed closer to each other than a diameter of the screws, giving rise to problems such as being unable to reduce the waveguide structure in size, etc. In other words, it may not be possible to adapt the above waveguide structures to waveguide structures for the transmission of high frequency signals in the microwave band and the millimeter wave band for which reductions in size are being demanded. Other problems also arise such as deterioration in isolation between the waveguides, etc.

As structures that suppress deterioration in isolation between the waveguides, or deterioration in energy transmission efficiency when the high frequency signals propagate through the waveguides, etc., that results from gaps that communicate between internal and external portions of the waveguides, there have been proposed:

conventional high frequency signal transmission casings in which waveguides are configured by joining together first and second conductive members by means of a conductive rubber material (see Patent Literature 1, for example);

first conventional waveguide slot array antennas in which waveguides are configured by joining together first and second conductive members by means of a conductive pressure sensitive adhesive sheet (see Patent Literature 2, for example); and second conventional waveguide slot array antennas that fix first and second conductive members using an adhesive to configure waveguides, and that have bumps that are made of a conductive resin that are disposed in advance so as to penetrate that adhesive to ensure continuity between the first and second conductive members (see Patent Literature 3, for example).

In addition, there have been proposed:

conventional waveguide pipes in which waveguides are configured by joining together first and second conductive members by frictional stirring and bonding (see Patent Literature 4, for example); and conventional waveguide converters that suppress leakage of high frequency signals from gaps that communicate between internal and external portions of waveguides between first and second conductive members, if such gaps arise, by forming a second groove that has a predetermined depth that has an opening on a surface of the first conductive member in close proximity to both sides of a first groove in a width direction (see Patent Literature 5, for example).

[Patent Literature 1]: Japanese Patent Laid-Open No. HEI 8-186401 (Gazette)

[Patent Literature 2]: Japanese Patent Laid-Open No. 2003-318641 (Gazette)

[Patent Literature 3]: Japanese Patent No. 3650083 (Gazette)

[Patent Literature 4]: Japanese Patent No. 3610274 (Gazette)

[Patent Literature 5]: Japanese Patent No. 3843946 (Gazette)

In conventional high frequency signal transmission casings, two waveguides are configured in a casing that has an opening on one surface by integrating a conductive rubber material between a bottom surface of a partitioning plate and the casing, fixing the partitioning plate and the conductive rubber material using screws, and fixing a conductive cover to an opening edge portion of the casing so as to cover two first grooves that are constituted by the partitioning plate and the casing. Here, because the conductive rubber material is elastically deformed by being pressed and held between the casing and the partitioning plate, it is placed in close contact with the partitioning plate and the casing, enabling gaps near the bottom of the first groove to be eliminated.

In conventional high frequency signal transmission casings, the conductive rubber material is interposed between the bottom surface of the partitioning plate and the casing, but eliminating gaps between the internal portion and the external portion of the waveguides of the waveguide structure by applying the conductive rubber material so as to be interposed between the first and second conductive members of the above waveguide structure is easily conceivable.

However, even if a conductive rubber material is interposed between the above first and second conductive members, when a plurality of waveguides are to be configured, it is necessary to fix the walls of the first conductive member that partition off the first grooves and the second conductive member using screws, and problems remain such as being unable to reduce the waveguide structure in size. In addition, because electroconductivity of the conductive rubber material is small compared to metal, energy transmission loss is increased when high frequency signals propagate through waveguides in a waveguide structure to which the conductive rubber material has been applied compared to when the waveguides are configured using only metal.

Because volume of the conductive rubber material reduces as it deteriorates with the passage of time, gaps may arise that communicate between internal and external portions of the waveguides as time passes. It is also commonly known that the rate of temperature change in the electroconductivity of a conductive rubber material is high. In other words, another problem has been that optimal waveguide conditions for efficiently propagating high frequency signals cannot be maintained against the passage of time and temperature changes in a waveguide structure to which conductive rubber has been applied.

First conventional waveguide slot array antennas have a construction in which a conductive slot plate and base body that constitute a waveguide are joined together using a conductive pressure sensitive adhesive sheet. Because the slot plate and the base body are thereby placed in close contact with the conductive pressure sensitive adhesive sheet, gaps that communicate between internal and external portions of the waveguide can also be eliminated.

However, conductive pressure sensitive adhesive sheets have characteristics are such that not only is their electroconductivity small compared to the electroconductivity of metal, their rate of temperature change is high, and their volume reduces as they deteriorate with the passage of time. Consequently, although reductions in size are enabled because first conventional waveguide slot array antennas perform joining together of the slot plate and the base body by adhesion of the conductive pressure sensitive adhesive sheet without using screws, with regard to other points they have similar problems to waveguide structures to which the conductive rubber material has been applied.

Second conventional waveguide slot array antennas have a construction in which a slot plate and a base body that are made of metal that constitute waveguides are joined together by an adhesive, and bumps that are constituted by a conductive resin that are disposed in advance on adhesive positions of the slot plate pass through the adhesive to contact and communicate with the base body. Gaps that communicate between internal and external portions of the waveguide can thereby also be eliminated.

Because second conventional waveguide slot array antennas perform joining together of the slot plate and the base body using an adhesive without using screws, reductions in size are enabled. If a predetermined adhesive is selected, the degree of degradation of the adhesive as time passes can also be reduced compared to the conductive rubber material and the conductive sheet.

However, because continuity between the slot plate and the base body is performed only by the bumps, one problem has been that electrical continuity between the slot plate and the base body is insufficient, increasing energy transmission loss when high frequency signals propagate through the waveguides.

Because conductive members of conventional waveguide pipes are joined together by frictional stirring and bonding, the conductive members are joined together without gaps, enabling increases in energy transmission loss when high frequency signals propagate through the wave guides to be suppressed. However, joining together of the conductive members by frictional stirring and bonding is performed beyond the joined portion between the conductive members. Consequently, problems remain such as conventional waveguide pipes not being able to respond to demands for reductions in size.

In conventional waveguide converters, because space for the second grooves that are formed on two sides in the width direction of the first groove must be ensured on the first conductive member, problems remain such as not being able to respond to demands for reductions in size. Even if the conventional waveguide converters could hypothetically be reduced in size by forming the second grooves on the first conductive member accurately with an extremely small width, new problems arise such as increased costs related to forming the second grooves.

SUMMARY OF THE INVENTION

The present invention aims to solve the above problems and an object of the present invention is to provide a waveguide structure that prevents occurrences of gaps that communicate between internal and external portions of a waveguide without increasing energy transmission loss of high frequency signals, that is low cost, that has superior durability, and that is compact, an antenna apparatus that uses that waveguide structure, and a vehicle radar apparatus in which a waveguide structure or an antenna apparatus is used.

In order to achieve the above object, according to one aspect of the present invention, there is provided a waveguide structure including: a base that has a mounting surface; a metal plate member that has elasticity, that is stacked on the mounting surface, and that functions together with the base to constitute a waveguide. The waveguide structure includes a positioning mechanism that is constituted by: a positioning member that is disposed on the mounting surface as an integral member of the mounting surface so as to protrude from a first of the base and the plate member; and an interfitting portion that is formed on a second of the base and the plate member, and that is fitted together with the positioning member, the positioning mechanism positioning the plate member on the mounting surface of the base and also restricting movement along the mounting surface by fitting together of the positioning member and the interfitting portion. The waveguide structure includes a holding means that holds the plate member in a state of close contact with the mounting surface by pressing the plate member so as to generate a reaction force in the plate member.

According to the waveguide structure of the present invention, a metal plate member can be held in a state of close contact on a mounting surface that in configured on a metal base, and that is obtained by sweeping in a sweep direction a deflection curve for a beam supported at two ends so as to generate a reaction force in the plate member. Thus, the waveguide structure can be configured while preventing occurrences of gaps that communicate between internal and external portions of the waveguide without using members that have inferior electroconductivity to metal, and without directly fastening portions of the mounting surface and the plate member that face each other using screws. Together with this, it is no longer necessary to form a groove for suppressing leakage of high frequency signals on the base of the waveguide structure in the manner of conventional waveguide converters. Consequently, the waveguide structure can suppress increases in energy transmission loss of high frequency signals while also ensuring durability at reduced cost, and also makes it possible to respond to demand for reductions in size.

DETAILED DESCRIPTION OF THE PREFERRED EMBODIMENTS

Preferred embodiments of the present invention will now be explained with reference to the drawings.

Embodiment 1

Figure 1:
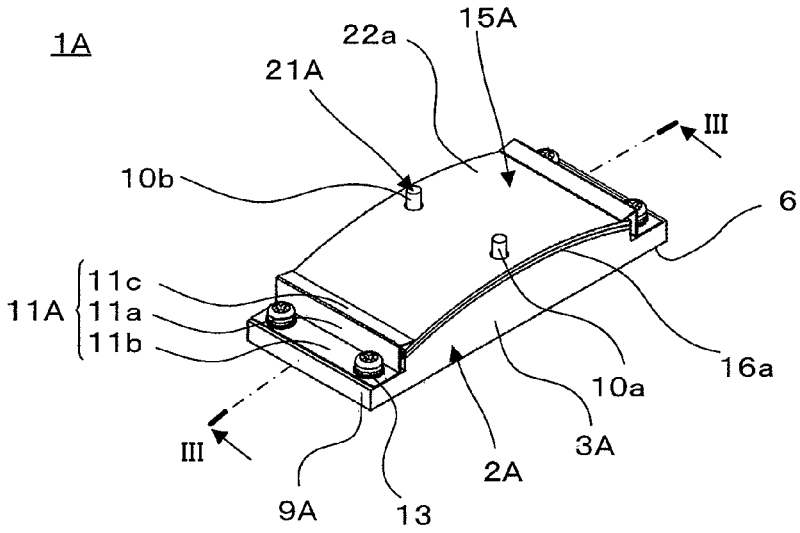
FIG. 1 is a perspective of a waveguide structure according to Embodiment 1 of the present invention.
Figure 2:
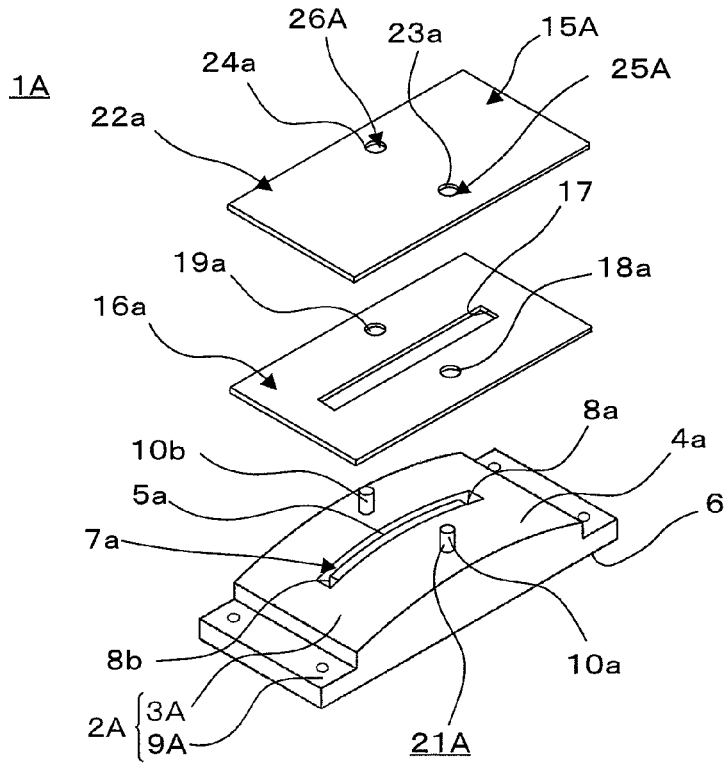
FIG. 2 is an exploded perspective of the waveguide structure according to Embodiment 1 of the present invention.
Figure 3:
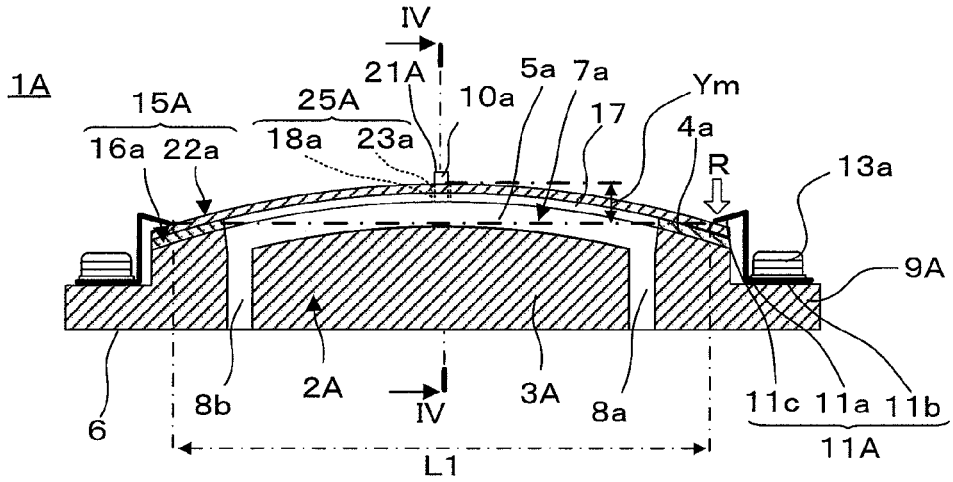
FIG. 3 is a cross section taken along Line III-III in FIG. 1 viewed from the direction of the arrows.
Figure 4:
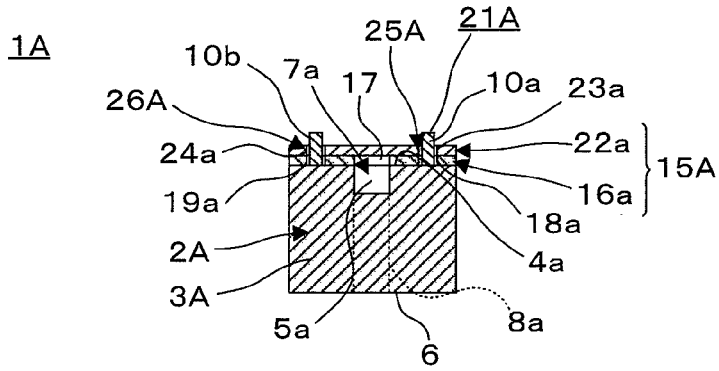
FIG. 4 is a cross section taken along Line IV-IV in FIG. 3 viewed from the direction of the arrows.
Figure 5:
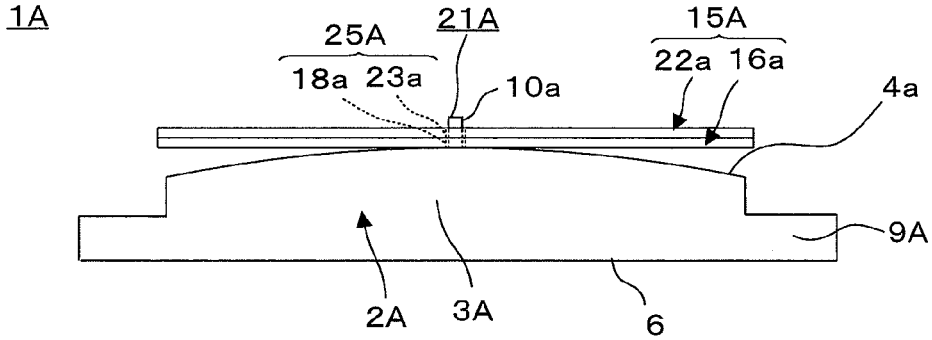
FIG. 5 is a diagram for explaining a procedure for assembling the waveguide structure of the invention according to Embodiment 1 of the present invention.
Figure 6:
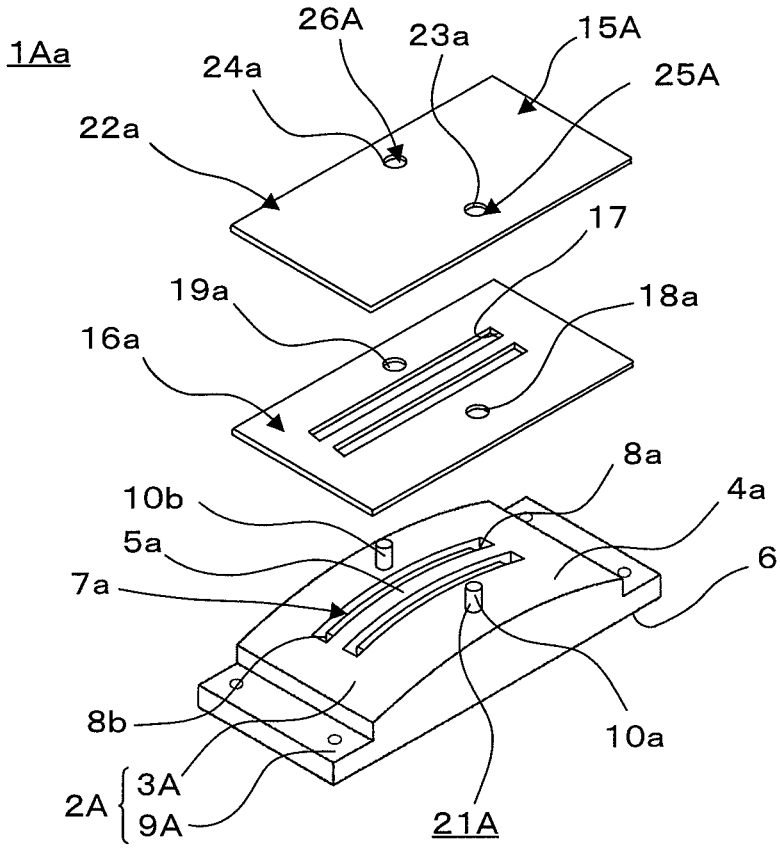
FIG. 6 is an exploded perspective that shows another variation of the waveguide structure according to Embodiment 1 of the present invention, and shows a case in which the waveguide structure has two wave guides.

FIG. 1 is a perspective of a waveguide structure according to Embodiment 1 of the present invention, FIG. 2 is an exploded perspective of the waveguide structure according to Embodiment 1 of the present invention, FIG. 3 is a cross section taken along Line III-III in FIG. 1 viewed from the direction of the arrows, FIG. 4 is a cross section taken along Line IV-IV in FIG. 3 viewed from the direction of the arrows, FIG. 5 is a diagram for explaining a procedure for assembling the waveguide structure of the invention according to Embodiment 1 of the present invention, and FIG. 6 is an exploded perspective that shows another variation of the waveguide structure according to Embodiment 1 of the present invention, and shows a case in which the waveguide structure has two waveguides.

Moreover, depiction of holders is omitted in FIG. 2.

In FIGS. 1 through 4, a waveguide structure 1A includes: a metal base 2A that has a curved mounting surface 4*a*; and an elastic metal plate member 15A that is stacked on the mounting surface 4*a* and that functions together with the base 2A to constitute a waveguide 7*a*. In addition, the waveguide structure 1A includes: a positioning mechanism 21A that is constituted by: a first positioning pin 10*a* and a second positioning pin 10*b* that function as a positioning member that is disposed on the mounting surface as an integral member of the mounting surface so as to protrude from the mounting surface 4*a*; and a first interfitting portion 25A and a second interfitting portion 26A that are formed on the plate member 15A and that are fitted together with the first positioning pin 10*a* and the second positioning pin 10*b*, the positioning mechanism 21A positioning the plate member 15A on the mounting surface 4*a* of the base 2A, and also restricting movement parallel to the mounting surface 4*a*; and a holder 11A that functions as a holding means that holds the plate member 15A on the mounting surface 4*a* in a state of close contact.

The base 2A includes: a main body portion 3A that is rectangular when viewed from a side that is opposite the mounting surface 4*a*; and flanges 9A that extend outward from two longitudinal ends of the main body portion 3A.

Hereinafter, a longitudinal direction when the main body portion 3A is viewed from the side that is opposite the mounting surface 4*a* will simply be called the longitudinal direction of the main body portion 3A.

The mounting surface 4*a* is configured so as to have a convex curved surface that is obtained by sweeping in a sweep direction a deflection curve for a beam that is supported at two ends. Moreover, the sweep direction is a direction that is perpendicular to a plane that includes the deflection curve.

The deflection curve for a beam that is supported at two ends is set as follows:

two longitudinal edge portions of the plate member 15A are supported and the plate member 15A is deflected by applying a load between the two longitudinal edge portions. The deflection curve for a beam that is supported at two ends is set so as to be a curve that is parallel to major surfaces (front and rear surfaces) of the plate member 15A in a cross section that is perpendicular to the width direction of the plate member 15A in this state. Moreover, if it is necessary to make the pressure distribution between the plate member 15A and the base 2A uniform when the plate member 15A is deflected parallel to the mounting surface 4*a* by pressing two longitudinal edges of the plate member 15A, it is desirable for the deflection curve for a beam that is supported at two ends to be a shape that applies a uniformly distributed load over an entire region in the longitudinal direction of the plate member 15A.

Hereinafter, the direction that follows the mounting surface 4*a* in the cross section of the main body portion 3A that is perpendicular to the sweep direction, which does not have a curvature, will be called "the curve direction".

The mounting surface 4*a* is formed so as to have a curve in the cross section of the main body portion 3A that is perpendicular to the sweep direction in which a distance from a line segment that connects two ends of the mounting surface 4*a* increases toward center in the curve direction, as shown in FIG. 3. In other words, the distance from a plane that includes the two edge portions of the mounting surface 4*a* in the curve direction increases toward a longitudinal center in the curve direction of the mounting surface 4*a*. Hereinafter, the portion of the mounting surface 4*a* at which the distance from the plane that includes the two edge portions of the mounting surface 4*a* in the curve direction is greatest will be called "a mounting surface maximum projecting portion".

A flat input and output port forming surface 6 is configured on a surface on an opposite side of the base 2A from the mounting surface 4*a*.

A waveguide groove 5*a* that has an opening on the mounting surface 4*a* is formed on the main body portion 3A. Here, the waveguide groove 5*a* extends for a predetermined length in the curve direction of the mounting surface 4*a* at a predetermined width in the sweep direction of the mounting surface 4*a*. A bottom surface of the waveguide groove 5*a* is configured so as to have a curved surface that has a curvature that matches the curvature of the mounting surface 4*a* in the curve direction.

Waveguide input and output passages 8*a* and 8*b* are formed on the main body portion 3A so as to pass through between two ends of the waveguide groove 5*a* and the input and output port forming surface 6.

The first positioning pin 10*a* and the second positioning pin 10*b*, which are both cylindrical, are disposed on the mounting surface as integral members of the mounting surface so as to protrude at the mounting surface maximum projecting portion on two sides of the waveguide groove 5*a* in the sweep direction.

Here, the first positioning pin 10*a* and the second positioning pin 10*b* are each separated by a first distance from two edge portions parallel to the curve direction of the mounting surface 4*a* (two edge portions in the sweep direction), respectively.

The plate member 15A is constituted by a two-layer divided plate member that is made up of: a first divided plate member 16*a* that is stacked on the mounting surface 4*a*; and a second divided plate member 22*a* that is stacked on the first divided plate member 16*a*. The first divided plate member 16*a* and the second divided plate member 22*a* are constituted by similar elastic metals.

The first divided plate member 16*a* is configured so as to have a flat, rectangular shape that has long sides that match a length of the mounting surface 4*a* in the curve direction, and short sides that match a length of the mounting surface 4*a* in the sweep direction. A waveguide constituting aperture 17 that has a width and a length that match a width and a length of the waveguide groove 5*a* is formed on the first divided plate member 16*a* so as to face the waveguide groove 5*a* when the first divided plate member 16*a* and the mounting surface 4*a* are placed in close contact with outer edges aligned.

In addition, a first interfitting aperture 18*a* and a second interfitting aperture 19*a* that have an aperture shape that is circular are respectively formed on portions of the first divided plate member 16*a* that are central in the longitudinal direction, and that are separated by a first distance from each of the two long sides.

The second divided plate member 22*a* is configured so as to have a flat, rectangular shape that is identical in size to the first divided plate member 16*a*. In addition, a third interfitting aperture 23*a* and a fourth interfitting aperture 24*a* that have aperture shapes that are similar to those of the first interfitting aperture 18*a* and the second interfitting aperture 19*a* are respectively formed on portions of the second divided plate member 22*a* that are central in the longitudinal direction, and that are separated by a first distance from each of the two long sides.

The first divided plate member 16*a* is stacked on the mounting surface 4*a* such that a first surface thereof faces the mounting surface 4*a* in a state in which the first positioning pin 10*a* and the second positioning pin 10*b* are inserted through (fitted together with) the first interfitting aperture 18*a* and the second interfitting aperture 19*a*.

In addition, the second divided plate member 22*a* is stacked on the first divided plate member 16*a* such that a first surface thereof faces a second surface of the first divided plate member 16*a* in a state in which the first positioning pin 10*a* and the second positioning pin 10*b* are inserted through the third interfitting aperture 23*a* and the fourth interfitting aperture 24*a*.

The positioning mechanism 21A is constituted by the first positioning pin 10*a*, the second positioning pin 10*b*, the first interfitting portion 25A, which is constituted by the first interfitting aperture 18*a* and the third interfitting aperture 23*a*, and the second interfitting portion 26A, which is constituted by the second interfitting aperture 19*a* and the fourth interfitting aperture 24*a*. Here, external shapes of the first positioning pin 10*a* and the second positioning pin 10*b* approximately match internal shapes of each of the interfitting apertures. In other words, the positioning mechanism 21A positions the plate member 15A at a prescribed position on the mounting surface 4*a* and also restricts movement of the plate member 15A parallel to the mounting surface 4*a* by the fitting together of the first positioning pin 10*a* and the first interfitting portion 25A, and by the fitting together of the second positioning pin 10*b* and the second interfitting portion 26A.

Two curve direction edge portions of the second divided plate member 22*a* are pressed by a pair of holders 11A that will be explained below such that the first divided plate member 16*a* and the second divided plate member 22*a* extend parallel to the curved shape of the mounting surface 4*a* in an elastically deformed state.

Here, the "two curve direction edge portions" means predetermined portions in a range that includes a vicinity of the two edge portions of the second divided plate member 22*a* that are parallel to the sweep direction.

The holders 11A are configured by bending two long side portions of flat, rectangular leaf springs in opposing directions. Specifically, the holders 11A are constituted by: an intermediate portion 11*a*; and a mounted portion 11*b* and a pressing portion 11*c* that extend outward from the intermediate portion 11*a* in opposite directions. Here, the mounted portion 11*b* extends outward so as to be perpendicular to the intermediate portion 11*a*, and the pressing portion 11*c* extends outward at an acute angle relative to the intermediate portion 11*a*.

The mounted portion 11*b* of a first holder 11A is securely fastened onto a first flange 9A by screws 13. Here, the intermediate portion 11*a* of the holder 11A extends so as to project beyond the mounting surface 4*a* opposite a first side surface that is perpendicular to the longitudinal direction of the main body portion 3A. A leading end of the pressing portion 11*c* is placed in contact over an entire region in the sweep direction with a vicinity of a first curve direction edge portion of the second divided plate member 22*a* that is curved parallel to the mounting surface 4*a*, and the pressing portion 11*c* presses the second divided plate member 22*a*.

The mounted portion 11*b* of a second holder 11A is securely fastened onto a second flange 9A by screws 13. Here, the intermediate portion 11*a* of the second holder 11A extends so as to project beyond the mounting surface 4*a* opposite a second side surface that is perpendicular to the longitudinal direction of the main body portion 3A. A leading end of the pressing portion 11*c* is placed in contact over an entire region in the sweep direction with a vicinity of a second curve direction edge portion of the second divided plate member 22*a* that is curved parallel to the mounting surface 4*a*, and the pressing portion 11*c* presses the second divided plate member 22*a*.

The first divided plate member 16*a* and the second divided plate member 22*a* are held stably on the mounting surface 4*a* in a curved state parallel to the mounting surface 4*a* by pressing forces from the holders 11A.

The waveguide groove 5*a*, the waveguide constituting aperture 17, and the second divided plate member 22*a* function together to constitute a waveguide 7*a* that extends in the longitudinal direction of the main body portion 3A.

The shape of the deflection curve of the mounting surface 4*a*, in other words, the shape of the curve due to the path that is drawn in the curve direction of the mounting surface 4*a*, is configured so as to satisfy Expression (1) below, and the holders 11A are configured so as to press the predetermined positions in the vicinity of the two curve direction ends of the second divided plate member 22*a* with a pressing force R that can be expressed by Expression (2) below.

Moreover, Expression (1) is a deflection curve formula from material mechanics for a beam supported at two ends that is subjected to a uniformly distributed load along its entire length, and Expression (2) is an expression that is easily found from a maximum deflection formula and a geometrical-moment of inertia formula for a plate.

$$Y=16YmX(X3-2L1X2+L13)/(5L14) \quad (1)$$

$$R=192kEbh3Ym/(60L13) \quad (2)$$

Here, a Y-axis direction is a normal direction of a plane that includes the edge portions of the mounting surface 4*a* at the two ends in the curve direction, and an X-axis direction is a direction in which the edge portions of the mounting surface 4*a* at the two ends in the curve direction face each other. Point 0 of the Y-axis is a contacting portion between the holders 11A and the second divided plate member 22*a*, and Point 0 of the X-axis is a contacting portion between the first holder 11A and the second divided plate member 22*a*.

Ym, L1, E, b, h, and k are defined as follows:

Ym is maximum deflection of the second divided plate member 22*a*, which is defined by a maximum distance from a plane that includes two straight lines that are constituted by the contacting portions between the holders 11A and the second divided plate member 22*a* to a front surface (a second surface) of the second divided plate member 22*a;*

L1 is a distance between two contact positions between the pair of holders 11A and the second divided plate member 22*a;*

E is a modulus of longitudinal elasticity of the first divided plate member 16*a* and the second divided plate member 22*a* b is a length of the first divided plate member 16*a* and the second divided plate member 22*a* in the sweep direction;

h is a total thickness of the first divided plate member 16*a* and the second divided plate member 22*a*; and k is the number of divided plate members that constitute the plate member 15A.

When the first divided plate member 16*a* and the second divided plate member 22*a* are curved parallel to a mounting surface 4*a* that is configured into a curved surface that has a cross section perpendicular to the sweep direction that satisfies Expression (1) and the two edge portions in the curve direction of the first divided plate member 16*a* and the second divided plate member 22*a* are pressed with a pressing force that has a predetermined value R that is defined by Expression (2), reaction forces arise in the first divided plate member 16*a* and the second divided plate member 22*a* that act in a direction in which an entire region of the first divided plate member 16*a* and the second divided plate member 22*a* are pressed against the mounting surface 4*a*.

In other words, the first divided plate member 16*a* is stacked onto the mounting surface 4*a* without forming gaps between it and the mounting surface 4*a*, and the second divided plate member 22*a* is stacked onto the first divided plate member 16*a* without forming gaps between it and the first divided plate member 16*a*.

Stable electrical continuity is thereby ensured between the first divided plate member 16*a* and the main body portion 3A, and between the first divided plate member 16*a* and the second divided plate member 22*a*.

Next, a procedure for assembling the waveguide structure 1A will be explained.

First, the first divided plate member 16*a* is disposed on the mounting surface 4*a* by inserting the first positioning pin 10*a* and the second positioning pin 10*b* through the first interfitting aperture 18*a* and the second interfitting aperture 19*a* of the first divided plate member 16*a*, as shown in FIG. 5. Next, the second divided plate member 22*a* is disposed on the first divided plate member 16*a* by inserting the first positioning pin 10*a* and the second positioning pin 10*b* through the third interfitting aperture 23*a* and the fourth interfitting aperture 24*a* of the second divided plate member 22*a*.

The first divided plate member 16*a* and the second divided plate member 22*a* are deformed elastically from near the first positioning pin 10*a* and the second positioning pin 10*b* toward a first end of the mounting surface 4*a* in the curve direction so as to lie parallel to the mounting surface 4*a*. Next, while maintaining elastic deformation, the first holder 11A is fixed by fastening the first flange 9A and the mounted portion 11*b* using screws 13 such that a leading end of the first divided plate member 16*a* near the pressing portion 11*c* of the holder 11A is placed in contact with a vicinity of the short sides of the second divided plate member 22*a* over an entire region in the width direction.

Next, the first divided plate member 16*a* and the second divided plate member 22*a* are deformed elastically from near the first positioning pin 10*a* and the second positioning pin 10*b* toward a second end of the mounting surface 4*a* in the curve direction so as to lie parallel to the mounting surface 4*a*. Next, assembly of the waveguide structure 1A that is shown in FIGS. 1, 3, and 4 is completed by fastening the second holder 11A onto the second flange 9A while maintaining elastic deformation.

The waveguide structure 1A according to Embodiment 1 includes: a metal base 2A that has a mounting surface 4*a* that is configured so as to have a curved surface that is obtained by sweeping in a sweep direction a deflection curve for a beam supported at two ends; and an elastic metal plate member 15A that is stacked on the mounting surface 4*a* and that functions together with the base 2A to constitute a waveguide 7*a*. In addition, the waveguide structure 1A includes holders 11A that press two curve direction edge portions of the plate member 15A that has been stacked on the mounting surface 4*a* so as to generate reaction forces in the respective first divided plate member 16*a* and second divided plate member 22*a* that constitute the plate member 15A to hold the first divided plate member 16*a* on the mounting surface 4*a* and the second divided plate member 22*a* on the first divided plate member 16*a* in a state of close contact.

Consequently, in the waveguide structure 1A, a first surface of the first divided plate member 16*a* and the mounting surface 4*a*, and a first surface of the second divided plate member 22*a* and a second surface of the first divided plate member 16*a* can be placed in close contact without using conductive rubber materials or adhesive sheets, etc., that have inferior electroconductivity to metal, and that deteriorate easily.

In other words, because the waveguide structure 1A can prevent gaps that communicate between internal and external portions of the waveguides 7*a* from forming without using a member that has inferior electroconductivity to metal, durability can be ensured while suppressing increases in energy transmission loss of high frequency signals.

One waveguide 7*a* is explained as being configured on the waveguide structure 1A, but the above effects can also be achieved even if the waveguide structure 1Aa is configured so as to have two adjacent waveguides 7*a*, as shown in FIG. 6, for example. Moreover, except for two waveguides 7*a* being formed, the configuration of the waveguide structure 1Aa is identical to that of the waveguide structure 1A. In other words, the first surface of the first divided plate member 16*a* is pressed onto the mounting surface 4*a*, and the first surface of the second divided plate member 22*a* is pressed onto the second surface of the first divided plate member 16*a* by a uniformly distributed load due to the reaction forces from the first divided plate member 16*a* and from the second divided plate member 22*a* even if a plurality of waveguides 7*a* are configured on the waveguide structure 1Aa. For this reason, because gaps that communicates between internal and external portions of the waveguides 7*a* are no longer formed even if the walls that partition off the waveguides 7*a* and the plate member 15A are not fastened together by screws, the waveguides 7*a* can be placed closer together and the waveguide structure configured more compactly. Consequently, it is possible to use the waveguide structure 1Aa as a waveguide structure for the transmission of high frequency signals in the microwave band and the millimeter wave band for which reductions in size are being demanded.

In addition, because it is also not necessary to form a groove for suppressing leakage of high frequency signals on two sides of the waveguide groove 5*a*, the waveguide structure 1A can be configured at reduced cost.

The waveguide structure 1A also includes: a positioning mechanism 21A that has: a first positioning pin 10*a* and a second positioning pin 10*b* that are disposed so as to project on a mounting surface maximum projecting portion so as to be separated in a sweep direction; and a first interfitting portion 25A and a second interfitting portion 26A that are formed on a plate member 15A and together with which the first positioning pin 10*a* and the second positioning pin 10*b* are fitted.

The internal shape of the first interfitting portion 25A approximately matches the external shape of the first positioning pin 10*a*, and the internal shape of the second interfitting portion 26A approximately matches the external shape of the second positioning pin 10*b*.

Consequently, movement of the first divided plate member 16*a* and the second divided plate member 22*a* parallel to the mounting surface 4*a* can be restricted by the first positioning pin 10*a* and the second positioning pin 10*b*, and the first divided plate member 16*a* and the second divided plate member 22*a* can be disposed accurately at the prescribed position on the mounting surface 4*a* simply by inserting the first positioning pin 10*a* and the second positioning pin 10*b* through each of the interfitting apertures that constitute the first interfitting portion 25A and the second interfitting portion 26A when the first divided plate member 16*a* and the second divided plate member 22*a* are stacked on the mounting surface 4*a*. In other words, the waveguide 7*a* can be configured to exact design dimensions.

The work of elastically deforming the first divided plate member 16*a* and the second divided plate member 22*a* over the mounting surface 4*a* is thereby facilitated. Consequently, workers who perform the curving work on the first divided plate member 16*a* and the second divided plate member 22*a* can be prevented from generating gaps that communicate between internal and external portions of the waveguide 7*a* by erroneously deforming the first divided plate member 16*a* and the second divided plate member 22*a* plastically, etc.

Moreover, it is necessary to increase milling precision of each of the positioning pins and each of the interfitting apertures in order to insert the first positioning pin 10*a* and the second positioning pin 10*b* through the first interfitting portion 25A and the second interfitting portion 26A practically without leaving gaps, but formation of each of the positioning pins and each of the interfitting apertures is easier than accurately forming a groove for suppressing leakage of high frequency signals on two sides of a waveguide groove 5*a*.

In addition, the positioning mechanism 21A is disposed so as to be aligned with a portion of the mounting surface 4*a* at which a distance from a plane that includes the two edge portions of the mounting surface 4*a* in the curve direction is at a maximum (the mounting surface maximum projecting portion). Wobbling of the first divided plate member 16*a* and the second divided plate member 22*a* that arises as a result of clearance between the first interfitting aperture 18*a* and the first positioning pin 10*a* and between the third interfitting aperture 23*a* and the first positioning pin 10*a*, and clearance between the second interfitting aperture 19*a* and the second positioning pin 10*b*, and between the fourth interfitting aperture 24*a* and the second positioning pin 10*b*, can be suppressed while curving the first divided plate member 16*a* and the second divided plate member 22*a* by elastically deforming the first divided plate member 16*a* and the second divided plate member 22*a* so as to cover the mounting surface maximum projecting portion when the first divided plate member 16*a* and the second divided plate member 22*a* are being curved. Thus, because the curving work on the first divided plate member 16*a* and the second divided plate member 22*a* is greatly facilitated, and the amount of time required for assembly of the waveguide structure 1A is shortened, costs of the waveguide structure 1A can also be reduced with regard to assembly.

The first positioning pin 10*a* and the second positioning pin 10*b* is explained as being cylindrical. However, the external shape of the positioning pins is not limited to being circular, and may also be a triangular prism, rectangular prism, or a any prismatic body that has an external shape other than circular, such as semicircular, etc. In that case, the first interfitting aperture, the second interfitting aperture, the third interfitting aperture, and the fourth interfitting aperture should also be configured so as to have internal shapes that match the external shapes of the positioning pins.

The positioning pins 10*a* and 10*b* are explained as being disposed on the mounting surface 4*a* as a pair, but are not limited to being disposed as a pair, and may also be replaced by a single positioning pin. In that case, if a positioning pin that has an external shape other than circular is used, a positioning mechanism may also be constituted by: a single positioning pin that is disposed on the mounting surface 4*a*; and interfitting apertures that are formed on the first divided plate member 16*a* and the second divided plate member 22*a* so as to have an internal shape that matches the external shape of the positioning pin.

The plate member 15A is explained as being constituted by a two-layer divided plate member that is constituted by the first divided plate member 16*a* and the second divided plate member 22*a*. However, the plate member 15A may also be constituted by a divided plate member that has three or more layers by stacking additional divided plate members that are similar to the first divided plate member 16*a* between the second divided plate member 22*a* and the mounting surface 4*a*, etc., or the plate member 15A may be constituted by only the second divided plate member 22*a*.

Figure 7:
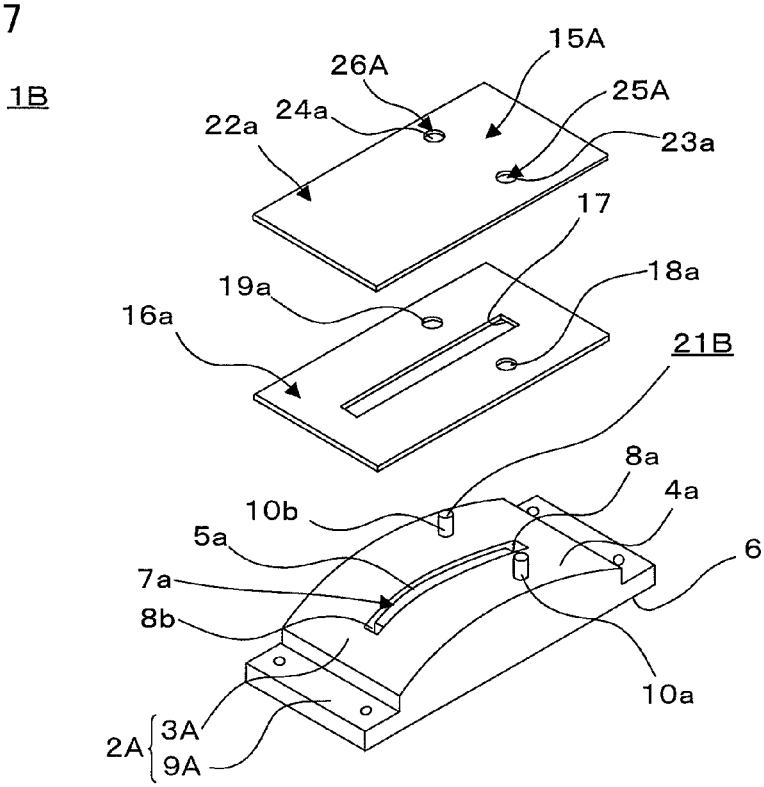
FIG. 7 is an exploded perspective of a waveguide structure according to a first preferred variation of the present invention.
Figure 8:
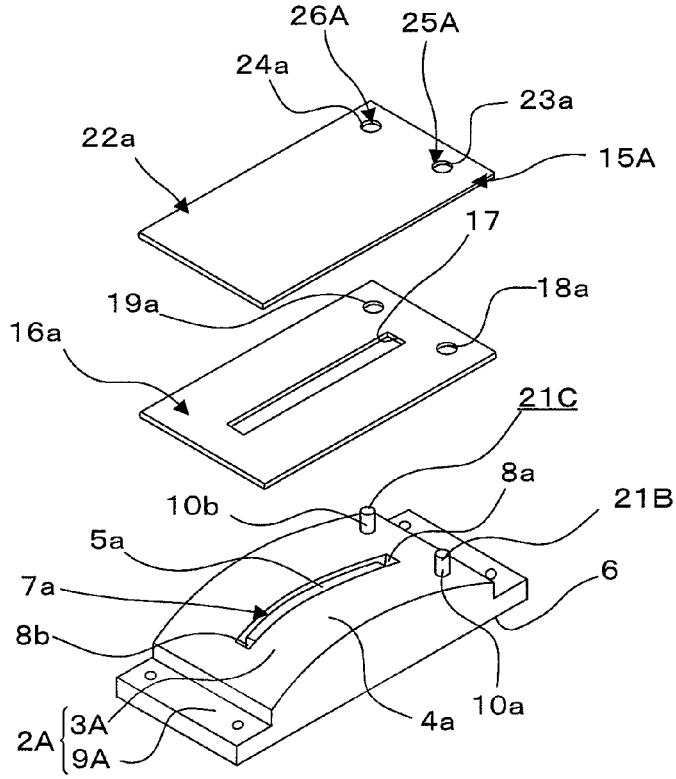
FIG. 8 is an exploded perspective of a waveguide structure according to a second preferred variation of the present invention.

In Embodiment 1 above, the first positioning pin 10*a* and the second positioning pin 10*b* are explained as being disposed on the mounting surface as integral members of the mounting surface so as to be separated from each other so as to protrude from the mounting surface maximum projecting portion of the mounting surface 4*a*, but if the first positioning pin 10*a* and the second positioning pin 10*b* cannot be disposed so as to protrude from the mounting surface maximum projecting portion, they may be disposed so as to protrude from the mounting surface 4*a* in a similar manner to a first preferred variation that is shown in FIG. 7 or a second preferred variation that is shown in FIG. 8 below.

First Preferred Variation

FIG. 7 is an exploded perspective of a waveguide structure according to a first preferred variation of the present invention.

In FIG. 7, a positioning mechanism 21B of a waveguide structure 1B has a configuration that is similar to that of the positioning mechanism 21A, but is configured so as to be aligned with a portion of the mounting surface 4*a* at which a gradient is gentlest. The rest of the configuration of the waveguide structure 1B is similar to that of the waveguide structure 1A.

A procedure for assembling the waveguide structure 1B is similar to the procedure for assembling the waveguide structure 1A.

Because the positioning mechanism 21B is configured so as to be aligned with a portion of the mounting surface 4*a* at which the gradient is gentlest, warping of the opening shapes of the first interfitting aperture 18*a*, the second interfitting aperture 19*a*, the third interfitting aperture 23*a*, and the fourth interfitting aperture 24*a* is also reduced when the first divided plate member 16*a* and the second divided plate member 22*a* are curved from a flat state during assembly of the waveguide structure 1B. In other words, because clearance of the diameters of the first interfitting aperture 18*a* and the third interfitting aperture 23*a*, and the second interfitting aperture 19*a* and the fourth interfitting aperture 24*a*, relative to the diameters of the first positioning pin 10*a* and the second positioning pin 10*b* can be reduced, positioning precision of the first divided plate member 16*a* and the second divided plate member 22*a* on the mounting surface 4*a* can be improved greatly.

Second Preferred Variation

FIG. 8 is an exploded perspective of a waveguide structure according to a second preferred variation of the present invention.

In FIG. 8, a positioning mechanism 21C of a waveguide structure 1C has a configuration that is similar to that of the positioning mechanism 21A, but is configured on a portion of the mounting surface 4*a* near a first edge portion in the curve direction. The rest of the configuration of the wave guide structure 1C is similar to that of the waveguide structure 1A.

According to the waveguide structure 1C, movement of the first divided plate member 16*a* and the second divided plate member 22*a* parallel to the mounting surface 4*a* during assembly can be reliably restricted by first supporting first longitudinal end portions of the first divided plate member 16*a* and the second divided plate member 22*a* using a holder 11A. Consequently, the first divided plate member 16*a* and the second divided plate member 22*a* can be deformed elastically without having to be concerned about misalignments between the members due to wobbling of the first divided plate member 16*a* and the second divided plate member 22*a* that arises as a result of clearance between the first interfitting aperture 18*a* and the first positioning pin 10*a* and between the third interfitting aperture 23*a* and the first positioning pin 10*a*, and clearance between the second interfitting aperture 19*a* and the second positioning pin 10*b*, and between the fourth interfitting aperture 24*a* and the second positioning pin 10*b*, when the first divided plate member 16*a* and the second divided plate member 22*a* are being curved. Thus, costs of the waveguide structure 1C can also be reduced with regard to assembly.

In the waveguide structures 1A through 1C, a first positioning pin 10*a* and a second positioning pin 10*b* are explained as being disposed on the mounting surface as integral members of the mounting surface so as to project from a mounting surface 4*a* of a base 2A, and a first interfitting portion 25A and a second interfitting portion 26A that fit together with the first positioning pin 10*a* and the second positioning pin 10*b* are formed on a plate member 15A. However, as described in the Third Preferred Variation, which will be explained below using FIGS. 9 and 10, a waveguide structure 1D may also be configured such that a first positioning pin 10*a* and a second positioning pin 10*b* are disposed on the mounting surface as integral members of the mounting surface so as to protrude from a second divided plate member 22*a*, and an first interfitting portion 25B and a second interfitting portion 26B that fit together with the first positioning pin 10*a* and the second positioning pin 10*b* are formed on a base 2A and a first divided plate member 16*a*.

Third Preferred Variation

Figure 9:
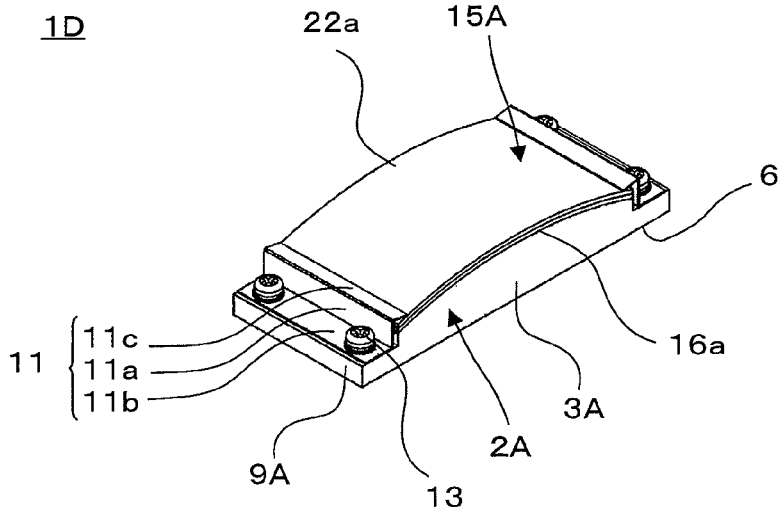
FIG. 9 is a perspective of a waveguide structure according to a third preferred variation of the present invention.
Figure 10:
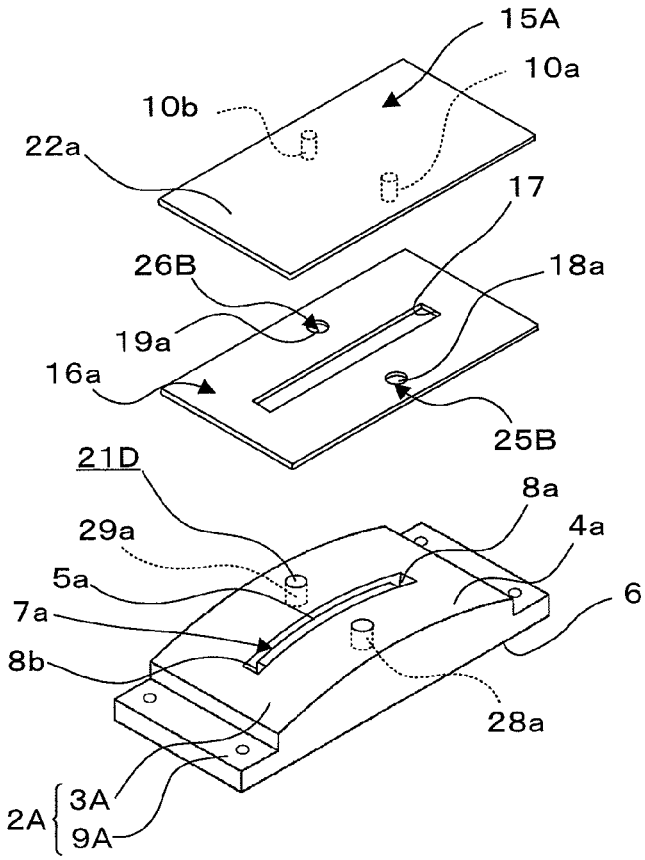
FIG. 10 is an exploded perspective of the waveguide structure according to the third preferred variation of the present invention.

FIG. 9 is a perspective of a waveguide structure according to a third preferred variation of the present invention, and FIG. 10 is an exploded perspective of the waveguide structure according to the third preferred variation of the present invention.

In FIGS. 9 and 10, a waveguide structure 1D is similar to the waveguide structure 1A except that a fifth interfitting aperture 28*a* and a sixth interfitting aperture 29*a* are formed to a predetermined depth on the main body portion 3A instead of the third interfitting aperture 23*a* and the fourth interfitting aperture 24*a* of the second divided plate member 22*a*, and a first positioning pin 10*a* and a second positioning pin 10*b* are disposed so as to project from a first surface of a second divided plate member instead of from the mounting surface 4*a*.

The first positioning pin 10*a* is inserted through a first interfitting portion 25B that is constituted by the first interfitting aperture 18*a* and the fifth interfitting aperture 28*a*, and the second positioning pin 10*b* is inserted through a second interfitting portion 26B that is constituted by the second interfitting aperture 19*a* and the sixth interfitting aperture 29*a*.

A positioning mechanism 21D is constituted by the first positioning pin 10*a*, the second positioning pin 10*b*, the first interfitting portion 25B, and the second interfitting portion 26B. Here, internal shapes of the first interfitting portion 25B and the second interfitting portion 26B approximately match external shapes of the first positioning pin 10*a* and the second positioning pin 10*b*. Consequently, the positioning mechanism 21D positions the plate member 15A at a prescribed position on the mounting surface 4*a* and also restricts movement of the plate member 15A parallel to the mounting surface 4*a* by the fitting together of the first positioning pin 10*a* and the first interfitting portion 25B, and by the fitting together of the second positioning pin 10*b* and the second interfitting portion 26B.

A procedure for assembling the waveguide structure 1D includes stacking the first divided plate member 16*a* on the mounting surface 4*a* so as to align the first interfitting aperture 18*a* and the second interfitting aperture 19*a* with the fifth interfitting aperture 28*a* and the sixth interfitting aperture 29*a*, inserting the first positioning pin 10*a* and the second positioning pin 10*b* into the first interfitting portion 25B and the second interfitting portion 26B, then curving the first divided plate member 16*a* and the second divided plate member 22*a* parallel to the mounting surface 4*a*, and is completed by holding the first divided plate member 16*a* and the second divided plate member 22*a* using holders 11A.

According to the waveguide structure 1D of the third preferred variation, the construction that presses the plate member 15A onto the mounting surface 4*a* is similar to that of the waveguide structure 1A, and the first surface of the first divided plate member 16*a* is pressed onto the mounting surface 4*a*, and the first surface of the second divided plate member 22*a* is pressed onto the second surface of the first divided plate member 16*a* by a uniformly distributed load due to the reaction forces from the first divided plate member 16*a* and from the second divided plate member 22*a*.

Consequently, the waveguide structure 1D can be configured using metal without generating gaps that communicate between internal and external portions of the waveguide 7*a*.

The waveguide structure 1D also includes: a positioning mechanism 21D that has: a first positioning pin 10*a* and a second positioning pin 10*b* that are disposed so as to project from a rear surface of the second divided plate member 22*a* at a central portion in the curve direction so as to be separated in a sweep direction; and a first interfitting portion 25B and a second interfitting portion 26B that are formed on a base 2A and a first divided plate member 16*a* of a plate member 15A so as to have internal shapes that approximately match external shapes of the first positioning pin 10*a* and the second positioning pin 10*b* and together with which the first positioning pin 10*a* and the second positioning pin 10*b* are fitted.

Thus, the first divided plate member 16*a* and the second divided plate member 22*a* can be disposed accurately at a prescribed mounting position on the mounting surface 4*a* simply by stacking the first divided plate member 16*a* on the mounting surface 4*a* and inserting the first positioning pin 10*a* and the second positioning pin 10*b* of the second divided plate member 22*a* through the first interfitting portion 25B and the second interfitting portion 26B. Because movement of the first divided plate member 16*a* and the second divided plate member 22*a* other than in an axial direction of the first positioning pin 10*a* and the second positioning pin 10*b* is restricted when the first positioning pin 10*a* and the second positioning pin 10*b* have been inserted through the first interfitting portion 25B and the second interfitting portion 26B, the work of elastically deforming the first divided plate member 16*a* and the second divided plate member 22*a* over the mounting surface 4*a* is facilitated.

Consequently, according to the waveguide structure 1D, similar effects to those of the waveguide structure 1A can be achieved.

Moreover, in this third preferred variation, the first interfitting portion 25B and the second interfitting portion 26B are explained as being constituted by each of the interfitting apertures 18*a*, 19*a*, 23*a*, 24*a*, 28*a*, and 29*a*, but a first interfitting portion and a second interfitting portion may also be constituted by notches that are formed on the first divided plate member 16*a* and the base 2A so as to have internal shapes that conform to external shapes of the above positioning pins 10*a* and 10*b* with which they are fitted together, instead of each of the interfitting apertures 18*a*, 19*a*, 23*a*, 24*a*, 28*a*, and 29*a*.

The plate member 15A of the waveguide structure 1D is explained as being constituted by a two-layer divided plate member that is constituted by the first divided plate member 16*a* and the second divided plate member 22*a*. However, the plate member 15A may also be constituted by a divided plate member that has three or more layers by stacking additional divided plate members that are similar to the first divided plate member 16*a* between the second divided plate member 22*a* and the mounting surface 4*a*, etc., or the plate member 15A may be constituted by only the second divided plate member 22*a*.

Here, if the plate member 15A of the waveguide structure 1D is constituted only by the first divided plate member 16*a*, the divided plate member that fits together with the first positioning pin 10*a* and the second positioning pin 10*b* can be eliminated, and the first positioning pin 10*a* and the second positioning pin 10*b* that are disposed on the mounting surface as integral members of the mounting surface so as to protrude from the plate member 15A fit together directly with the fifth interfitting aperture 28*a* and the sixth interfitting aperture 29*a* that are formed on the main body portion 3A.

Embodiment 2

Figure 11:
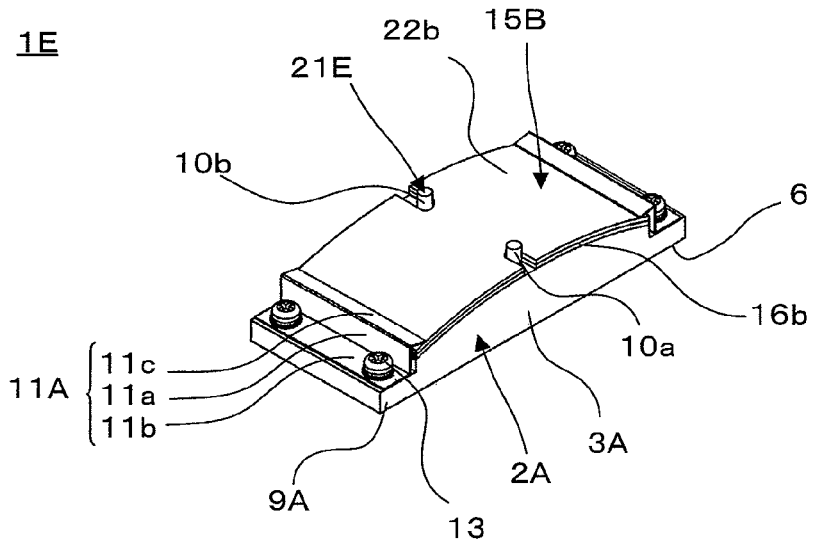
FIG. 11 is a perspective of a waveguide structure according to Embodiment 2 of the present invention.
Figure 12:
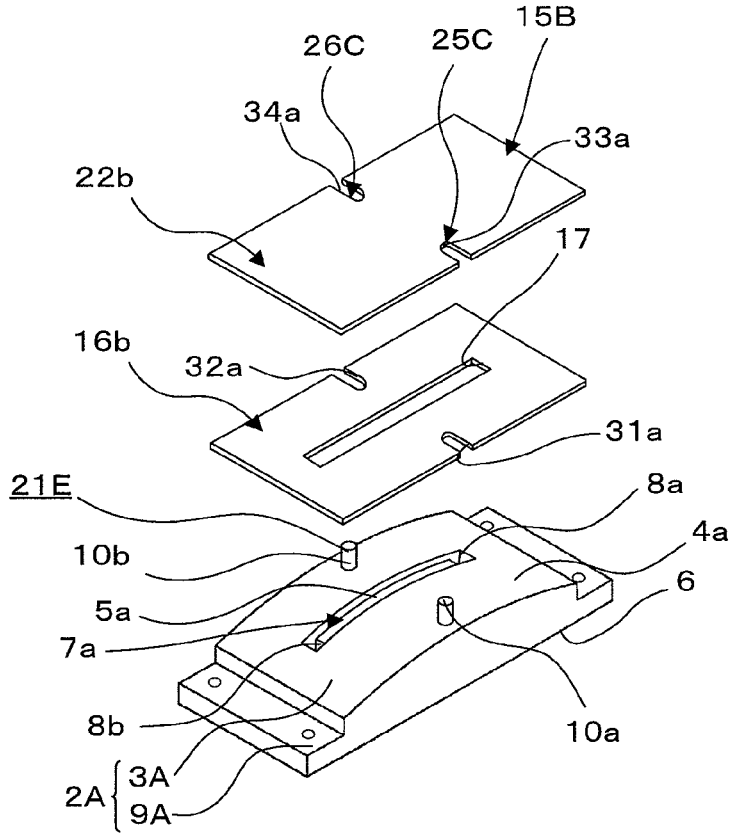
FIG. 12 is an exploded perspective of the waveguide structure according to Embodiment 2 of the present invention.
Figure 13:
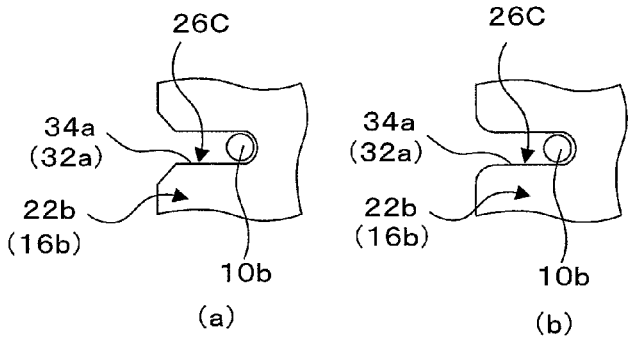
FIGS. 13A and 13B are partial front elevations of other variations of the waveguide structure according to Embodiment 2 of the present invention.

FIG. 11 is a perspective of a waveguide structure according to Embodiment 2 of the present invention, FIG. 12 is an exploded perspective of the waveguide structure according to Embodiment 2 of the present invention, and FIGS. 13A and 13B are partial front elevations of other variations of the waveguide structure according to Embodiment 2 of the present invention, FIGS. 13A and 13B showing preferred variations of the first plate member and the second plate member that have different notch shapes.

Moreover, in FIGS. 11 and 12, portions identical to or corresponding to those in Embodiment 1 above will be given identical numbering, and explanation thereof will be omitted.

In FIGS. 11 and 12, a waveguide structure 1E is configured in a similar manner to Embodiment 1 above except that a plate member 15B is used instead of the plate member 15A.

The plate member 15B includes: a first divided plate member 16*b* that is stacked on a mounting surface 4*a*; and a second divided plate member 22*b* that is stacked on the first divided plate member 16*b*. The first divided plate member 16*b* and the second divided plate member 22*b* are constituted by similar elastic metals.

The first divided plate member 16*b* is configured so as to have an approximately identical shape and similar size to those of the first divided plate member 16*a*. A first notch 31*a* and a second notch 32*a* that extend in a width direction of the first divided plate member 16*b* are formed so as to have a predetermined width and a predetermined depth on the first divided plate member 16*b* so as to have openings at intermediate portions in the longitudinal direction of two long sides thereof.

The second divided plate member 22*b* is configured so as to have an approximately identical shape and similar size to those of the second divided plate member 22*a*. A third notch 33*a* and a fourth notch 34*a* that extend in a width direction of the second divided plate member 22*b* are formed so as to have a predetermined width and a predetermined depth on the second divided plate member 22*b* so as to have openings at intermediate portions in the longitudinal direction of two long sides thereof.

Moreover, a width of the first through fourth notches 34*a* through 31*a* is slightly larger than a diameter of the first positioning pin 10*a* and the second positioning pin 10*b*. In other words, the width of the first through fourth notches 31*a* through 34*a* is formed so as to correspond to a length of the first positioning pin 10*a* and the second positioning pin 10*b* in the curve direction.

The first divided plate member 16*b* is stacked on the mounting surface 4*a* such that a first surface thereof faces the mounting surface 4*a* in a state in which the first positioning pin 10*a* and the second positioning pin 10*b* are inserted through the first notch 31*a* and the second notch 32*a*.

In addition, the second divided plate member 22*b* is stacked on the first divided plate member 16*b* such that a first surface thereof faces a second surface of the first divided plate member 16*b* in a state in which the first positioning pin 10*a* and the second positioning pin 10*b* are inserted through the third notch 33*a* and the fourth notch 34*a*.

Here, internal shapes of the first through fourth notches 34*a* through 31*a* conform to external shapes of the first positioning pin 10*a* and the second positioning pin 10*b*. In other words, depths of the first and third notches 31*a* and 33*a* and depths of the second and fourth notches 32*a* and 34*a* are set such that the first positioning pin 10*a* and the second positioning pin 10*b* face floor portions of the first through fourth notches 34*a* through 31*a* practically without leaving gaps.

The positioning mechanism 21E is constituted by the first positioning pin 10*a*, the second positioning pin 10*b*, a first interfitting portion 25C, which is constituted by the first notch 31*a* and the third notch 33*a*, and a second interfitting portion 26C, which is constituted by the second notch 32*a* and the fourth notch 34*a*.

Here, diameters of the first positioning pin 10*a* and the second positioning pin 10*b* are approximately equal to the widths of each of the notches 31*a* through 34*a*. Consequently, the positioning mechanism 21E positions the plate member 15B at a prescribed position on the mounting surface 4*a* and also restricts movement of the plate member 15B parallel to the mounting surface 4*a* by the fitting together of the first positioning pin 10*a* and the first interfitting portion 25C, and by the fitting together of the second positioning pin 10*b* and the second interfitting portion 26C.

The plate member 15B is held in a curved state so as to be placed in close contact with the mounting surface 4*a* by pressing forces from holders 11A.

Moreover, the plate member 15B being placed in close contact with the mounting surface 4*a* means that not only the first divided plate member 16*b* and the mounting surface 4*a* but also the first divided plate member 16*b* and the second divided plate member 22*b* are placed in close contact.

A procedure for assembling the waveguide structure 1E is similar to that of Embodiment 1 except that the first divided plate member 16*b* and the second divided plate member 22*b* are stacked onto the mounting surface 4*a* sequentially such that the first positioning pin 10*a* and the second positioning pin 10*b* are aligned with the first notch 31*a* and the third notch 33*a* and with the second notch 32*a* and the fourth notch 34*a*.

In a waveguide structure 1E that has been configured as described above, the construction that presses the plate member 15B onto the mounting surface 4*a* is similar to that of the waveguide structure 1A, and the first surface of the first divided plate member 16*b* is pressed onto the mounting surface 4*a*, and the first surface of the second divided plate member 22*b* is pressed onto the second surface of the first divided plate member 16*b* by a uniformly distributed load due to the reaction forces from the first divided plate member 16*b* and from the second divided plate member 22*b*.

Consequently, the waveguide structure 1E can be configured using metal without generating gaps that communicate between internal and external portions of the waveguide 7*a*.

The first divided plate member 16*b* and the second divided plate member 22*b* can be disposed accurately at a predetermined mounting position on the mounting surface 4*a* simply by inserting the first positioning pin 10*a* and the second positioning pin 10*b* through the first notch 31*a* and the second notch 32*a*, and through the third notch 33*a* and the fourth notch 34*a*, when stacking the first divided plate member 16*b* and the second divided plate member 22*b* on the mounting surface 4*a*. Movement of the first divided plate member 16*b* and the second divided plate member 22*b* is also restricted except in the axial direction of the first positioning pin 10*a* and the second positioning pin 10*b*.

Consequently, according to Embodiment 2, similar effects to those in Embodiment 1 above can be achieved.

Moreover, the widths of the above first through fourth notches 34*a* through 31*a* are explained as being slightly larger than lengths of the first positioning pin 10*a* and the second positioning pin 10*b* in the curve direction, but opening end corner portions of the second notch 32*a* and the fourth notch 34*a* may also be relieved by forming opening ends so as to have a tapered shape so as to become gradually wider toward the opening ends, or by machining the opening end corner portions so as to have a rounded shape, as shown in FIGS. 13A and 13B. Although not shown, opening ends of the first notch 31*a* and the third notch 33*a* may be also relieved in a similar manner.

By adopting a configuration of this kind, each of the notches 31*a* through 34*a* of the first divided plate member 16*b* and the second divided plate member 22*b* can be prevented from catching on members such as the first positioning pin 10*a* and the second positioning pin 10*b*, etc., as the first divided plate member 16*b* and the second divided plate member 22*b* are moved from predetermined places when performing an assembly operation for the waveguide structure 1E. In other words, large stresses can be prevented from acting on the first divided plate member 16*b* and the second divided plate member 22*b* that would plastically deform the first divided plate member 16*b* and the second divided plate member 22*b*.

Thus, because gaps are prevented from arising between internal and external portions the waveguides 7*a* due to a plastically deformed first divided plate member 16*b* or second divided plate member 22*b* being stacked on the mounting surface 4*a*, reliability of propagation of high frequency signals is further improved by using the waveguide structure 1E.

Embodiment 3

Figure 14:
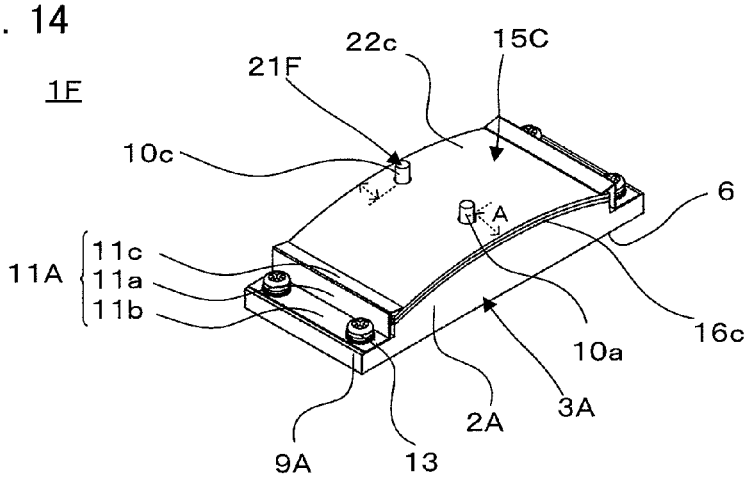
FIG. 14 is a perspective of a waveguide structure according to Embodiment 3 of the present invention.
Figure 15:
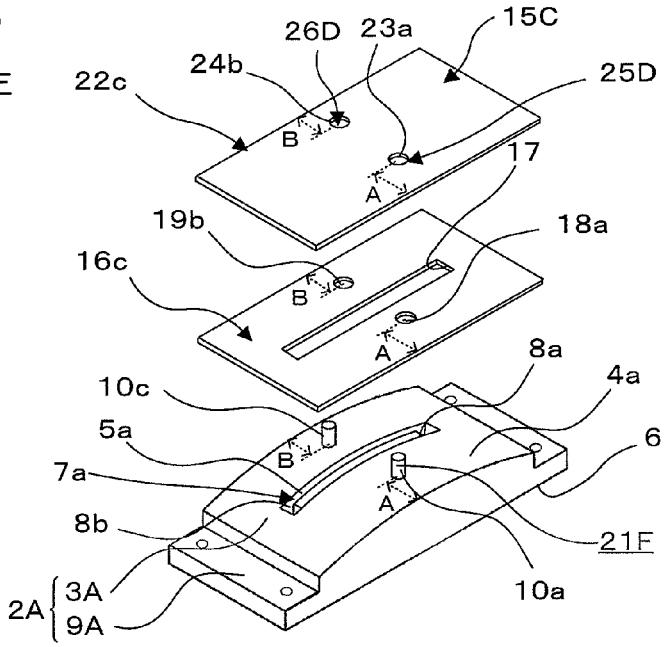
FIG. 15 is an exploded perspective of the waveguide structure according to Embodiment 3 of the present invention.
Figure 16:
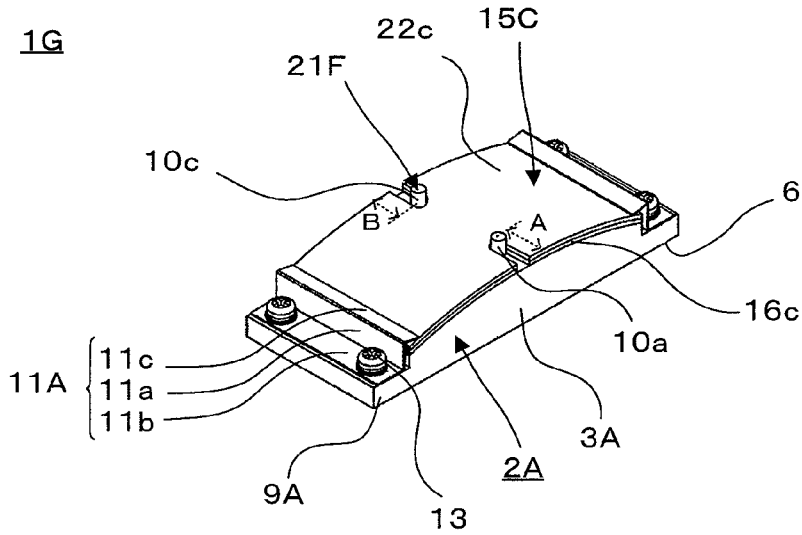
FIG. 16 is a perspective of another variation of the waveguide structure according to Embodiment 3 of the present invention.
Figure 17:
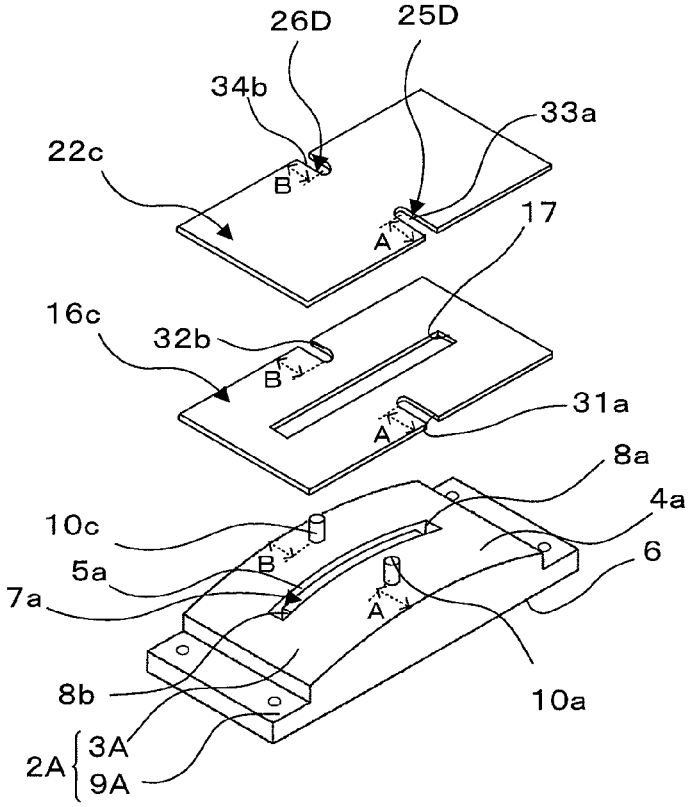
FIG. 17 is an exploded perspective of the other variation of the wave guide structure according to Embodiment 3 of the present invention.

FIG. 14 is a perspective of a waveguide structure according to Embodiment 3 of the present invention, FIG. 15 is an exploded perspective of the waveguide structure according to Embodiment 3 of the present invention, FIG. 16 is a perspective of another variation of the waveguide structure according to Embodiment 3 of the present invention, and FIG. 17 is an exploded perspective of the other variation of the waveguide structure according to Embodiment 3 of the present invention.

Moreover, in FIGS. 14 through 17, portions identical to or corresponding to those in Embodiment 1 above will be given identical numbering, and explanation thereof will be omitted.

In FIGS. 14 and 15, a waveguide structure 1F is configured in a similar manner to Embodiment 1 above except that a second positioning pin 10*c* that functions as a positioning member is used instead of the second positioning pin 10*b*, and a plate member 15C is used instead of the plate member 15A.

The first positioning pin 10*a* is disposed so as to project from a portion of the mounting surface maximum projecting portion that is separated by a first distance A from a first edge portion in the sweep direction of the mounting surface 4*a*, as described above. The second positioning pin 10*c* is disposed so as to project from a portion of the mounting surface maximum projecting portion that is separated by a second distance B from a second edge portion in the sweep direction of the mounting surface 4*a*. In other words, the first positioning pin 10*a* and the second positioning pin 10*c* are disposed on opposite sides of center in the sweep direction so as to be asymmetrical relative to the center in the sweep direction.

The plate member 15C includes: a first divided plate member 16*c* that is stacked on a mounting surface 4*a*; and a second divided plate member 22*c* that is stacked on the first divided plate member 16*c*.

The first divided plate member 16*c* is configured in a similar manner to the first divided plate member 16*a* except that a second interfitting aperture 19*b* is formed instead of the second interfitting aperture 19*a*. Moreover, the second interfitting aperture 19*b* is formed on a portion of the first divided plate member 16*c* at a longitudinal center of the first divided plate member 16*c*, and separated by a second distance B from a second long side.

The second divided plate member 22*c* is configured in a similar manner to the second divided plate member 22*a* except that a fourth interfitting aperture 24*b* is formed instead of the fourth interfitting aperture 24*a*. Moreover, the fourth interfitting aperture 24*b* is formed on a portion of the second divided plate member 22*c* at a longitudinal center of the second divided plate member 22*c*, and separated by a second distance B from a second long side.

The first divided plate member 16*c* is stacked on the mounting surface 4*a* such that a first surface thereof faces the mounting surface 4*a* in a state in which the first positioning pin 10*a* and the second positioning pin 10*c* are inserted through the first interfitting aperture 18*a* and the second interfitting aperture 19*b*.

In addition, the second divided plate member 22*c* is stacked on the first divided plate member 16*c* such that a first surface thereof faces the first divided plate member 16*c* in a state in which the first positioning pin 10*a* and the second positioning pin 10*c* are inserted through the third interfitting aperture 23*a* and the fourth interfitting aperture 24*b*.

The positioning mechanism 21F is constituted by the first positioning pin 10*a*, the second positioning pin 10*c*, the first interfitting portion 25D, which is constituted by the first interfitting aperture 18*a* and the third interfitting aperture 23*a*, and the second interfitting portion 26D, which is constituted by the second interfitting aperture 19*b* and the fourth interfitting aperture 24*b*. Here, diameters of the first positioning pin 10*a* and the second positioning pin 10*c* are approximately equal to diameters of each of the interfitting apertures. Consequently, the positioning mechanism 21F positions the plate member 15C at a prescribed position on the mounting surface 4*a* and also restricts movement of the plate member 15C parallel to the mounting surface 4*a* by the fitting together of the first positioning pin 10*a* and the first interfitting portion 25D, and by the fitting together of the second positioning pin 10*c* and the second interfitting portion 26D.

The plate member 15C is held in a curved state so as to be placed in close contact with the mounting surface 4*a* by pressing forces from holders 11A.

A procedure for assembling the waveguide structure 1F is similar to that of Embodiment 1 except that the first divided plate member 16*c* and the second divided plate member 22*c* are stacked on the mounting surface 4*a* such that the first interfitting aperture 18*a* and the third interfitting aperture 23*a* are aligned with the first positioning pin 10*a*, and the second interfitting aperture 19*b* and the fourth interfitting aperture 24*b* are aligned with the second positioning pin 10*c*.

According to Embodiment 3, the first divided plate member 16*c* and the second divided plate member 22*c* can be disposed accurately at a prescribed position on the mounting surface 4*a* in a similar manner to Embodiment 1 simply by inserting the first positioning pin 10*a* and the second positioning pin 10*c* through the first interfitting aperture 18*a* and the second interfitting aperture 19*b*, and through the third interfitting aperture 23*a* and the fourth interfitting aperture 24*b*, when stacking the first divided plate member 16*c* and the second divided plate member 22*c* on the mounting surface 4*a*.

Moreover, the first positioning pin 10*a* and the second positioning pin 10*c* are disposed on opposite sides of center in the sweep direction so as to be asymmetrical relative to the center in the sweep direction.

Thus, when the first long sides and the second long sides of the first divided plate member 16*c* and the second divided plate member 22*c* are in positional relationships that are opposite to normal relative to the first and second long sides of the mounting surface 4*a*, the first positioning pin 10*a* and the second positioning pin 10*c* cannot be inserted through the first interfitting aperture 18*a* and the third interfitting aperture 23*a*, and through the second interfitting aperture 19*b* and the fourth interfitting aperture 24*b*.

In other words, the first divided plate member 16*c* and the second divided plate member 22*c* can be disposed on the mounting surface 4*a* only if the first divided plate member 16*c* and the second divided plate member 22*c* are aligned in a normal position relative to the mounting surface 4*a*, preventing workers from mounting the first divided plate member 16*c* and the second divided plate member 22*c* to the base 2A in an incorrect orientation.

Moreover, in the waveguide structure 1F according to Embodiment 3, the first interfitting portion 25D and the second interfitting portion 26D through which the first positioning pin 10*a* and the second positioning pin 10*c* are inserted are explained as being interfitting apertures that have an aperture shape that is circular. However, the first interfitting portion and the second interfitting portion are not limited to this shape, and as shown in FIG. 16 and FIG. 17, a waveguide structure 1G may also be configured such that a first notch 31*a* and a second notch 32*b* are formed on the first divided plate member 16*c* instead of the first interfitting aperture 18*a* and the second interfitting aperture 19*b*, and a third notch 33*a* and a fourth notch 34*b* are formed on the second divided plate member 22*c* instead of the third interfitting aperture 23*a* and the fourth interfitting aperture 24*b*. In that case, depth of the first notch 31*a* and the third notch 33*a* should be set so as to allow for the first distance A and a radius of the first positioning pin 10*a*, and depth of the second notch 32*b* and the fourth notch 34*b* should be set so as to allow for the second distance B and a radius of the second positioning pin 10*c*. Similar effects to those of the waveguide structure 1F can be also achieved by a waveguide structure 1G that is configured in this manner.

Embodiment 4

Figure 18:
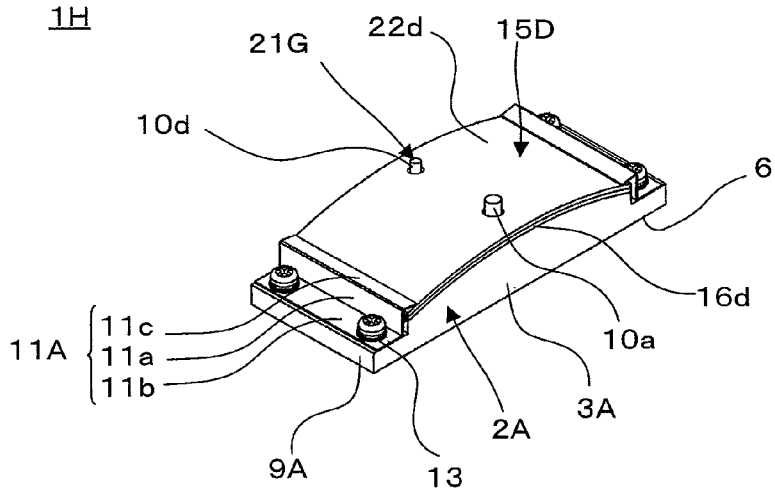
FIG. 18 is a perspective of a waveguide structure according to Embodiment 4 of the present invention.
Figure 19:
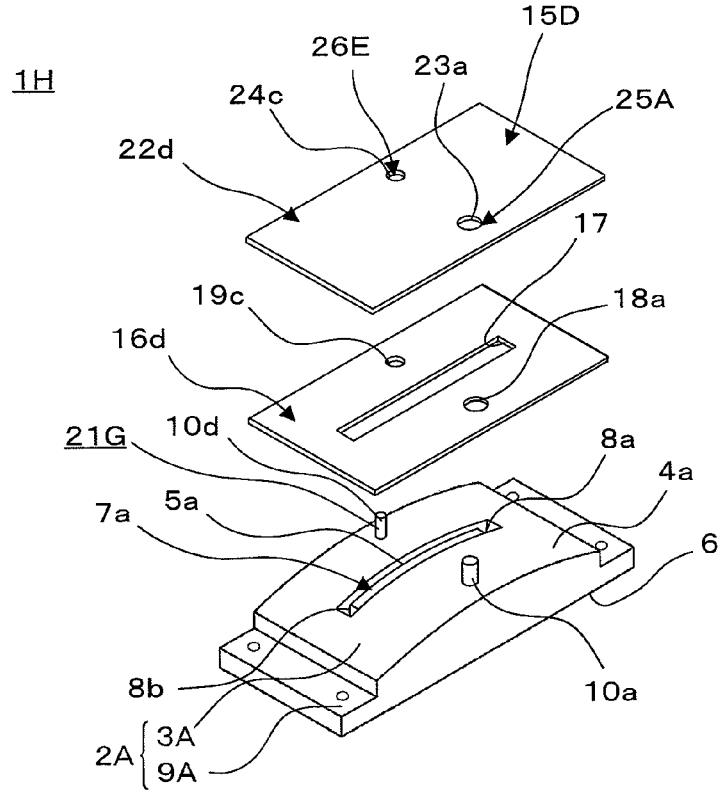
FIG. 19 is an exploded perspective of the waveguide structure according to Embodiment 4 of the present invention.

FIG. 18 is a perspective of a waveguide structure according to Embodiment 4 of the present invention, and FIG. 19 is an exploded perspective of the waveguide structure according to Embodiment 4 of the present invention.

Moreover, in FIGS. 18 and 19, portions identical to or corresponding to those in Embodiment 1 above will be given identical numbering, and explanation thereof will be omitted.

In FIGS. 18 and 19, a waveguide structure 1H is configured in a similar manner to Embodiment 1 above except that a second positioning pin 10*d* is disposed so as to project from the mounting surface 4*a* instead of the second positioning pin 10*b*, and a plate member 15D is used instead of the plate member 15A.

The second positioning pin 10*d* has a circular external shape, and has a smaller diameter than that of the second positioning pin 10*b*, and the diameters of the second positioning pin 10*d* and the first positioning pin 10*a* are different from each other.

The plate member 15D includes: a first divided plate member 16*d* that is stacked on a mounting surface 4*a*; and a second divided plate member 22*d* that is stacked on the first divided plate member 16*d*.

The first divided plate member 16*d* is configured in a similar manner to the first divided plate member 16*a* of the waveguide structure 1A except that a second interfitting aperture 19*c* that has an internal shape that approximately matches an external shape of the second positioning pin 10*d* is formed instead of the second interfitting aperture 19*a*.

The second divided plate member 22*d* is configured in a similar manner to the second divided plate member 22*a* of the waveguide structure 1A except that a fourth interfitting aperture 24*b* that has an internal shape that approximately matches the external shape of the second positioning pin 10*d* is formed instead of the fourth interfitting aperture 24*a*.

The first divided plate member 16*d* is stacked on the mounting surface 4*a* such that a first surface thereof faces the mounting surface 4*a* in a state in which the first positioning pin 10*a* and the second positioning pin 10*d* are inserted through the first interfitting aperture 18*a* and the second interfitting aperture 19*c*. In addition, the second divided plate member 22*d* is stacked on the first divided plate member 16*d* such that a first surface thereof faces the first divided plate member 16*d* in a state in which the first positioning pin 10*a* and the second positioning pin 10*d* are inserted through the third interfitting aperture 23*a* and the fourth interfitting aperture 24*c*.

The positioning mechanism 21G is constituted by the first positioning pin 10*a*, the second positioning pin 10*d*, the first interfitting portion 25A, and the second interfitting portion 26E, which is constituted by the second interfitting aperture 19*c* and the fourth interfitting aperture 24*c*. Here, a diameter of the first positioning pin 10*a* approximately matches diameters of the first interfitting aperture 18*a* and the third interfitting aperture 23*a*, and a diameter of the second positioning pin 10*d* approximately matches diameters of the second interfitting aperture 19*c* and the fourth interfitting aperture 24*c*. Consequently, the positioning mechanism 21G positions the plate member 15D at a prescribed position on the mounting surface 4*a* and also restricts movement parallel to the mounting surface 4*a* by the fitting together of the first positioning pin 10*a* and the first interfitting portion 25A and the second positioning pin 10*d* and the second interfitting portion 26E.

The plate member 15D is held in a curved state so as to be placed in close contact with the mounting surface 4*a* by pressing forces from holders 11A.

A procedure for assembling the waveguide structure 1H is similar to that of Embodiment 1 except that the second interfitting aperture 19*c* and the fourth interfitting aperture 24*c* are aligned with the second positioning pin 10*d*.

According to Embodiment 4, the first divided plate member 16*d* and the second divided plate member 22*d* can be disposed accurately at a prescribed position on the mounting surface 4*a* in a similar manner to Embodiment 1 simply by inserting the first positioning pin 10*a* and the second positioning pin 10*d* through the first interfitting aperture 18*a* and the second interfitting aperture 19*c*, and through the third interfitting aperture 23*a* and the fourth interfitting aperture 24*c*, when stacking the first divided plate member 16*d* and the second divided plate member 22*d* on the mounting surface 4*a*.

Moreover, the first positioning pin 10*a* and the second positioning pin 10*d* are configured so as to have different diameters (shapes). In addition, the internal shape of the first interfitting portion 25A corresponds to the external shape of the first positioning pin 10*a*, and the internal shape of the second interfitting portion 26E corresponds to the external shape of the second positioning pin 10*d*.

Thus, when the first and second long sides of the first divided plate member 16*d* and the second divided plate member 22*d* are in positional relationships that are opposite to normal relative to the first and second edge portions of the mounting surface 4*a* in the sweep direction, the first positioning pin 10*a* and the second positioning pin 10*d* cannot be inserted through the first divided plate member 16*d* and the second divided plate member 22*d*. In other words, the first positioning pin 10*a* can be inserted through the first interfitting aperture 18*a* and the third interfitting aperture 23*a*, the second positioning pin 10*d* can be inserted through the second interfitting aperture 19*c* and the fourth interfitting aperture 24*c*, and the first divided plate member 16*d* and the second divided plate member 22*d* can be disposed on the mounting surface 4*a* only if the first divided plate member 16*d* and the second divided plate member 22*d* are aligned correctly relative to the mounting surface 4*a*. Consequently, the first divided plate member 16*d* and the second divided plate member 22*d* can be prevented in advance from being mounted to the base 2A in an incorrect orientation.

Now, even in a positioning mechanism that is configured using positioning pins that have identical diameters that are disposed on the mounting surface as integral members of the mounting surface so as to protrude from the mounting surface 4*a* so as to be offset in position in the curve direction of the mounting surface 4*a*, and interfitting apertures that are formed on portions of the first divided plate member and the second divided plate member that correspond to each of the positioning pins, the first divided plate member and the second divided plate member can be stacked on the mounting surface 4*a* without making a mistake in the orientations of the first divided plate member and the second divided plate member. If the position of the pair of positioning pins is offset in the curve direction, it is necessary for diameters of the interfitting apertures of the first divided plate member and the second divided plate member to have a larger clearance relative to diameters of the positioning pins that fit together with them.

The waveguide structure 1H according to Embodiment 4 is effective when the first positioning pin 10*a* and the second positioning pin 10*d* are disposed on the mounting surface as integral members of the mounting surface so as to protrude from a predetermined position in the curve direction of the mounting surface 4*a*, and neither of the positioning pins can be disposed so as to protrude from a position that is offset in the curve direction. Clearance between the first interfitting portion 25A and the first positioning pin 10*a*, and clearance between the second interfitting portion 26E and the second positioning pin 10*d* can be set to a required minimum. In other words, in the waveguide structure 1H, the first divided plate member 16*d* and the second divided plate member 22*d* can be prevented from being stacked on the mounting surface 4*a* in an incorrect orientation while ensuring positioning precision of the first divided plate member 16*d* and the second divided plate member 22*d* at the prescribed position on the mounting surface 4*a*.

Embodiment 5

Figure 20:
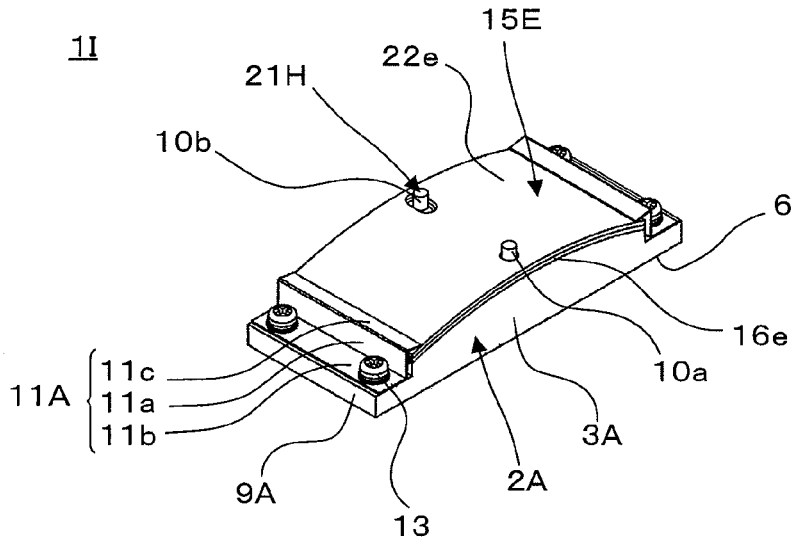
FIG. 20 is a perspective of a waveguide structure according to Embodiment 5 of the present invention.
Figure 21:
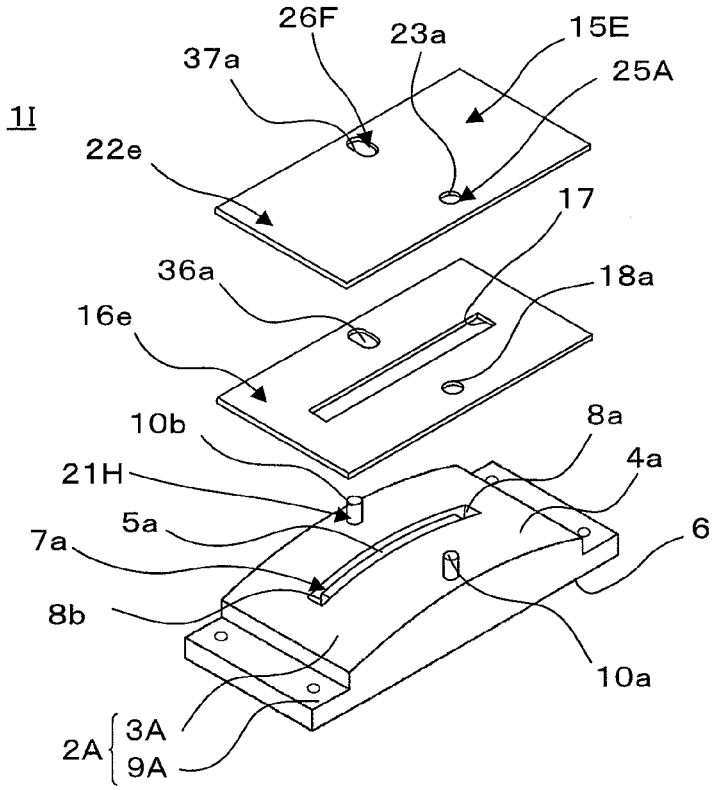
FIG. 21 is an exploded perspective of the waveguide structure according to Embodiment 5 of the present invention.
Figure 22:
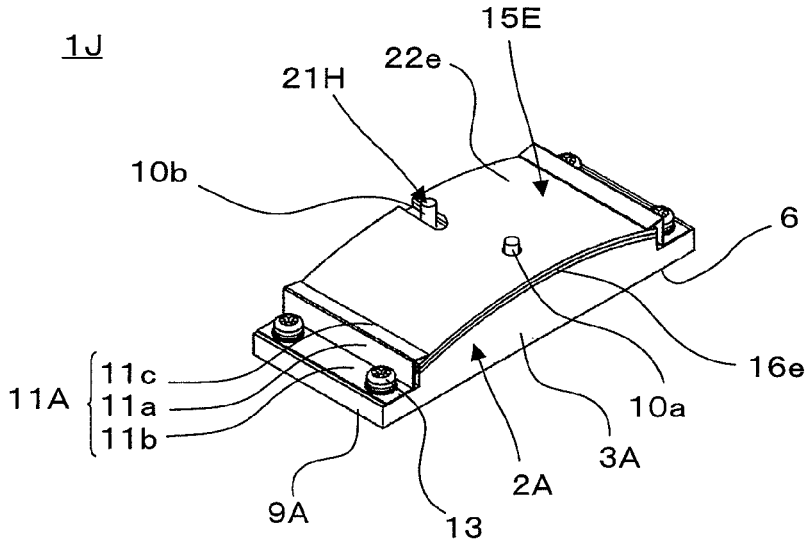
FIG. 22 is a perspective of another variation of the waveguide structure according to Embodiment 5 of the present invention.
Figure 23:
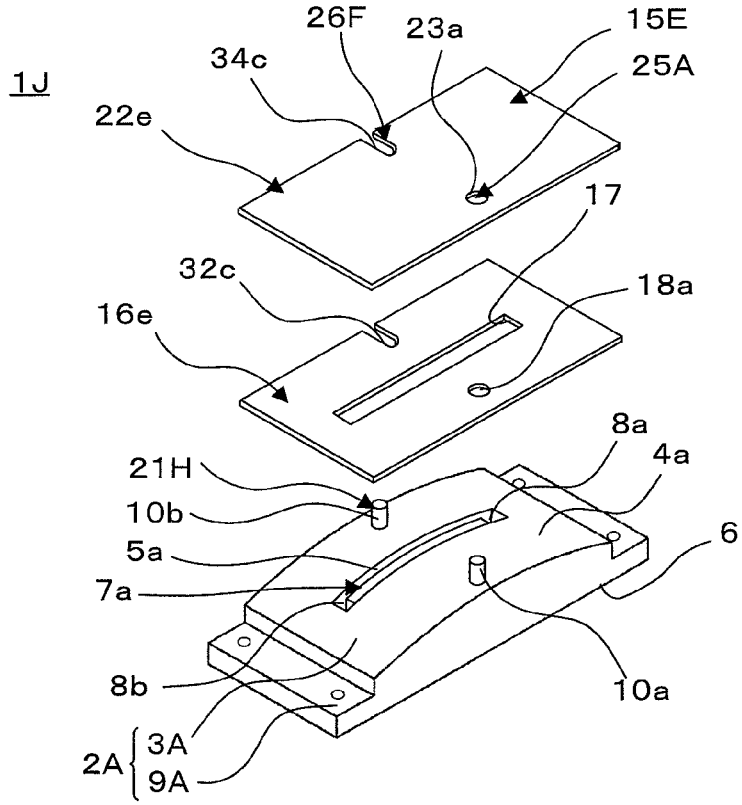
FIG. 23 is an exploded perspective of the other variation of the wave guide structure according to Embodiment 5 of the present invention.
Figure 24:
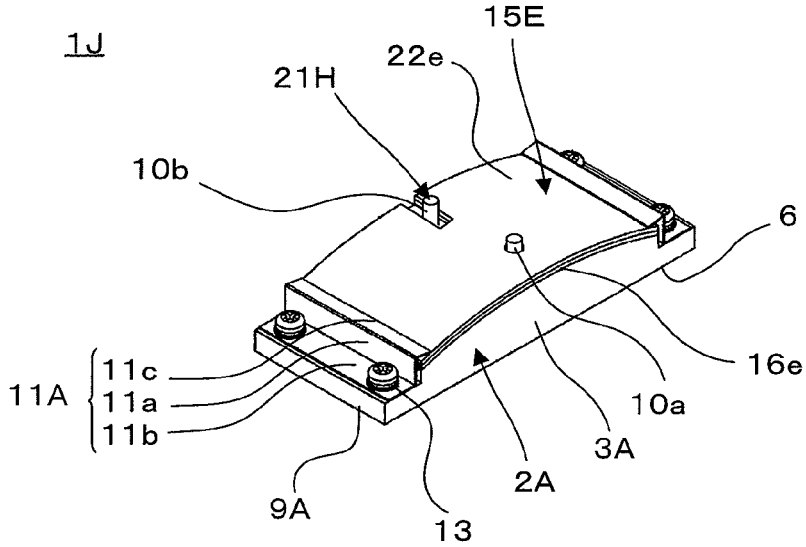
FIG. 24 is a perspective of yet another variation of the waveguide structure according to Embodiment 5 of the present invention.
Figure 25:
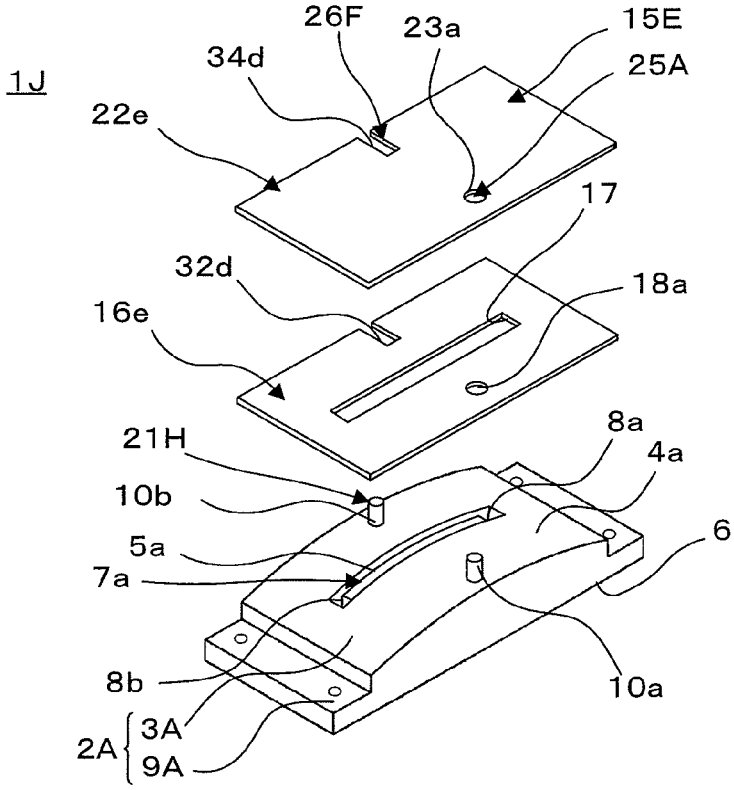
FIG. 25 is an exploded perspective of that other variation of the wave guide structure according to Embodiment 5 of the present invention.

FIG. 20 is a perspective of a waveguide structure according to Embodiment 5 of the present invention, and FIG. 21 is an exploded perspective of the waveguide structure according to Embodiment 5 of the present invention. FIG. 22 is a perspective of another variation of the waveguide structure according to Embodiment 5 of the present invention, and FIG. 23 is an exploded perspective of the other variation of the waveguide structure according to Embodiment 5 of the present invention. FIG. 24 is a perspective of yet another variation of the waveguide structure according to Embodiment 5 of the present invention, and FIG. 25 is an exploded perspective of that other variation of the waveguide structure according to Embodiment 5 of the present invention.

Moreover, in FIGS. 20 through 25, portions identical to or corresponding to those in Embodiment 1 above will be given identical numbering, and explanation thereof will be omitted.

In FIGS. 20 and 21, a waveguide structure 1I is configured in a similar manner to Embodiment 1 above except that a plate member 15E is used instead of the plate member 15A.

The plate member 15E includes: a first divided plate member 16*e* that is stacked on a mounting surface 4*a*; and a second divided plate member 22*e* that is stacked on the first divided plate member 16*e*.

The first divided plate member 16*e* is similar in configuration to the first divided plate member 16*a* of the waveguide structure 1A except that a slot-shaped second interfitting aperture 36*a* is formed instead of the second interfitting aperture 19*a*.

The second divided plate member 22*e* is similar in configuration to the second divided plate member 22*a* of the waveguide structure 1A except that a slot-shaped fourth interfitting aperture 24*b* is formed instead of the fourth interfitting aperture 24*a*.

The second interfitting aperture 36*a* and the fourth interfitting aperture 37*a* are formed such that major axes are oriented in a width direction of the first divided plate member 16*e* and the second divided plate member 22*e*.

Minor axial lengths of the second interfitting aperture 36*a* and the fourth interfitting aperture 37*a* are slightly longer than a diameter of the second positioning pin 10*b* when the curved first divided plate member 16*e* and second divided plate member 22*e* are viewed from a direction that faces their respective major surfaces. In other words, the minor axial lengths of the second interfitting aperture 36*a* and the fourth interfitting aperture 37*a* are set so as to correspond to a length of the second positioning pin 10*b* in the curve direction.

Major axial lengths of the second interfitting aperture 36*a* and the fourth interfitting aperture 37*a* are determined with consideration for an amount of permissible drift in the distance between the first interfitting aperture 18*a* and the second interfitting aperture 36*a* from a design perspective, an amount of permissible drift in the distance between the third interfitting aperture 23*a* and the fourth interfitting aperture 37*a* from a design perspective, an amount of relative drift in the first divided plate member 16*e* and the second divided plate member 22*e* relative to each of the positioning pins 10*a* and 10*b* allowing for age-related changes, and an amount of relative drift in the first divided plate member 16*e* and the second divided plate member 22*e* relative to each of the positioning pins 10*a* and 10*b* allowing for differences in coefficient of linear expansion if the first divided plate member 16*e* and the second divided plate member 22*e* are constituted by different metals.

The first divided plate member 16*e* is stacked on the mounting surface 4*a* such that a first surface thereof faces the mounting surface 4*a* in a state in which the first positioning pin 10*a* and the second positioning pin 10*b* are inserted through the first interfitting aperture 18*a* and the second interfitting aperture 36*a*.

In addition, the second divided plate member 22*e* is stacked on the first divided plate member 16*e* such that a first surface thereof faces the first divided plate member 16*e* in a state in which the first positioning pin 10*a* and the second positioning pin 10*b* are inserted through the third interfitting aperture 23*a* and the fourth interfitting aperture 37*a*.

The positioning mechanism 21H is constituted by the first positioning pin 10*a*, the second positioning pin 10*b*, the first interfitting portion 25A, and the second interfitting portion 26F, which is constituted by the second interfitting aperture 36*a* and the fourth interfitting aperture 37*a*.

Here, because the diameters of the first interfitting aperture 18*a* and the third interfitting aperture 23*a* are approximately equal to the diameter of the first positioning pin 10*a*, movement of the first divided plate member 16*e* and the second divided plate member 22*e* is restricted other than in the circumferential direction and the axial direction of the first positioning pin 10*a*. In addition, the minor axial lengths of the second interfitting aperture 36*a* and the fourth interfitting aperture 37*a* are approximately equal to the diameter of the second positioning pin 10*b*. Thus, the positioning mechanism 21H positions the plate member 15E at a prescribed position on the mounting surface 4*a* and also restricts movement of the plate member 15E parallel to the mounting surface 4*a* by the fitting together of the first positioning pin 10*a* and the first interfitting portion 25A, and by the fitting together of the second positioning pin 10*b* and the second interfitting portion 26F.

Moreover, the second interfitting aperture 36*a* and the fourth interfitting aperture 37*a* are for the purpose of restricting rotation of the first divided plate member 16*e* and the second divided plate member 22*e* around an axis of the first positioning pin 10*a*, and do not particularly require major axial length precision provided that management of minor axial length precision is performed.

The plate member 15E is held in a curved state so as to be placed in close contact with the mounting surface 4*a* by pressing forces from holders 11A.

In an initial state of the waveguide structure 1I, predetermined gaps or greater are formed between the second interfitting aperture 36*a* and the second positioning pin 10*b* and between the fourth interfitting aperture 37*a* and the second positioning pin 10*b* on the major axis of the second interfitting aperture 36*a* and the fourth interfitting aperture 37*a*. The second positioning pin 10*b* can thereby be prevented from colliding with the first divided plate member 16*e* and the second divided plate member 22*e* even if relative drift arises between the second positioning pin 10*b* and the first divided plate member 16*e* and between the second positioning pin 10*b* and the second divided plate member 22*e* as a result of differences in coefficient of linear expansion between the members and age-related changes.

A procedure for assembling the waveguide structure 1I is similar to that of Embodiment 1 except that the first divided plate member 16*e* and the second divided plate member 22*e* are stacked onto the mounting surface 4*a* sequentially such that the second positioning pin 10*b* is aligned with the second interfitting aperture 36*a* and the fourth interfitting aperture 37*a*.

According to Embodiment 5, the first divided plate member 16*e* and the second divided plate member 22*e* can be disposed accurately at a prescribed mounting position on the mounting surface 4*a* by disposing the first divided plate member 16*e* and the second divided plate member 22*e* so as to insert the first positioning pin 10*a* through the first interfitting aperture 18*a* and the third interfitting aperture 23*a* and insert the second positioning pin 10*b* through the second interfitting aperture 36*a* and the fourth interfitting aperture 24*b*, when stacking the first divided plate member 16*e* and the second divided plate member 22*e* on the mounting surface 4*a*.

Moreover, by using a configuration in which the second positioning pin 10*b* is inserted through the second interfitting aperture 36*a* and the fourth interfitting aperture 37*a*, it is possible to insert the first positioning pin 10*a* and the second positioning pin 10*b* through the first interfitting aperture 18*a* and the third interfitting aperture 23*a* and the second interfitting aperture 36*a* and the fourth interfitting aperture 37*a* without any problem even if processing deviations arise relative to the major axis of the second interfitting aperture 36*a*, for example, in the distances between the first positioning pin 10*a* and the second positioning pin 10*b*, between the first interfitting aperture 18*a* and the second interfitting aperture 36*a*, and between the third interfitting aperture 23*a* and the fourth interfitting aperture 37*a*. In other words, it becomes possible to support the first divided plate member 16*e* and the second divided plate member 22*e* on the base 2A such that neither the first positioning pin 10*a* and the first interfitting aperture 18*a* or the third interfitting aperture 23*a* nor the second positioning pin 10*b* and the second interfitting aperture 36*a* or the fourth interfitting aperture 37*a* will press on each other.

If, due to differences in coefficient of linear expansion of the base 2A, the first divided plate member 16*e*, and the second divided plate member 22*e*, or age-related changes, etc., each of the members expands or contracts, the first divided plate member 16*e* and the second divided plate member 22*e* will expand and contract relative to the interfitting portion of the first positioning pin 10*a*. Here, if the first positioning pin 10*a* and the first interfitting aperture 18*a* drift from each other by a distance D along the minor axis of the second interfitting aperture 36*a*, for example, minor axial drift between the second positioning pin 10*b* and the second interfitting aperture 36*a* will also be the distance D. However, if the first positioning pin 10*a* and the first interfitting aperture 18*a* drift along the major axis of the second interfitting aperture 36*a* by a distance D, the amount of relative drift on the major axis between the second positioning pin 10*b* and the second interfitting aperture 36*a* will be greater than the distance D in proportion to the distance between the first interfitting aperture 18*a* and the second interfitting aperture 36*a*. Moreover, relative drift along the major axis between the second positioning pin 10*b* and the fourth interfitting aperture 37*a* is also similar.

In the waveguide structure 1I, large gaps are formed in advance on first and second major axial sides of the second positioning pin 10*b*. Consequently, even if the relative positional relationship in the major axis between the second positioning pin 10*b* and the second interfitting aperture 36*a* or the fourth interfitting aperture 37*a* drifts significantly as a result of differences in coefficient of linear expansion of the base 2A, the first divided plate member 16*e*, and the second divided plate member 22*e*, or age-related changes, etc., the second positioning pin 10*b* will not collide into the walls at the first and second major axial ends of the second interfitting aperture 36*a* or the fourth interfitting aperture 37*a* due to that drift. Large pressing forces can thereby be prevented from arising between the second positioning pin 10*b* and the second interfitting aperture 36*a* or between the second positioning pin 10*b* and the fourth interfitting aperture 37*a*, preventing the first divided plate member 16*e* and the second divided plate member 22*e* from deforming plastically and warping, etc.

By reducing clearance between the first positioning pin 10*a* and the first interfitting aperture 18*a* and between the first positioning pin 10*a* and the third interfitting aperture 23*a*, and clearance between the second positioning pin 10*b* and the second interfitting aperture 36*a* and between the second positioning pin 10*b* and the fourth interfitting aperture 37*a* in the width direction of the second positioning pin 10*b* to a limit in a range that is permitted by cost without irregularities, positioning precision of the first divided plate member 16*e* and the second divided plate member 22*e* on the mounting surface 4*a* can be improved further.

Moreover, in Embodiment 5, restriction of rotation of the first divided plate member 16*e* and the second divided plate member 22*e* in a circumferential direction of the first positioning pin 10*a* is explained as being performed by the second interfitting aperture 36*a* and the fourth interfitting aperture 37*a* and by the second positioning pin 10*b* that has been inserted into the second interfitting aperture 36*a* and the fourth interfitting aperture 37*a*.

However, restriction of rotation of the first divided plate member 16*e* and the second divided plate member 22*e* in the circumferential direction of the first positioning pin 10*a* is not limited to this. As shown in FIGS. 22 and 23, a waveguide structure 1J may also be configured by forming a second notch 32*c* and a fourth notch 34*c* on the first divided plate member 16*e* and the second divided plate member 22*e* instead of the second interfitting aperture 36*a* and the fourth interfitting aperture 37*a* of the waveguide structure 1I, and inserting the second positioning pin 10*b* through the second notch 32*c* and the fourth notch 34*c*. In that case, the second notch 32*c* and the fourth notch 34*c* may be configured so as to extend in the sweep direction so as to have a width that is slightly larger than the diameter of the first positioning pin 10*a* and so as to have a floor portion that is configured so as to have a semicircular shape, for example. As shown in FIGS. 24 and 25, a waveguide structure 1J may also be configured by forming a second notch 32*d* and a fourth notch 34*d* that have a rectangular shape instead of the second interfitting aperture 36*a* and the fourth interfitting aperture 37*a* of the waveguide structure 1I, and inserting the second positioning pin 10*b* through the second notch 32*d* and the fourth notch 34*d*.

Using a waveguide structure 1J that is configured in this manner, rotation of the first divided plate member 16*e* and the second divided plate member 22*e* in the circumferential direction of the first positioning pin 10*a* can also be restricted and the first divided plate member 16*a* and the second divided plate member 22*a* can be disposed accurately at the prescribed position on the mounting surface 4*a*, and drift, etc., of the mounting surface 4*a*, the first divided plate member 16*e*, and the second divided plate member 22*e* that results from differences in coefficient of linear expansion between the members, age-related changes, etc., can also be accounted for. Consequently, similar effects to those of the waveguide structure 1I can also be achieved by the waveguide structure 1J.

Embodiment 6

Figure 26:
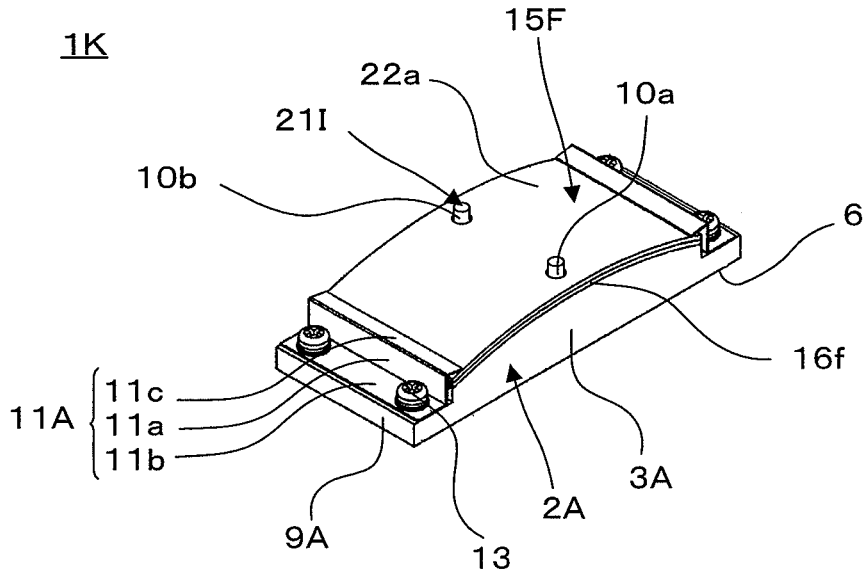
FIG. 26 is a perspective of a waveguide structure according to Embodiment 6 of the present invention.
Figure 27:
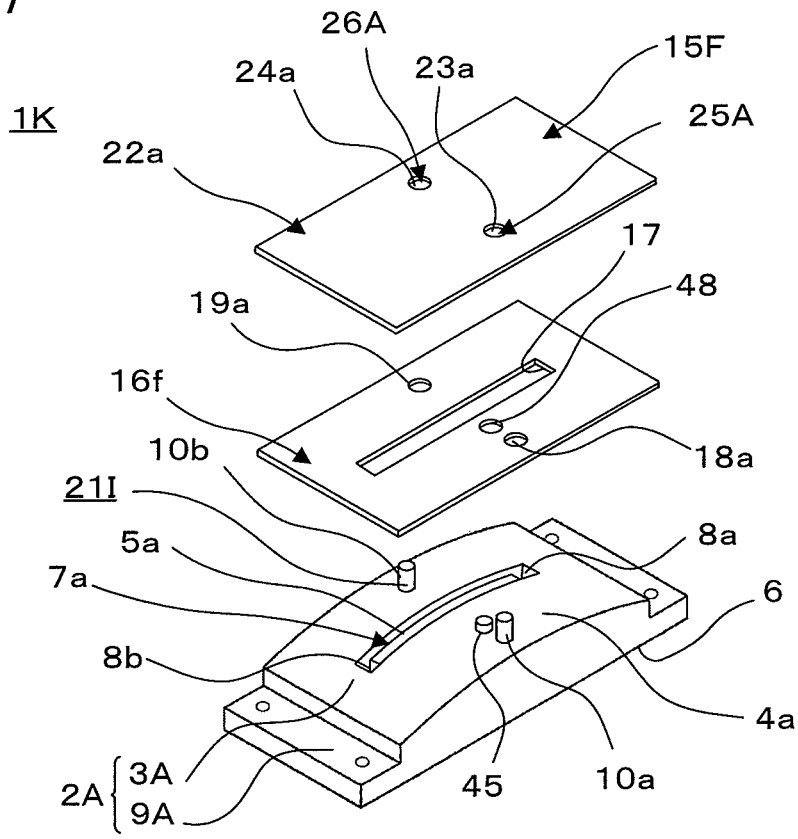
FIG. 27 is an exploded perspective of the waveguide structure according to Embodiment 6 of the present invention.

FIG. 26 is a perspective of a waveguide structure according to Embodiment 6 of the present invention, and FIG. 27 is an exploded perspective of the waveguide structure according to Embodiment 6 of the present invention.

Moreover, in FIGS. 26 and 27, portions identical to or corresponding to those in Embodiment 1 above will be given identical numbering, and explanation thereof will be omitted.

In FIGS. 26 and 27, a waveguide structure 1K is configured in a similar manner to Embodiment 1 above except that a stacking number corresponding interfitting pin 45 that functions as a stacking sequence regulating pin is disposed so as to project from a mounting surface maximum projecting portion between a waveguide groove 5*a* and a first positioning pin 10*a* at a third distance position from a first edge portions in the sweep direction, and a plate member 15F is used instead of the plate member 15A.

The plate member 15F includes: a first divided plate member 16*f* that is stacked on a mounting surface 4*a*; and a second divided plate member 22*a* that is stacked on the first divided plate member 16*f*.

A sequence regulating interfitting aperture 48 that functions as a stacking sequence regulating interfitting portion that has an aperture shape that is circular is formed on a portion of the first divided plate member 16*f* that is central in the longitudinal direction of the first divided plate member 16*f*, and that is separated by the third distance from a first long side. Moreover, the rest of the configuration of the first divided plate member 16*f* is similar to that of the first divided plate member 16*a* of the waveguide structure 1A.

An amount of protrusion of the stacking number corresponding interfitting pin 45 from the mounting surface 4*a* is set so as to be less than a thickness of the first divided plate member 16*f*.

Moreover, permissible errors in position on the mounting surface 4*a* and in diameter are set so as to be somewhat larger than the stacking number corresponding interfitting pin 45. The sequence regulating interfitting aperture 48 is formed with a rough milling precision so as to have a large diameter that allows a margin around the diameter of the stacking number corresponding interfitting pin 45 so as to enable fitting together with the stacking number corresponding interfitting pin 45 giving consideration to the permissible error in position on the mounting surface 4*a* and in diameter of the stacking number corresponding interfitting pin 45.

The first divided plate member 16*f* is stacked on the mounting surface 4*a* such that the first positioning pin 10*a* is inserted through a first interfitting aperture 18*a*, the stacking number corresponding interfitting pin 45 is inserted into the sequence regulating interfitting aperture 48, and the second positioning pin 10*b* is inserted through the second interfitting aperture 19*a*. The second divided plate member 22*a* is stacked on the first divided plate member 16*f* such that the first positioning pin 10*a* is inserted into the second interfitting aperture 23*a*, and the second positioning pin 10*b* is inserted through the fourth interfitting aperture 24*a*.

Here, a positioning mechanism 21I is constituted by the first positioning pin 10*a*, the second positioning pin 10*b*, the first interfitting portion 25A, and the second interfitting portion 26A. The positioning mechanism 21I positions the plate member 15F at a prescribed position on the mounting surface 4*a* and also restricts movement parallel to the mounting surface 4*a* by the fitting together of the first positioning pin 10*a* and the first interfitting portion 25A and the second positioning pin 10*b* and the second interfitting portion 26A.

The first positioning pin 10*a* and the second positioning pin 10*b*, and the stacking number corresponding interfitting pin 45 have respective heights that correspond to two plates and one plate, which is the respective number of stacked plates in the two-plate divided plate member that is constituted by the first divided plate member 16*f* and the second divided plate member 22*a*, and are each disposed so as to project from the mounting surface 4*a* so as to line up in the sweep direction. The sequence regulating interfitting aperture 48, a first interfitting aperture 18*a*, and a second interfitting aperture 19*a* that fit together with the stacking number corresponding interfitting pin 45, the first positioning pin 10*a*, and the second positioning pin 10*b* are formed on the first divided plate member 16*f* that is positioned in a first layer on the mounting surface 4*a*. A first interfitting aperture 18*a* and a second interfitting aperture 19*a* that fit together with the first positioning pin 10*a*, and the second positioning pin 10*b* are formed on the second divided plate member 22*a* that is positioned in a second layer on the mounting surface 4*a*.

The plate member 15F is held in a curved state so as to be placed in close contact with the mounting surface 4*a* by pressing forces from holders 11A.

A procedure for assembling the waveguide structure 1K is similar to that of Embodiment 1 except that when the first divided plate member 16*f* is stacked on the mounting surface 4*a*, the first interfitting aperture 18*a* is aligned with the first positioning pin 10*a*, the second interfitting aperture 19*a* is aligned with the second positioning pin 10*c*, the sequence regulating interfitting aperture 48 is also aligned with the stacking number corresponding interfitting pin 45, and the first divided plate member 16*f* is stacked on the mounting surface 4*a*.

According to the waveguide structure 1K according to Embodiment 6, the plate member 15F is constituted by a two-plate divided plate member 16*f* and 22*a* that is stacked on the mounting surface 4*a* of the base 2A. The stacking number corresponding interfitting pin 45 and the first positioning pin 10*a* (or the second positioning pin 10*b*) are disposed so as to project from the mounting surface 4*a* so as to line up in a sweep direction. The stacking number corresponding interfitting pin 45 and the first positioning pin 10*a* have respective heights that correspond to one plate and two plates, which is the respective number of stacked plates in the two-plate divided plate member that is constituted by the first divided plate member 16*f* and the second divided plate member 22*a*.

In the two-plate divided plate member 16*f* and 22*a*, the sequence regulating interfitting aperture 48 and the first interfitting aperture 18*a* that fit together with the stacking number corresponding interfitting pin 45 and the positioning pin 10*a* that have heights that correspond to the respective number of stacked plates, which are the first plate and the second plate divided plate member 16*f* and 22*a*, are formed on portions of the divided plate members 16*f* and 22*a*.

Thus, even if an attempt is made to stack the first divided plate member 16*f* and the second divided plate member 22*a* onto the mounting surface 4*a* in an incorrect stacking sequence, the second divided plate member 22*a* cannot be disposed directly on the mounting surface 4*a* because an interfitting aperture that corresponds to the stack number corresponding interfitting pin 45 has not been formed on the second divided plate member 22*a*.

In other words, the first positioning pin 10*a* and the second positioning pin 10*b* function as the only stacking sequence regulating pins that fit together with the second divided plate member 22*a* in the uppermost layer (in this case, the second layer), and the first interfitting portion 25A and the second interfitting portion 26A also function as stacking sequence regulating interfitting portions that correspond to the first positioning pin 10*a* and the second positioning pin 10*b* that only fit together with the second divided plate member 22*a* of the uppermost layer.

Consequently, according to the waveguide structure 1K, effects can be achieved such as preventing the first divided plate member 16*f* and the second divided plate member 22*a* from being stacked on the mounting surface 4*a* in an incorrect stacking sequence in addition to the effects of Embodiment 1.

Positioning accuracy between the stack number corresponding interfitting pin 45 and the sequence regulating interfitting aperture 48 may be rougher than positioning accuracy between the first positioning pin 10*a* and the first interfitting aperture 18*a* and between the first positioning pin 10*a* and the third interfitting aperture 23*a*, or positioning accuracy between the second positioning pin 10*b* and the second interfitting aperture 19*a* and between the second positioning pin 10*b* and the fourth interfitting aperture 24*a*. Consequently, the waveguide structure 1K makes it possible to include a function that prevents errors in the stacking sequence of the first divided plate member 16*a* and the second divided plate member 22*a* while suppressing machining costs.

Moreover, in Embodiment 6, the first positioning pin 10*a* and the second positioning pin 10*b* are explained as also functioning as a stack number corresponding interfitting pin 45 that has a height that corresponds to the number of stacked plates, i.e., the two plates in the divided plate member 16*f* and 22*a*, but a stacking sequence regulating pin that has a height that corresponds to the number of stacked plates (the two plates of the divided plate member 16*f* and 22*a*) may also be disposed separately from the first positioning pin 10*a* and the second positioning pin 10*b*.

However, by making the first positioning pin 10*a* and the second positioning pin 10*b* also function as a stacking sequence regulating pin that has a height that corresponds to the number of stacked plates (the two plates of the divided plate member 16*f* and 22*a*), reductions in the cost of the waveguide structure 1K, and additional reductions in the size of the waveguide structure 1K can be achieved from the viewpoint of reduction in the number of parts.

The plate member 15F is explained as being constituted by two plates that are constituted by the first divided plate member 16*f* and the second divided plate member 22*a*, but the plate member is not limited to being constituted by two divided plate members, and may also be constituted by n divided plate members (where n is an integer that is greater than or equal to 2). In that case, n stacking number corresponding interfitting pins 45 that function as stacking sequence regulating pins that respectively have a height that corresponds to each of the number of stacked plates in the divided plate members from one plate to n plates may be disposed on the mounting surface as integral members of the mounting surface so as to protrude from the mounting surface 4*a* of the base 2A in a single row in the sweep direction with the first positioning pin 10*a* and the second positioning pin 10*b*. Here, positioning pins 10*a* and 10*b* may also serve as stacking number corresponding interfitting pins that function as stacking sequence regulating pins that have a height that corresponds to n plates in the number of plates stacked in the divided plate member. Interfitting apertures that function as stacking sequence regulating interfitting portions that fit together with the stacking number corresponding interfitting pins 45 that have heights that correspond to the respective number of plates stacked in n divided plate members from one plate to m plates (where m is an integer that is greater than or equal to 1 and less than or equal to n) should respectively be formed on the divided plate members that are stacked on the mounting surface 4*a* up to an m-th layer.

Embodiment 7

Figure 28:
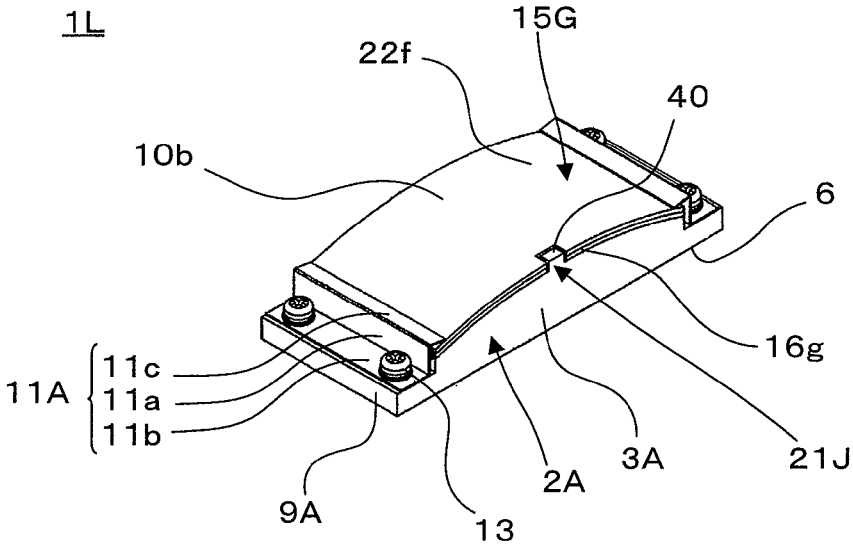
FIG. 28 is a perspective of a waveguide structure according to Embodiment 7 of the present invention.
Figure 29:
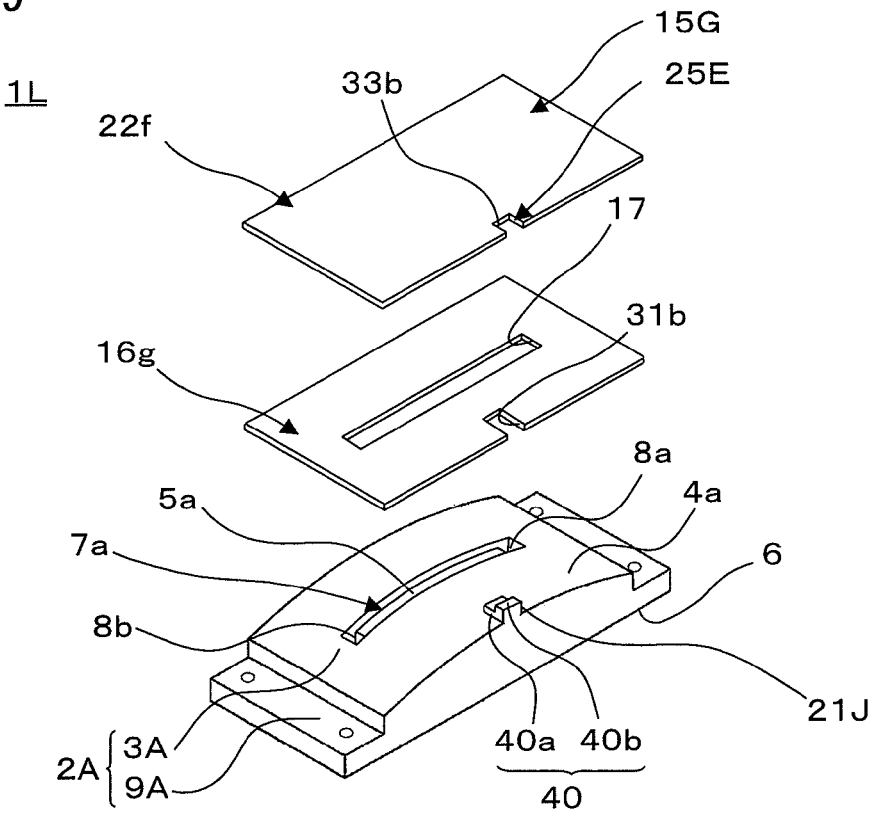
FIG. 29 is an exploded perspective of the waveguide structure according to Embodiment 7 of the present invention.

FIG. 28 is a perspective of a waveguide structure according to Embodiment 7 of the present invention, and FIG. 29 is an exploded perspective of the waveguide structure according to Embodiment 7 of the present invention.

Moreover, in FIGS. 28 and 29, portions identical to or corresponding to those in Embodiment 1 above will be given identical numbering, and explanation thereof will be omitted.

In FIGS. 28 and 29, a waveguide structure 1L is configured in a similar manner to Embodiment 1 above except that a stepped protruding portion 40 that functions as a positioning member and a stacking sequence regulating member is disposed so as to project from the mounting surface 4*a*, a plate member 15G is used instead of the plate member 15A, and the first positioning pin 10*a* and the second positioning pin 10*b* are omitted.

The stepped protruding portion 40 is disposed so as to project from a mounting surface maximum projecting portion of the mounting surface 4*a* near a first edge portion in the sweep direction. Here, an external shape of a cross section that is perpendicular to the direction of projection of the stepped protruding portion 40 is quadrilateral. The stepped protruding portion 40 is formed so as to have a stepped shape in which a height from the mounting surface 4*a* becomes lower at predetermined positions from a first end toward a second end in the sweep direction. Here, a surface of a first step that is parallel to the mounting surface 4*a* will be called "a first step surface", and a surface of a second step that is parallel to the mounting surface 4*a* will be called "a second step surface".

A portion of the stepped protruding portion 40 that is constituted from the mounting surface 4*a* to the first step surface in the direction of protrusion of the stepped protruding portion 40 from the mounting surface 4*a* will be designated "a first step portion 40*a*", and a portion of the stepped protruding portion 40 that is constituted from the first step surface to the second step surface will be designated "a second step portion 40*b*".

Moreover, a thickness direction of the first step portion 40*a* and the second step portion 40*b* is the direction of projection of the stepped protruding portion 40. Length of the stepped protruding portion 40 in the curve direction is constant irrespective of position in the sweep direction.

The plate member 15G is constituted by: a first divided plate member 16*g* that is stacked on a mounting surface 4*a*; and a second divided plate member 22*f* that is stacked on the first divided plate member 16*g*.

The first divided plate member 16*g* is configured in a similar manner to the first divided plate member 16*a* of the waveguide structure 1A except that a first notch 31*b* is formed instead of the first interfitting aperture 18*a*, and formation of the second interfitting aperture 19*a* is omitted.

Here, a shape of the first notch 31*b* corresponds to an external shape of the first step portion 40*a* when viewed from the direction of projection of the stepped protruding portion 40.

The second divided plate member 22*f* is configured in a similar manner to the second divided plate member 22*a* of the waveguide structure 1A except that a third notch 33*b* is formed instead of the third interfitting aperture 23*a*, and formation of the fourth interfitting aperture 24*a* is omitted. Here, a shape of the third notch 33*b* corresponds to an external shape of the second step portion 40*b* when viewed from the direction of projection of the stepped protruding portion 40 from the mounting surface 4*a*.

The first divided plate member 16*g* is stacked on the mounting surface 4*a* such that the first step portion 40*a* of the stepped protruding portion 40 is fitted together with the first notch 31*b* practically without leaving gaps. Here, a thickness of the first divided plate member 16*g* matches a thickness of the first step portion 40*a*. In addition, the second divided plate member 22*f* is stacked on the first divided plate member 16*g* such that the second step portion 40*b* of the stepped protruding portion 40 is fitted together with the third notch 33*b* practically without leaving gaps.

The positioning mechanism 21J is constituted by the stepped protruding portion 40 and a first interfitting portion 25E that is constituted by the first notch 31*b* and the third notch 33*b*. Because the first notch 31*b* and the third notch 33*b* have internal shapes that match the external shape of the stepped protruding portion 40, the positioning mechanism 21J positions the plate member 15G at a prescribed position on the mounting surface 4*a* and also restricts rotational movement of the plate member 15G around the stepped protruding portion 40 parallel to the mounting surface 4*a* by the fitting together of the stepped protruding portion 40 and the first interfitting portion 25E.

The plate member 15G is held in a curved state so as to be placed in close contact with the mounting surface 4*a* by pressing forces from holders 11A.

A procedure for assembling the waveguide structure 1L is similar to that of Embodiment 1 except that the first divided plate member 16*g* is disposed on the mounting surface 4*a* such that the first notch 31*b* is fitted together with the first step portion 40*a*, and the second divided plate member 22*f* id disposed on the first divided plate member 16*g* such that the third notch 33*b* is fitted together with the second step portion 40*b*.

In Embodiment 7, the stepped protruding portion 40 is constituted by a first step portion 40*a* and a second step portion 40*b* that are formed at predetermined height positions in the direction of projection from the mounting surface 4*a* so as to have a stepped shape such that a width in the sweep direction becomes narrower. A first notch 31*b* that corresponds to an external shape of the first step portion 40*a* when viewed from the direction of projection of the stepped protruding portion 40 from the mounting surface 4*a* is formed on the first divided plate member 16*g*, and a third notch 33*b* that corresponds to an external shape of the second step portion 40*b* when viewed from the direction of projection of the stepped protruding portion 40 from the mounting surface 4*a* is formed on the second divided plate member 22*f*.

Thus, even if an attempt is made to stack the first divided plate member 16*g* and the second divided plate member 22*f* onto the mounting surface 4*a* in an incorrect stacking sequence, the second divided plate member 22*f* cannot be fitted together with the first step portion 40*a* because area of the third notch 33*b* of the second divided plate member 22*f* is less than area of the first step portion 40*a* when viewed from the direction of projection of the stepped protruding portion 40 from the mounting surface 4*a*.

In other words, the stepped protruding portion 40 also functions as the first positioning pin 10*a* and the second positioning pin 10*b* according to the waveguide structure 1A, and fulfills a role of positioning the first divided plate member 16*g* and the second divided plate member 22*f* at a prescribed position on the mounting surface 4*a* and a role of preventing errors in stacking sequence. Consequently, according to the waveguide structure 1L, effects can be achieved such as preventing the first divided plate member 16*g* and the second divided plate member 22*f* from being stacked on the mounting surface 4*a* in an incorrect stacking sequence in addition to the effects of Embodiment 1.

Moreover, in Embodiment 7, the plate member 15G is explained as being constituted by a two divided plate members that are constituted by the first divided plate member 16*g* and the second divided plate member 22*f*, and the stepped protruding portion 40 as being configured so as to have two steps. However, the number of steps in the stepped protruding portion 40 should be appropriately determined so as to correspond to the number of stacked plates in the divided plate members that constitute the plate member.

In other words, if a plate member is constituted by n divided plate members (where n is an integer that is greater than or equal to 2) that are stacked on the mounting surface 4*a* of the base 2A, the stepped protruding portion 40 may also be configured by integrating first through n-th step portions that have areas of cross sections that are perpendicular to a thickness direction that are reduced sequentially. The stepped protruding portion should be disposed on the mounting surface as an integral member of the mounting surface so as to protrude from the mounting surface 4*a* such that a first step portion is positioned near the mounting surface 4*a* and a thickness direction is aligned in a direction of projection. Here, heights of the m-th step portion of the stepped protruding portion (where m is an integer that is greater than or equal to 1 and less than or equal to n) from the mounting surface 4*a* are configured so as to reach a height that corresponds to each of the number of stacked divided plate members from one plate to m plates. Notches or interfitting apertures that function as stacking sequence regulating interfitting portions that have sizes that correspond to sizes of the cross-sectional areas that are perpendicular to the thickness direction of the m-th step portion should be formed on divided plate members that are stacked on the mounting surface 4*a* up to an m-th layer. Divided plate members that fit together with each of the step portions of the stepped protruding portion are thereby also determined uniquely, preventing the plurality of divided plate members from being stacked in an incorrect stacking sequence.

Moreover, the stepped protruding portion 40 may also be configured without omitting the positioning pin 10*a* and the positioning pin 10*b* by coaxially integrating first through (n−1)-th step portions that have areas of cross sections that are perpendicular to a thickness direction that are reduced sequentially. In that case, the stepped protruding portion should also be disposed on the mounting surface as an integral member of the mounting surface so as to protrude from the mounting surface 4*a* such that a first step portion is positioned near the mounting surface 4*a* and a thickness direction is aligned in a direction of projection. Interfitting apertures that function as stacking sequence regulating interfitting portions that have sizes that correspond to sizes of the cross-sectional areas that are perpendicular to the thickness direction of the m-th step portion should be formed on divided plate members that are stacked on the mounting surface 4*a* up to an m-th layer, where m is an integer that is greater than or equal to 1 and less than or equal to (n−1). Divided plate members that fit together with each of the step portions of the stepped protruding portion are also determined uniquely when configured in this manner, preventing the plurality of divided plate members from being stacked in an incorrect stacking sequence.

However, when the stepped protruding portion 40 also functions as the first positioning pin 10*a* and the second positioning pin 10*b* according to the waveguide structure 1A, the waveguide structure can be simplified and reduced in size compared to when members for positioning the plate member 15G at the prescribed position on the mounting surface 4*a* and for preventing stacking sequence errors are configured separately, thereby enabling reductions in the cost of the waveguide structure to be achieved.

Embodiment 8

Figure 30:
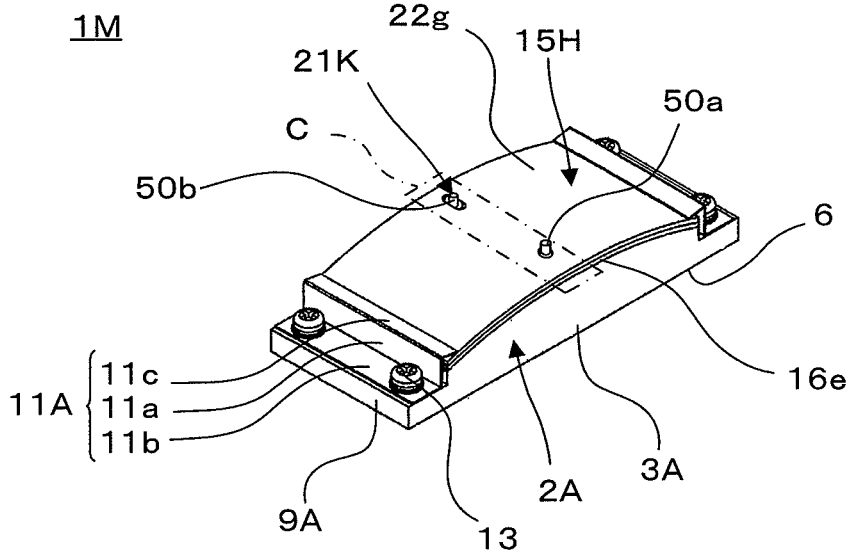
FIG. 30 is a perspective of a waveguide structure according to Embodiment 8 of the present invention.
Figure 31:
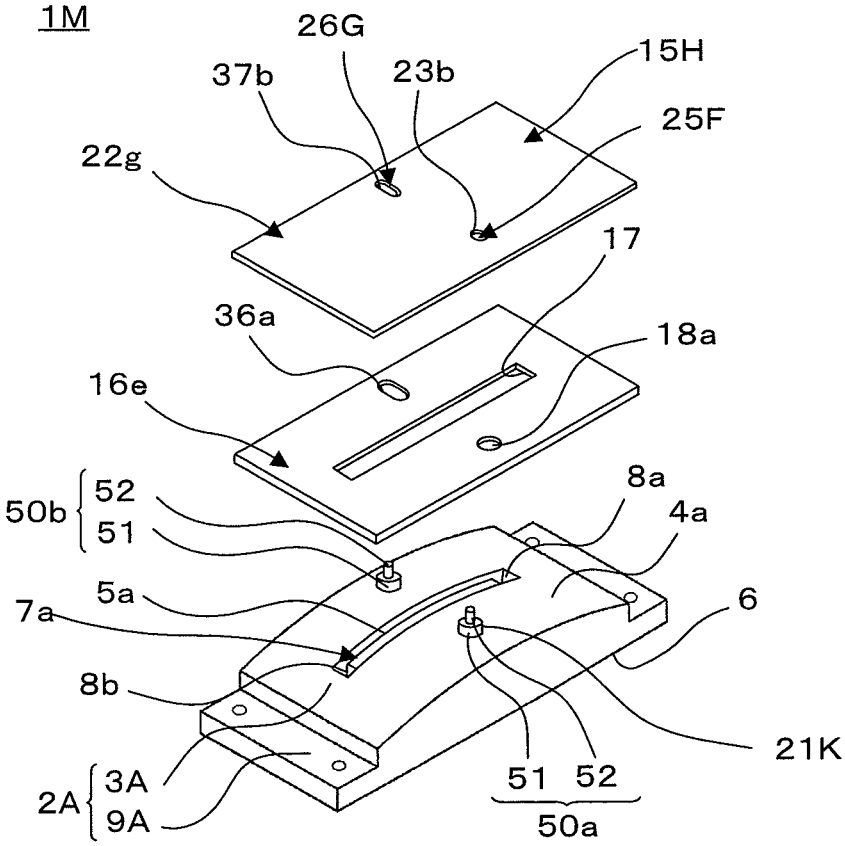
FIG. 31 is an exploded perspective of the waveguide structure according to Embodiment 8 of the present invention.
Figure 32:
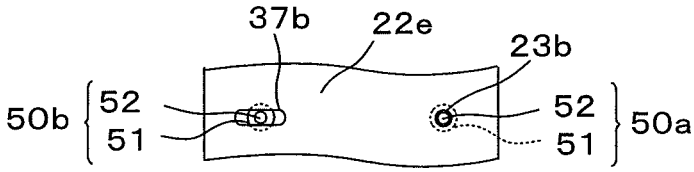
FIG. 32 is an enlarged front elevation of Portion C in FIG. 30.
Figure 33:
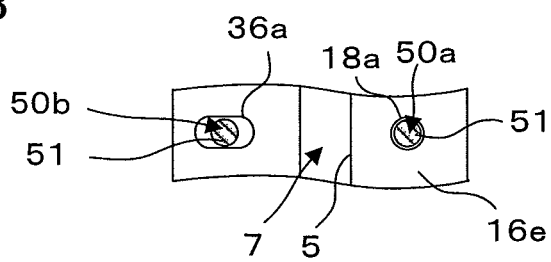
FIG. 33 is a front elevation that does not consider a second plate member from FIG. 32.

FIG. 30 is a perspective of a waveguide structure according to Embodiment 8 of the present invention, FIG. 31 is an exploded perspective of the waveguide structure according to Embodiment 8 of the present invention, FIG. 32 is an enlarged front elevation of Portion C in FIG. 30, and FIG. 33 is a front elevation that does not consider a second plate member from FIG. 32.

Moreover, in FIGS. 30 through 33, portions identical to or corresponding to those in Embodiment 1 above will be given identical numbering, and explanation thereof will be omitted.

In FIGS. 30 through 33, a waveguide structure 1M is configured in a similar manner to Embodiment 1 above except that a first multiple diameter pin 50*a* and a second multiple diameter pin 50*b* that function as a positioning member and a stacking sequence regulating member are disposed on the mounting surface as integral members of the mounting surface so as to project from the mounting surface 4*a* instead of the first positioning pin 10*a* and the second positioning pin 10*b*, a plate member 15H is used instead of the plate member 15A, and the first positioning pin 10*a* and the second positioning pin 10*b* are omitted.

Specifically, the first multiple diameter pin 50*a* and the second multiple diameter pin 50*b* are each disposed so as to be separated from each other so as to project from a mounting surface maximum projecting portion so as to be separated by a first distance from two edge portions that are parallel to the curve direction.

The first multiple diameter pin 50*a* and the second multiple diameter pin 50*b* are each constituted by a first step portion 51 and a second step portion 52 that have a circular cross sectional shape that are integrated coaxially. Here, a thickness direction of each of the step portions is an axial direction. A diameter of the second step portion 52 is smaller than a diameter of the first step portion 51. The first multiple diameter pin 50*a* and the second multiple diameter pin 50*b* are disposed so as to protrude from the mounting surface 4*a* such that the first step portion 51 is positioned near the mounting surface 4*a* and the thickness direction is aligned in a direction of projection from the mounting surface 4*a*.

The plate member 15H includes: a first divided plate member 16*e* that is stacked on a mounting surface 4*a*; and a second divided plate member 22*g* that is stacked on the first divided plate member 16*e*.

A diameter of the first interfitting aperture 18*a* and a minor axial length of the second interfitting aperture 36*a* of the first divided plate member 16*e* are slightly longer than diameters of the first step portions 51 of the first multiple diameter pin 50*a* and the second multiple diameter pin 50*b*.

The second divided plate member 22*g* is similar in configuration to the second divided plate member 22*e* of the waveguide structure 1I except that a third interfitting aperture 23*b* is formed instead of the third interfitting aperture 23*a*, and a slot-shaped fourth interfitting aperture 37*b* is formed instead of the fourth interfitting aperture 37*a*.

Moreover, a major axis of the fourth interfitting aperture 37*b* is oriented in a width direction of the first divided plate member 16*e* and the second divided plate member 22*g*.

A diameter of the third interfitting aperture 23*b* is slightly larger than a diameter of the second step portion 52 of the first multiple diameter pin 50*a*, and a minor axial length of the fourth interfitting aperture 37*b* is slightly longer than a diameter of the second step portions 52 of the second multiple diameter pin 50*b*.

A major axial length of the fourth interfitting aperture 37*b* is determined in a similar manner to the second interfitting aperture 36*a* of the waveguide structure 1I with consideration for an amount of permissible drift in the distance between the first interfitting aperture 18*a* and the second interfitting aperture 36*a* from a design perspective, an amount of permissible drift in the distance between the third interfitting aperture 23*b* and the fourth interfitting aperture 37*b* from a design perspective, an amount of relative drift in the first divided plate member 16*e* and the second divided plate member 22*g* relative to each of the multiple diameter pins 50*a* and 50*b* allowing for age-related changes, and an amount of relative drift in the first divided plate member 16*e* and the second divided plate member 22*g* relative to each of the multiple diameter pins 50*a* and 50*b* allowing for differences in coefficient of linear expansion if the first divided plate member 16*e* and the second divided plate member 22*g* are constituted by different metals.

The first divided plate member 16*e* is stacked on the mounting surface 4*a* such that a first surface thereof faces the mounting surface 4*a* in a state in which the first step portion 51 of the first multiple diameter pin 50*a* and the first step portion 51 of the second multiple diameter pin 50*b* are inserted through the first interfitting aperture 18*a* and the second interfitting aperture 36*a*. In addition, the second divided plate member 22*g* is stacked on the first divided plate member 16*e* such that a first surface thereof faces the first divided plate member 16*e* in a state in which the second step portion 52 of the first multiple diameter pin 50*a* and the second step portion 52 of the second multiple diameter pin 50*b* are inserted through the third interfitting aperture 23*b* and the fourth interfitting aperture 37*b*.

A positioning mechanism 21K is constituted by the first multiple diameter pin 50*a*, the second multiple diameter pin 50*b*, the first interfitting portion 25F, which is constituted by the first interfitting aperture 18*a* and the third interfitting aperture 23*b* that functions respectively as a stacking sequence regulating interfitting portion, and the second interfitting portion 26G, which is constituted by the second interfitting aperture 36*a* and the fourth interfitting aperture 37*b* that functions respectively as a stacking sequence regulating interfitting portion. Here, because gaps between the first interfitting aperture 18*a* and the first multiple diameter pin 50*a* and between the second interfitting aperture 23*b* and the first multiple diameter pin 50*a* are practically nonexistent, movement of the first divided plate member 16*e* and the second divided plate member 22*g* is restricted other than in the circumferential direction and the axial direction of the first multiple diameter pin 50*a*. In addition, because gaps between wall portions on two minor axial sides of the second interfitting aperture 36*a* and the fourth interfitting aperture 37*b* and the first step portion 51 and the second step portion 52 of the second multiple diameter pin 50*b* are practically nonexistent, movement of the first divided plate member 16*e* and the second divided plate member 22*g* is also restricted in the circumferential direction of the first multiple diameter pin 50*a*.

In other words, the positioning mechanism 21K positions the plate member 15H at a prescribed position on the mounting surface 4*a* and also restricts movement of the plate member 15H parallel to the mounting surface 4*a* by the fitting together of the first multiple diameter pin 50*a* and the first interfitting portion 25F, and by the fitting together of the second multiple diameter pin 50*b* and the second interfitting portion 26G.

The plate member 15H is held in a curved state so as to be placed in close contact with the mounting surface 4*a* by pressing forces from holders 11A.

Immediately after assembly of the waveguide structure 1M, predetermined gaps or greater are formed between the second interfitting aperture 36*a* and the second multiple diameter pin 50*b* and between the fourth interfitting aperture 37*b* and the second multiple diameter pin 50*b* on the major axis of the second interfitting aperture 36*a* and the fourth interfitting aperture 37*b*. Large stresses can thereby be prevented from arising between the second multiple diameter pin 50*b* and the first divided plate member 16*e* and between the second multiple diameter pin 50*b* and the second divided plate member 22*g* even if relative drift arises between the second multiple diameter pin 50*b* and the first divided plate member 16*e* and between the second multiple diameter pin 50*b* and the second divided plate member 22*g* as a result of permissible errors during machining, differences in coefficient of linear expansion between the members, and age-related changes.

Moreover, because the second interfitting aperture 36*a* and the fourth interfitting aperture 37*b* need only restrict rotation of the first divided plate member 16*e* and the second divided plate member 22*g* around an axis of the first multiple diameter pin 50*a*, major axial length precision is not particularly required provided that management of minor axial length precision is performed.

A procedure for assembling the waveguide structure 1M is similar to that of Embodiment 1 except that the first divided plate member 16*c* and the second divided plate member 22*g* are stacked on the mounting surface 4*a* such that the first interfitting aperture 18*a* and the third interfitting aperture 23*b* are aligned with the first multiple diameter pin 50*a*, and the second interfitting aperture 36*a* and the fourth interfitting aperture 37*b* are aligned with the second multiple diameter pin 50*b*.

According to Embodiment 8, the first divided plate member 16*e* and the second divided plate member 22*g* can be disposed accurately at a prescribed position on the mounting surface 4*a* in a similar manner to Embodiment 1 simply by inserting the first multiple diameter pin 50*a* and the second multiple diameter pin 50*b* through the first interfitting aperture 18*a* and the second interfitting aperture 36*a*, and through the third interfitting aperture 23*b* and the fourth interfitting aperture 37*b*, when disposing the first divided plate member 16*e* and the second divided plate member 22*g* on the mounting surface 4*a*.

The first multiple diameter pin 50*a* and the second multiple diameter pin 50*b* are disposed so as to project from the mounting surface 4*a* such that diameters reduce in a stepped shape at a position of the thickness of the first divided plate member 16*e* in the direction of projection from the mounting surface 4*a*. In addition, a first interfitting aperture 18*a* that has a diameter that corresponds to the diameter of the first step portion 51 of the first multiple diameter pin 50*a* and a slot-shaped second interfitting aperture 36*a* that has a minor axial length that corresponds to the diameter of the first step portion 51 of the second multiple diameter pin 50*b* are formed on the first divided plate member 16*e*. A third interfitting aperture 23*b* that has a diameter that corresponds to the diameter of the second step portion 52 of the first multiple diameter pin 50*a* and a slot-shaped fourth interfitting aperture 37*b* that has a minor axial length that corresponds to the diameter of the second step portion 52 of the second multiple diameter pin 50*b* are formed on the second divided plate member 22*g*.

Thus, even if an attempt is made to stack the first divided plate member 16*e* and the second divided plate member 22*g* onto the mounting surface 4*a* in an incorrect stacking sequence, the first multiple diameter pin 50*a* and the second multiple diameter pin 50*b* cannot be inserted through the third intermitting aperture 23*b* and the fourth interfitting aperture 37*b* of the second divided plate member 22*g*. Consequently, according to the waveguide structure 1M, effects can be achieved such as preventing the first divided plate member 16*e* and the second divided plate member 22*g* from being stacked on the mounting surface 4*a* in an incorrect stacking sequence in addition to the effects of Embodiment 1.

Thus, the first multiple diameter pin 50*a* and the second multiple diameter pin 50*b* also function as the first positioning pin 10*a* and the second positioning pin 10*b* according to the waveguide structure 1A, and fulfill a role of positioning the plate member 15H that is constituted by the first divided plate member 16*e* and the second divided plate member 22*g* at a prescribed position on the mounting surface 4*a* and a role of preventing errors in stacking sequence. In other words, the waveguide structure can be simplified and reduced in size compared to when members for positioning the plate member 15H at the prescribed position on the mounting surface 4*a* and for preventing stacking sequence errors are configured separately, thereby enabling reductions in the cost of the waveguide structure to be achieved.

Moreover, in Embodiment 8, the plate member 15H is explained as being constituted by two plates, i.e., the first divided plate member 16*e* and the second divided plate member 22*g*, and the first multiple diameter pin 50*a* and the second multiple diameter pin 50*b* as being each configured so as to have two steps, i.e., the first step portion 51 and the second step portion 52. However, the number of steps in the first multiple diameter pin 50*a* and the second multiple diameter pin 50*b* should be appropriately determined so as to correspond to the number of stacked plates in the divided plate members that constitute the plate member.

In other words, if a plate member is constituted by n divided plate members (where n is an integer that is greater than or equal to 2) that are stacked on the mounting surface 4*a* of the base 2A, multiple diameter pins may also be configured by coaxially integrating first through n-th step portions that have areas of cross sections (or diameters) that are perpendicular to a thickness direction (an axial direction) that are reduced sequentially. Here, heights of the m-th step portion of the multiple diameter pins (where m is an integer that is greater than or equal to 1 and less than or equal to n) from the mounting surface 4*a* should be configured to a height that corresponds to each of the number of stacked divided plate members from one plate to m plates. Interfitting apertures that function as stacking sequence regulating interfitting portions that have sizes that correspond to sizes of the cross-sectional areas that are perpendicular to the axial direction of the m-th step portion should be formed on divided plate members that are stacked on the mounting surface 4*a* up to an m-th layer.

If a multiple diameter pin is disposed separately from the first positioning pin 10*a* and the second positioning pin 10*b*, the multiple diameter pin may also be configured by coaxially integrating first through (n−1)-th step portions.

The second multiple diameter pin 50*b* is explained as being inserted through the second interfitting aperture 36*a* and the fourth interfitting aperture 37*b*, but a second positioning pin 10*b* that has a single diameter that spans an axial direction may also be disposed on the mounting surface as an integral member of the mounting surface so as to protrude from the mounting surface 4*a* instead of the second multiple diameter pin 50*b*. In that case, a minor axial length of a first slot on a first divided plate member and a minor axial length of a second slot on a second divided plate member should be formed so as to correspond to the diameter of the second positioning pin 10*b*. The above effects can also be achieved by a waveguide structure that is configured in this manner.

The above effects can also be achieved by a waveguide structure that is configured by forming notches on the first plate member and the second plate member instead of the respective first interfitting aperture 18*a*, third interfitting aperture 23*b*, second interfitting aperture 36*a*, and fourth interfitting aperture 37*b*.

Embodiment 9

Figure 34:
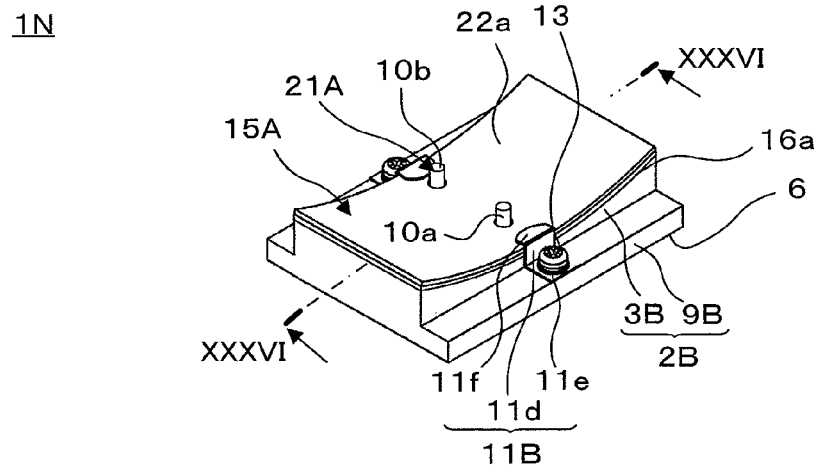
FIG. 34 is a perspective of a waveguide structure according to Embodiment 9 of the present invention.
Figure 35:
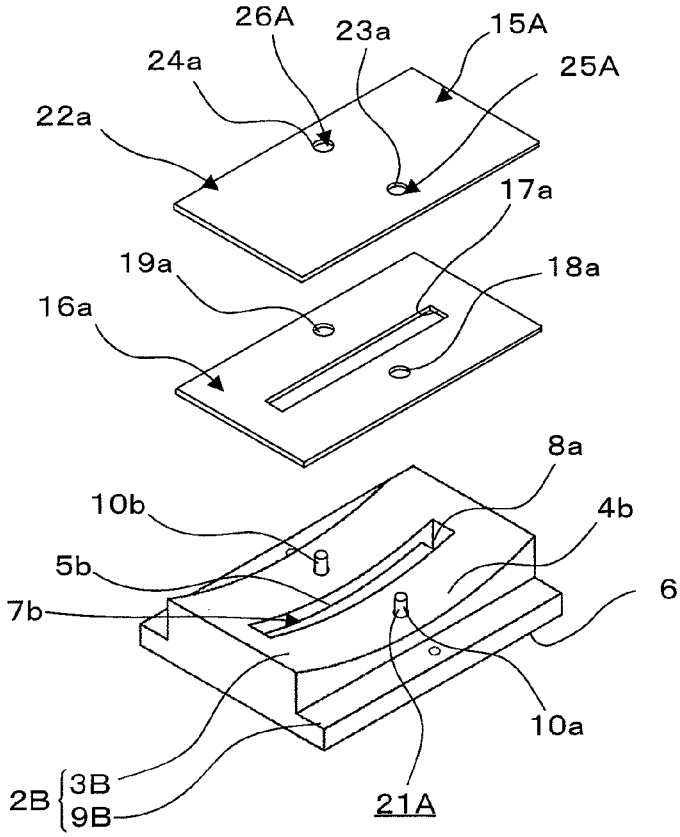
FIG. 35 is an exploded perspective of the waveguide structure according to Embodiment 9 of the present invention.
Figure 36:
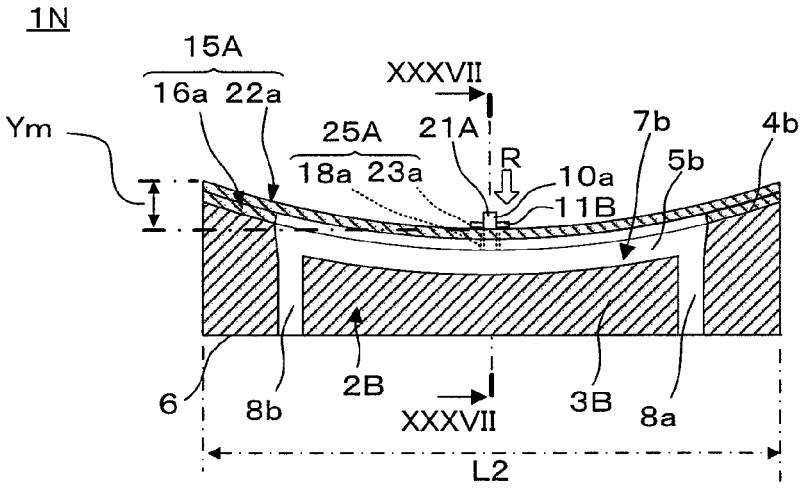
FIG. 36 is a cross section taken along Line XXXVI-XXXVI in FIG. 34 viewed from the direction of the arrows.
Figure 37:
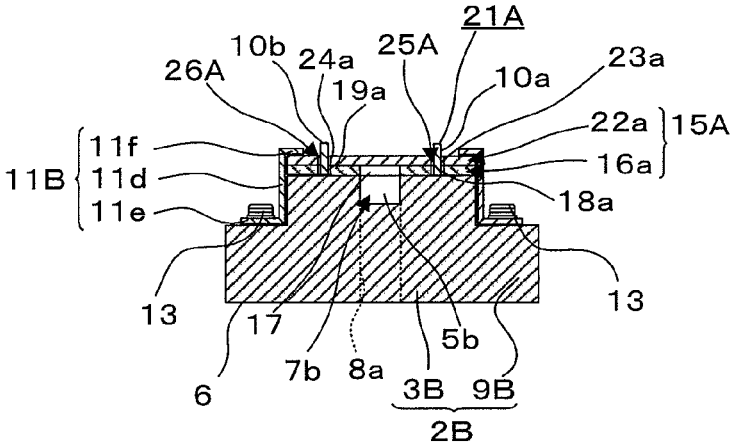
FIG. 37 is a cross section taken along Line XXXVII-XXXVII in FIG. 36 viewed from the direction of the arrows.
Figure 38:
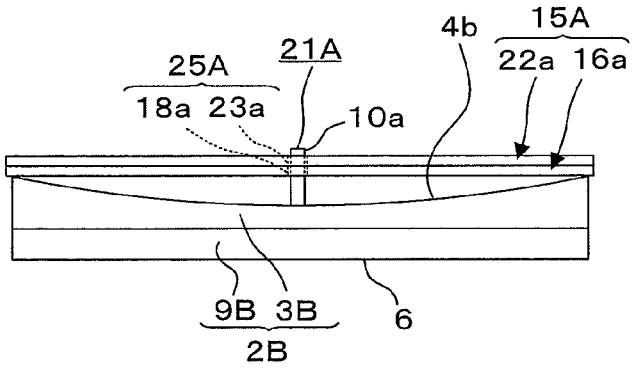
FIG. 38 is a diagram for explaining a procedure for assembling the waveguide structure of the invention according to Embodiment 9 of the present invention.

FIG. 34 is a perspective of a waveguide structure according to Embodiment 9 of the present invention, FIG. 35 is an exploded perspective of the waveguide structure according to Embodiment 9 of the present invention, FIG. 36 is a cross section taken along Line XXXVI-XXXVI in FIG. 34 viewed from the direction of the arrows, FIG. 37 is a cross section taken along Line XXXVII-XXXVII in FIG. 36 viewed from the direction of the arrows, and FIG. 38 is a diagram for explaining a procedure for assembling the waveguide structure of the invention according to Embodiment 9 of the present invention.

Moreover, depiction of holders is omitted in FIG. 35.

In FIGS. 34 through 38, portions identical to or corresponding to those in Embodiment 1 above will be given identical numbering, and explanation thereof will be omitted.

In FIGS. 34 through 37, a waveguide structure 1N is configured in a similar manner to Embodiment 1 above except that a base 2B is used instead of the base 2A, and a pair of holders 11B that function as a holding means are used instead of the pair of holders 11A.

The base 2B is prepared using a metal, and is constituted by: a metal main body portion 3B that has a curved mounting surface 4*b*; and flanges 9B that project out from two ends of the main body portion 3B in the width direction. The main body portion 3B has a rectangular shape when viewed from a side that is opposite the mounting surface 4*b*, and hereinafter a longitudinal direction of the main body portion 3B when the main body portion 3B is viewed from the side that is opposite the mounting surface 4*b* will simply be called the longitudinal direction of the main body portion 3B.

The mounting surface 4*b* is configured so as to have a concave curved surface that is obtained by sweeping a cantilever deflection curve in a sweep direction. Moreover, the sweep direction is a direction that is perpendicular to a plane that includes the deflection curve.

The cantilever deflection curve is set as follows:

a central portion in the longitudinal direction of the plate member 15A is supported and the plate member 15A is deflected by applying a load to two longitudinal edges. The cantilever deflection curve is set so as to be a curve that is parallel to major surfaces of the plate member 15A in a cross section that is perpendicular to the width direction of the plate member 15A in this state. Moreover, if it is necessary to make the pressure distribution between the plate member 15A and the base 2A uniform when the plate member 15A is deflected parallel to the mounting surface 4*a* by pressing the central portion of the plate member 15A, it is desirable for the cantilever deflection curve to be a shape that applies a uniformly distributed load over an entire region in the longitudinal direction of the plate member 15A.

The mounting surface 4*b* is formed so as to have a curve in the cross section of the main body portion 3B that is perpendicular to the sweep direction in which a distance from a line segment that connects two ends of the mounting surface 4*b* increases toward center in the curve direction, as shown in FIG. 36. In other words, the distance from a plane that includes the two edge portions of the mounting surface 4*b* in the curve direction increases toward a longitudinal center in the curve direction of the mounting surface 4*b*.

A waveguide groove 5*b* that has an opening on the mounting surface 4*b* is formed on the main body portion 3B. Here, the waveguide groove 5*b* extends for a predetermined length in the longitudinal direction of the main body portion 3B at a predetermined depth and a predetermined width in the sweep direction of the mounting surface 4*b*.

Waveguide input and output passages 8*a* and 8*b* are each formed on the main body portion 3B so as to pass through between an input and output port forming surface 6 that is configured on an opposite side from the mounting surface 4*b* and each of two ends of the waveguide groove 5*b*.

Hereinafter, the portion of the mounting surface 4*b* at which the distance from the plane that includes the two edge portions of the mounting surface 4*b* in the curve direction is greatest will be called "a mounting surface maximum recess portion".

The pair of holders 11B are each configured by bending two ends of flat plates, and are constituted by: an intermediate portion 11*d*; and a mounted portion 11*e* and a pressing portion 11*f* that extend outward from the intermediate portion 11*d* in opposite directions.

A first positioning pin 10*a* and a second positioning pin 10*b* are disposed on the mounting surface as integral members of the mounting surface so as to protrude at the mounting surface maximum recess portion on two sides of the waveguide groove 5*b* in the sweep direction. The first positioning pin 10*a* and the second positioning pin 10*b* are formed at portions that are separated by a first distance from each of two edge portions in the sweep direction of the mounting surface 4*b*.

A first divided plate member 16*a* is stacked on the mounting surface 4*b* such that a first surface thereof faces the mounting surface 4*b* in a state in which the first positioning pin 10*a* and the second positioning pin 10*b* are inserted through a first interfitting aperture 18*a* and a second interfitting aperture 19*a*. Here, a waveguide constituting aperture 17 faces the waveguide groove 5*b*.

In addition, the second divided plate member 22*a* is stacked on the first divided plate member 16*a* such that a first surface thereof faces a second surface of the first divided plate member 16*a* in a state in which the first positioning pin 10*a* and the second positioning pin 10*b* are inserted through the third interfitting aperture 23*a* and the fourth interfitting aperture 24*a*. In other words, a positioning mechanism 21A is disposed so as to be positioned at the mounting surface maximum recess portion. The positioning mechanism 21A positions the plate member 15A at a prescribed position on the mounting surface 4*b* and also restricts movement of the plate member 15A parallel to the mounting surface 4*b* by the fitting together of the first positioning pin 10*a* and the first interfitting portion 25A, and by the fitting together of the second positioning pin 10*b* and the second interfitting portion 26A.

The mounted portion 11*e* of a first holder 11B is securely fastened onto a longitudinally central portion of a first flange 9B by a screw 13. Here, the intermediate portion 11*d* of the holder 11A extends so as to be opposite side surfaces of the first divided plate member 16*a* and the second divided plate member 22*a*, and such that the pressing portion 11*f* presses a vicinity of a central portion a first edge portion of the second divided plate member 22*a* in the sweep direction.

The mounted portion 11*e* of a second holder 11B is also securely fastened onto a longitudinally central portion of a second flange 9B by a screw 13. Here, the intermediate portion 11*d* of the holder 11A extends so as to be opposite side surfaces of the first divided plate member 16*a* and the second divided plate member 22*a*, and such that the pressing portion 11*f* presses a vicinity of a central portion a second edge portion of the second divided plate member 22*a* in the sweep direction.

The first divided plate member 16*a* and the second divided plate member 22*a* are held stably on the mounting surface 4*b* in a curved state parallel to the mounting surface 4*b* by pressing forces from the holders 11B.

The waveguide groove 5*b*, the waveguide constituting aperture 17, and the second divided plate member 22*a* function together to constitute a waveguide 7*b* that extends in the longitudinal direction of the main body portion 3B.

Here, the pressing portions 11*f* of the holders 11B are configured so as to have a curved shape equal to the curved shape of the portion of the second divided plate member 22*a* that contacts the pressing portion 11*f* so as not to impede curvature of the plate member 15A. Moreover, the pressing portions 11*f* may also press the second divided plate member 22*a* in point contact with the second divided plate member 22*a*.

Moreover, the shape of the deflection curve of the mounting surface 4*b*, in other words, the shape of the curve due to the path that is drawn in the curve direction of the mounting surface 4*b*, is configured so as to satisfy Expression (3) below, and the holders 11B are configured so as to press the central portions of each of the edge portions of the second divided plate member 22*a* in the sweep direction with a pressing force R that can be expressed by Expression (4) below.

Moreover, Expression (3) is a deflection curve formula from material mechanics for a cantilever that is subjected to a uniformly distributed load along its entire length, and Expression (4) is an expression that is easily found from a maximum deflection formula and a geometrical-moment of inertia formula for a plate.

$$Y=16YmX(X4-L23X/2+3L24/16)/(3L24) \quad (3)$$

$$R=2kEbh3Ym/(3L23) \quad (4)$$

Here, a Y-axis direction is a normal direction of a plane that includes the edge portions of the mounting surface 4*b* at the two ends in the curve direction, and an X-axis direction is a direction in which the edge portions of the mounting surface 4*b* at the two ends in the curve direction face each other.

Point 0 of the Y-axis and X-axis is the mounting surface maximum recess portion of the base 2B.

Ym, L2, E, b, h, and k are defined as follows:

Ym is maximum deflection of the second divided plate member 22*a*, which is defined by a maximum distance between the second divided plate member 22 and a plane that includes edge portions at two ends of a front surface (a second surface) of the second divided plate member 22*a* in the curve direction;

L2 is spacing between two ends of the plate member 15A in the curve direction;

E is a modulus of longitudinal elasticity of the first divided plate member 16*a* and the second divided plate member 22*a* b is a length of the first divided plate member 16*a* and the second divided plate member 22*a* in the sweep direction;

h is a total thickness of the first divided plate member 16*a* and the second divided plate member 22*a*; and k is the number of divided plate members that constitute the plate member 15A.

When the two edge portions in the curve direction of the first divided plate member 16*a* and the second divided plate member 22*a* are each pressed with a pressing force that has a predetermined value R that is defined by Expression (3), reaction forces that act in a direction in which an entire region of the first divided plate member 16*a* and the second divided plate member 22*a* are pressed against the mounting surface 4*b* arise in the first divided plate member 16*a* and the second divided plate member 22*a*.

In other words, the first divided plate member 16*a* is stacked onto the mounting surface 4*b* without forming gaps between it and the mounting surface 4*b*, and the second divided plate member 22*a* is stacked onto the first divided plate member 16*a* without forming gaps between it and the first divided plate member 16*a*.

Stable electrical continuity is thereby ensured between the first divided plate member 16*a* and the main body portion 3B, and between the first divided plate member 16*a* and the second divided plate member 22*a*.

Next, a procedure for assembling the waveguide structure 1N will be explained.

First, the first divided plate member 16*a* is mounted on the mounting surface 4*b* by inserting the first positioning pin 10*a* and the second positioning pin 10*b* through the first interfitting aperture 18*a* and the second interfitting aperture 19*a* of the first divided plate member 16*a*, as shown in FIG. 38. Next, the second divided plate member 22*a* is mounted on the first divided plate member 16*a* by inserting the first positioning pin 10*a* and the second positioning pin 10*b* through the third interfitting aperture 23*a* and the fourth interfitting aperture 24*a* of the second divided plate member 22*a*.

The first divided plate member 16*a* and the second divided plate member 22*a* are then deformed elastically so as to lie alongside the mounting surface 4*b*. Next, as shown in FIGS. 34 and 37, portions of the first divided plate member 16*a* on two sides of the mounting surface maximum recess portion in the sweep direction are pressed down by the pressing portions 11*f* while maintaining elastic deformation by fastening the mounted portions 11*e* of each of the pair of holders 11B into the respective pair of flanges 9B using the screws 13. Assembly of the waveguide structure 1N is thereby completed.

The waveguide structure 1N according to Embodiment 9 includes: a metal base 2B that has a mounting surface 4*b* that is configured so as to have a curved surface that is obtained by sweeping in a sweep direction a deflection curve for a cantilever; and an elastic metal plate member 15A that is stacked on the mounting surface 4*b* and that functions together with the base 2B to constitute a waveguide 7*b*. In addition, the waveguide structure 1N includes holders 11B that press intermediate portions of each of two edge portions in the sweep direction of the plate member 15A that has been stacked on the mounting surface 4*b* so as to generate reaction forces in the plate member 15A to hold the plate member 15A on the mounting surface 4*b* in a state of close contact.

The waveguide structure 1N also includes a positioning mechanism 21A that positions the plate member 15A on the mounting surface 4*b* and also restricts movement of the plate member 15A parallel to the mounting surface 4*b* by the fitting together of the first positioning pin 10*a* and the second positioning pin 10*b* with the first interfitting portion 25A and the second interfitting portion 26A.

Consequently, according to the waveguide structure 1N, similar effects to those of the waveguide structure 1A can be achieved.

Embodiment 10

Figure 39:
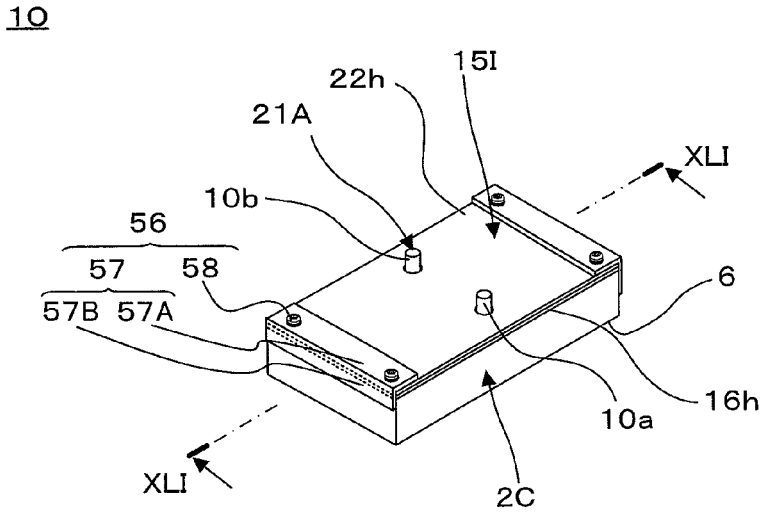
FIG. 39 is a perspective of a waveguide structure according to Embodiment 10 of the present invention.
Figure 40:
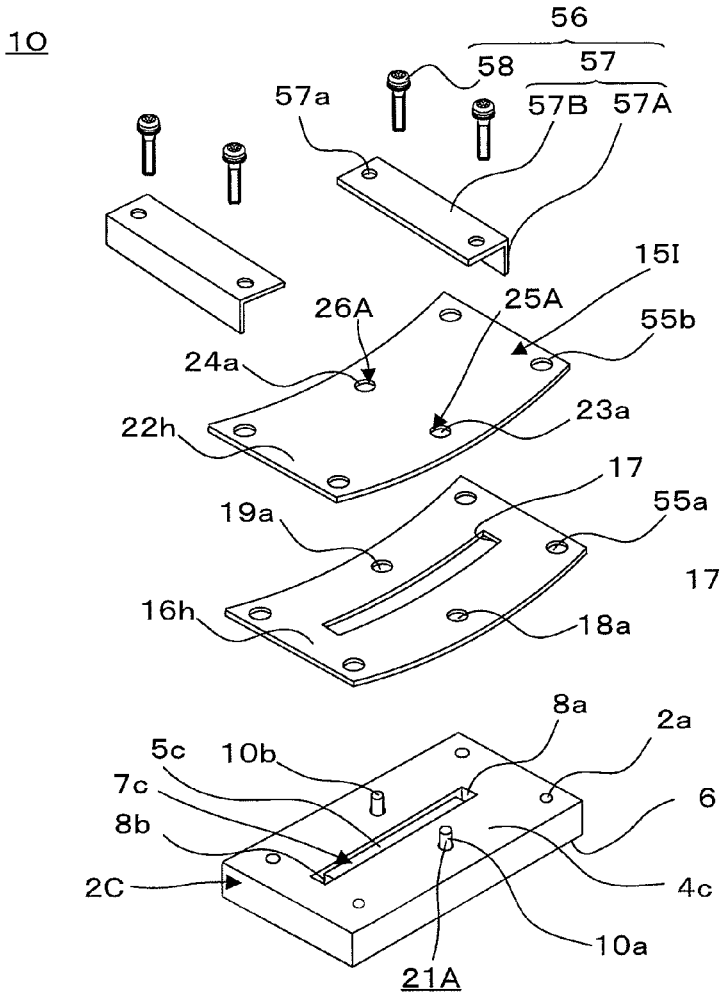
FIG. 40 is an exploded perspective of the waveguide structure according to Embodiment 10 of the present invention.
Figure 41:
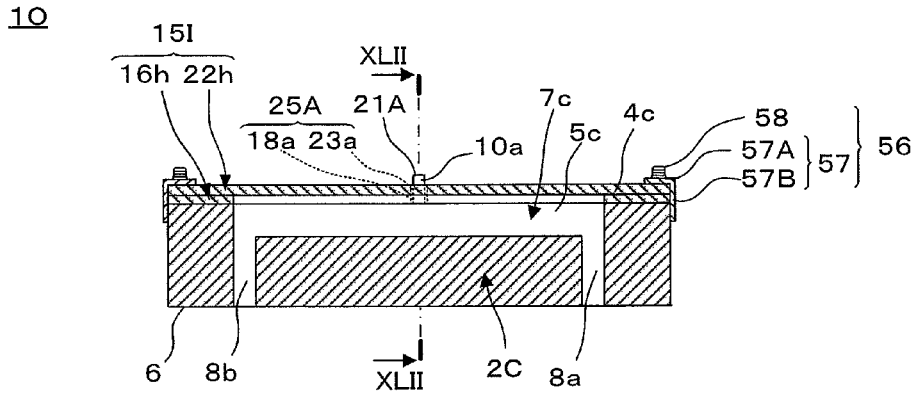
FIG. 41 is a cross section taken along Line XLI-XLI in FIG. 39 viewed from the direction of the arrows.
Figure 42:
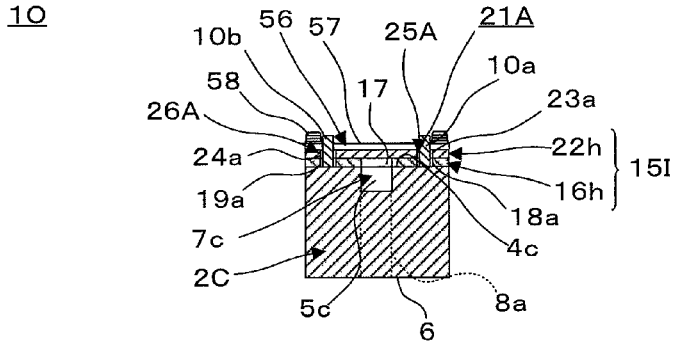
FIG. 42 is a cross section taken along Line XLII-XLII in FIG. 41 viewed from the direction of the arrows.
Figure 43:
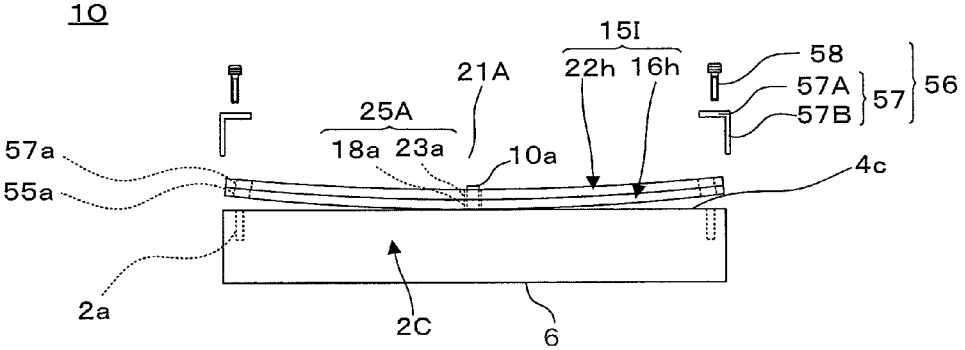
FIG. 43 is a diagram for explaining a procedure for assembling the waveguide structure of the invention according to Embodiment 10 of the present invention.

FIG. 39 is a perspective of a waveguide structure according to Embodiment 10 of the present invention, FIG. 40 is an exploded perspective of the waveguide structure according to Embodiment 10 of the present invention, FIG. 41 is a cross section taken along Line XLI-XLI in FIG. 39 viewed from the direction of the arrows, FIG. 42 is a cross section taken along Line XLII-XLII in FIG. 41 viewed from the direction of the arrows, and FIG. 43 is a diagram for explaining a procedure for assembling the waveguide structure of the invention according to Embodiment 10 of the present invention.

In FIGS. 39 through 42, a waveguide structure 1O includes: a metal base 2C that has a flat mounting surface 4*c*; and an elastic metal plate member 15I that is stacked on the mounting surface 4*c* and that functions together with the base 2C to constitute a waveguide 7*c*. In addition, the waveguide structure 1O includes: a positioning mechanism 21A that is constituted by: a first positioning pin 10*a* and a second positioning pin 10*b* that are disposed on the mounting surface as integral members of the mounting surface so as to protrude from the mounting surface 4*c*; and a first interfitting portion 25A and a second interfitting portion 26A that are formed on the plate member 15I and that are fitted together with the first positioning pin 10*a* and the second positioning pin 10*b*, the positioning mechanism 21A positioning the plate member 15I on the mounting surface 4*c*, and also restricting movement parallel to the mounting surface 4*c*; and a plate member holding jig 56 that functions as a holding means that elastically deforms a first divided plate member 16*h* and a second divided plate member 22*h* into a flat shape and holds them on the mounting surface 4*c* in a state of close contact.

The base 2C is configured so as to have a rectangular parallelepipedic shape, and the mounting surface 4*c* is configured on a first surface thereof.

A waveguide groove 5*c* that has an opening on the mounting surface 4*c* is formed on the base 2C. Here, the waveguide groove 5*c* extends for a predetermined length in the longitudinal direction of the mounting surface 4*c* at a predetermined width and a predetermined depth in the sweep direction of the mounting surface 4*c*. Screw-threaded apertures 2*a* are also formed on the base 2C so as to have openings in a vicinity of each of the corner portions of the mounting surface 4*c*.

Waveguide input and output passages 8*a* and 8*b* are each formed on the base 2C so as to pass through between an input and output port forming surface 6 that is configured on an opposite side from the mounting surface 4*c* of the base 2C and each of two ends of the waveguide groove 5*c*.

A first positioning pin 10*a* and a second positioning pin 10*b* are disposed the mounting surface as integral members of the mounting surface so as to protrude from two sides of the waveguide groove 5*c* in the width direction of the mounting surface 4*c* at a central portion in the longitudinal direction of the mounting surface 4*c*. Here, the first positioning pin 10*a* and the second positioning pin 10*b* are formed at portions that are separated by a predetermined distance from each of the long sides of the mounting surface 4*c*.

The plate member 15I is constituted by a two-layer divided plate member that is made up of: a first divided plate member 16*h* that is stacked on the mounting surface 4*c*; and a second divided plate member 22*h* that is stacked on the first divided plate member 16*h*. The first divided plate member 16*h* and the second divided plate member 22*h* are constituted by similar elastic metals.

The first divided plate member 16*h* is elastic, and is configured by curving a rectangular flat plate that has long sides that match a length of a long side of the mounting surface 4*c*, and short sides that match a length of the mounting surface 4*c* in the width direction. A major surface of the first divided plate member 16*h* is configured into a curved surface that is obtained by sweeping a deflection curve for a beam supported at two ends in the sweep direction. In other words, two surfaces of the first divided plate member 16*h* are constituted by a concave surface and a convex surface.

The sweep direction of the first divided plate member 16*h* is a direction that is perpendicular to the plane that includes the deflection curve, and the first divided plate member 16*h* does not have curvature over an entire region in the sweep direction. A direction that is parallel to the deflection curve for a beam supported at two ends of the major surfaces in the cross section of the first divided plate member 16*h* that is perpendicular to the sweep direction will be called "the curve direction".

An first interfitting aperture 18*a* and a second interfitting aperture 19*a* are respectively formed on portions of the first divided plate member 16*h* that are longitudinally central in the curve direction, and that are separated by a predetermined distance from each edge portions that are oriented in the curve direction. A waveguide constituting aperture 17 is formed on the first divided plate member 16*h* so as to face the waveguide groove 5*c* when the first divided plate member 16*h* and the mounting surface 4*c* are placed in close contact with outer edges aligned.

Penetrating aperture 55*a* are formed in a vicinity of each of the corner portions of the first divided plate member 16*h*.

The second divided plate member 22*h* is similarly configured by curving a rectangular flat plate that is identical in size to the first divided plate member 16*h*. A third interfitting aperture 23*a* and a fourth interfitting aperture 24*a* are respectively formed on portions of the second divided plate member 22*h* that are longitudinally central in the curve direction, and that are separated by a predetermined distance from each edge portions that are oriented in the curve direction.

Penetrating aperture 55*b* are respectively formed in a vicinity of the corner portions of the second divided plate member 22*h*.

Moreover, aperture diameters of the penetrating aperture 55*a* and 55*b* are greater than aperture diameters of the screw-threaded apertures 2*a*.

The plate member holding jigs 56 have pressing force transmitting covers 57 and plate member pressing screws 58.

The pressing force transmitting covers 57 are formed so as to have L-shaped cross sections that are constituted by a flat, rectangular plate member pressing portion 57A, and an auxiliary projecting portion 57B that extends vertically outward from one of the long sides of the plate member pressing portion 57A. A pair of penetrating apertures 57*a* are formed on the plate member pressing portion 57A so as to be separated from each other in a longitudinal direction.

The first divided plate member 16*h* and the second divided plate member are stacked on the mounting surface 4*c* by inserting the first positioning pin 10*a* and the second positioning pin 10*b* through the first interfitting aperture 18*a* and the second interfitting aperture 19*a* of the first divided plate member 16*h*, and inserting the first positioning pin 10*a* and the second positioning pin 10*b* through the third interfitting aperture 23*a* and the fourth interfitting aperture 24*a* of the second divided plate member 22*h*.

The positioning mechanism 21A is constituted by the first positioning pin 10*a*, the second positioning pin 10*b*, the first interfitting portion 25A, which is constituted by the first interfitting aperture 18*a* and the third interfitting aperture 23*a*, and the second interfitting portion 26A, which is constituted by the second interfitting aperture 19*a* and the fourth interfitting aperture 24*a*. In other words, the positioning mechanism 21A positions the plate member 15I at a prescribed position on the mounting surface 4*c* and also restricts movement of the plate member 15I parallel to the mounting surface 4*c* by the fitting together of the first positioning pin 10*a* and the first interfitting portion 25A, and by the fitting together of the second positioning pin 10*b* and the second interfitting portion 26A.

The pressing force transmitting covers 57 are disposed around two longitudinal edge portions of the mounting surface 4*c*. Here, the plate member pressing portions 57A are placed in contact with the mounting surface 4*c* such that the penetrating apertures 57*a* face the penetrating aperture 55*a* and 55*b*. Moreover, the auxiliary projecting portions 57B extend downward parallel to two end surfaces in the longitudinal direction of the base 2C of the laminated body that is constituted by the base 2C and the plate member 15I.

The first divided plate member 16*h* and the second divided plate member 22*h* are fastened to the base 2C by plate member pressing screws 58 that are inserted through the penetrating apertures 55*a*, 55*b*, and 57*a* and screwed into the screw-threaded aperture 2*a*. At that point, the first divided plate member 16*h* and the second divided plate member 22*h* are elastically deformed so as to have a flat shape so as to extend along the mounting surface 4*c*. Pressing force (fastening force) from the plate member pressing screws 58 is adjusted such that the second divided plate member 22*h* is pressed by a force that corresponds to the above Expression (2). Reaction forces that place the first divided plate member 16*h* in close contact with the mounting surface 4*c* and that place the second divided plate member 22*h* in close contact with the first divided plate member 16*h* are thereby generated by the pressing forces from the plate member pressing screws 58.

The waveguide groove 5*c*, the waveguide constituting aperture 17, and the second divided plate member 22*h* function together to constitute a waveguide 7*c* that extends in the longitudinal direction of the base 2C. Here, because the first divided plate member 16*h* and the mounting surface 4*c*, and the first divided plate member 16*h* and the second divided plate member 22*h*, are placed in close contact without leaving gaps, electrical continuity is ensured between the first divided plate member 16*h* and the second divided plate member 22*h*, and between the second divided plate member 22*h* and the base 2C.

Next, a procedure for assembling the waveguide structure 1O will be explained.

First, the first divided plate member 16*h* is mounted on the mounting surface 4*c* by placing the first divided plate member 16*h* opposite the mounting surface 4*c* such that the concave surface of the first divided plate member 16*h* faces away from the mounting surface 4*c*, and inserting the first positioning pin 10*a* and the second positioning pin 10*b* through the first interfitting aperture 18*a* and the second interfitting aperture 19*a*, as shown in FIG. 43.

Next, the second divided plate member 22*h* is mounted on the mounting surface 4*c* by placing the second divided plate member 22*h* opposite the first divided plate member 16*h* such that the concave surface of the second divided plate member 22*h* faces away from the mounting surface 4*c*, and inserting the first positioning pin 10*a* and the second positioning pin 10*b* through the third interfitting aperture 23*a* and the fourth interfitting aperture 24*a*.

The first divided plate member 16*h* and the second divided plate member 22*h* are then deformed elastically so as to have a flat shape. At that point, each of the screw-threaded apertures 2*a* in the vicinity of the corner portions of the base 2C, each of the penetrating apertures 55*a* in the vicinity of the corner portions of the first divided plate member 16*h*, and each of the penetrating apertures 55*b* in the vicinity of the corner portions of the second divided plate member 22*h* align with each other. The pressing force transmitting covers 57 are then disposed on the plate member 15I such that the auxiliary projecting portions 57B are parallel to two end surfaces of the first divided plate member 16*h* and the second divided plate member 22*h* in the longitudinal direction of the base 2C, and such that the penetrating apertures 57*a* of the plate member pressing portions 57A align with the penetrating aperture 55*b*. The plate member 15I is then fixed between the pressing force transmitting covers 57 and the base 2C by screwing the plate member pressing screws 58 that are inserted through the penetrating apertures 55*a* and 55*b* into the screw-threaded apertures 2*a*. Assembly of the waveguide structure 1O is thereby completed.

The waveguide structure 1O according to Embodiment 10 includes: a metal base 2C that has a flat mounting surface 4*c*; and a plate member 15I that is constituted by a first divided plate member 16*h* and a second divided plate member 22*h* that are each configured so as to have a curved plate shape using a metal that has elasticity, and that are stacked on the mounting surface 4*c* so as to be elastically deformed such that reaction forces are generated in a direction that presses against the mounting surface 4*c*, the plate member 15I functioning together with the base 2C to constitute a waveguide 7*c*.

The waveguide structure 1O also includes a positioning mechanism 21A that positions the plate member 15I on the mounting surface 4*c* and also restricts movement of the plate member 15I parallel to the mounting surface 4*c* by the fitting together of the first positioning pin 10*a* and the second positioning pin 10*b* with the first interfitting portion 25A and the second interfitting portion 26A. In addition, the waveguide structure 1O includes plate member holding jigs 56 that press two edge portions in the curve direction of the plate member 15I so as to generate reaction forces in the plate member 15I to hold the plate member 15I on the mounting surface 4*c* in a state of close contact.

Consequently, according to the waveguide structure 1O, similar effects to those of the waveguide structure 1A can be achieved.

Moreover, in Embodiment 10, the plate member 15I is explained as being configured by mounting a first divided plate member 16*h* and a second divided plate member 22*h* that have curved surfaces that are obtained by sweeping a deflection curve for a beam supported at two ends in the sweep direction onto a flat mounting surface 4*c* such that concave surfaces face away from the mounting surface 4*c*, then fixing first and second edge portions of the second divided plate member 16*h* in the curve direction onto the mounting surface 4*c* in a pressed state such that the first divided plate member 16*h* and the second divided plate member 22*h* are deformed elastically along the mounting surface 4*c*. However, stacking onto the mounting surface 4*c* of a first divided plate member and a second divided plate member that constitute a plate member is not limited to this state.

The plate member may also be configured as follows:

a first divided plate member and a second divided plate member are prepared that each have a curved surface that is obtained by sweeping front and rear surfaces in a cantilever deflection curve in the sweep direction. Then, the first divided plate member and the second divided plate member are mounted onto the mounting surface 4*c* such that the concave surfaces of each are oriented toward the mounting surface 4*c*, then the second divided plate member 16*h* is deformed elastically along the mounting surface 4*c* by pressing first and second sweep direction edge portions thereof.

Embodiment 11

Figure 44:
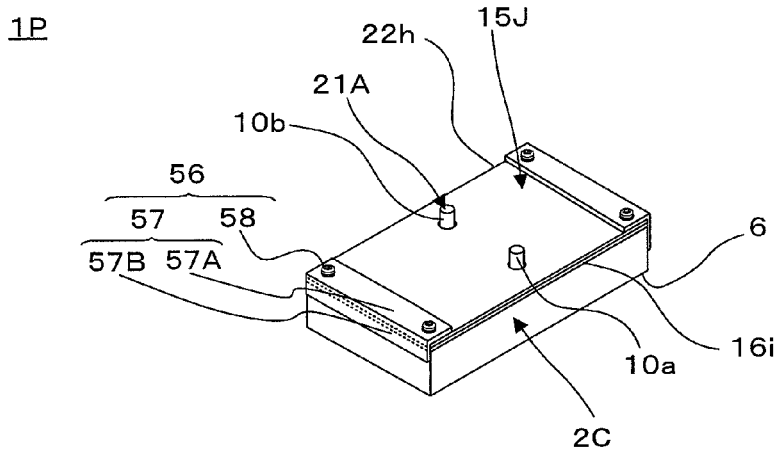
FIG. 44 is a perspective of a waveguide structure according to Embodiment 11 of the present invention.
Figure 45:
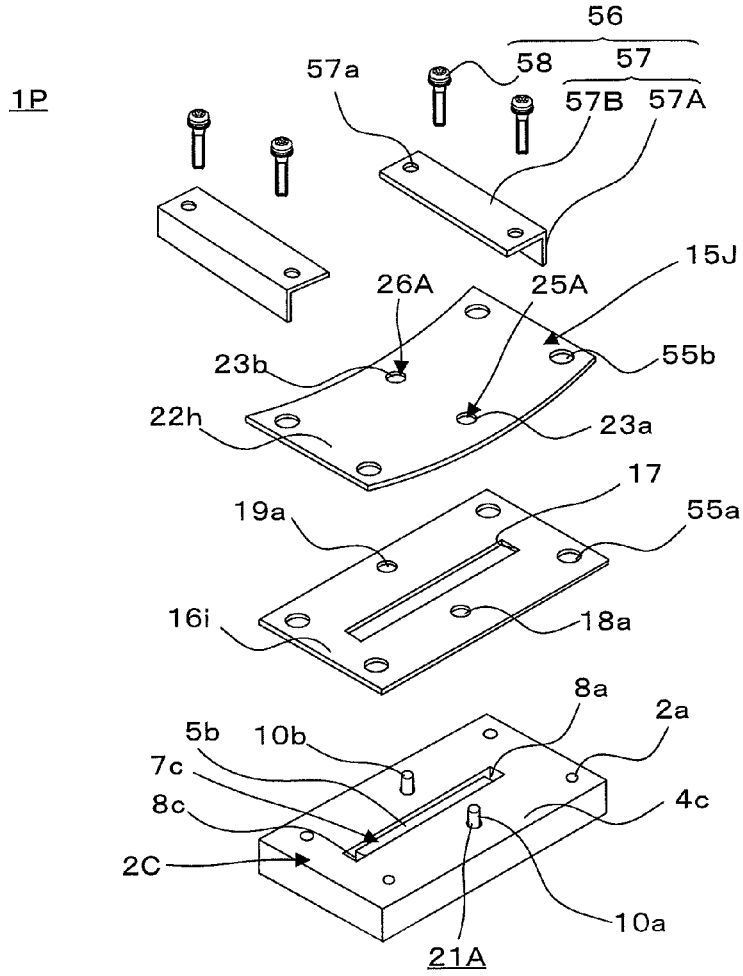
FIG. 45 is an exploded perspective of the waveguide structure according to Embodiment 11 of the present invention.

FIG. 44 is a perspective of a waveguide structure according to Embodiment 11 of the present invention, and FIG. 45 is an exploded perspective of the waveguide structure according to Embodiment 11 of the present invention.

Moreover, portions identical to or corresponding to those in Embodiments 1 and 10 above will be given identical numbering, and explanation thereof will be omitted.

In FIGS. 44 and 45, a waveguide structure 1P is configured in a similar manner to the waveguide structure 1O except that a plate member 15J is used instead of the plate member 15I.

The plate member 15J is configured in a similar manner to the plate member 15I except that a first divided plate member 16*i* that is stacked on a mounting surface 4*c* is used instead of the first divided plate member 16*h*.

The first divided plate member 16*i* is configured in a similar manner to the first divided plate member 16*h* except for being configured so as to have a flat, rectangular shape that has a major surface that is identical in the size the mounting surface 4*c*.

The first divided plate member 16*i* and the second divided plate member 22*h* are fastened to the base 2C by plate member pressing screws 58 that are inserted through the penetrating apertures 55*a*, 55*b*, and 57*a*, and the second divided plate member 22*h* is elastically deformed so as to be flat and extend along the mounting surface 4*c*.

Pressing force (fastening force) from the plate member pressing screws 58 is adjusted such that the second divided plate member 22*h* is pressed by a force that corresponds to the above Expression (2). Here, the first divided plate member 16*i* is placed in close contact with the mounting surface 4*c* and the second divided plate member 22*h* is placed in close contact with the first divided plate member 16*i* without gaps such that reaction forces are generated in the second divided plate member 22*h* due to the pressing forces from the plate member pressing screws 58.

A procedure for assembling the waveguide structure 1P is similar to the procedure for assembling the waveguide structure 1O except that the second divided plate member 22*h* is deformed elastically so as to contact the first divided plate member 16*i* flatly when being stacked on the mounting surface 4*c* instead of both the first divided plate member 16*h* and the second divided plate member 22*h* being deformed elastically so as to contact the mounting surface 4*c* flatly when being stacked on the mounting surface 4*c*.

The waveguide structure 1P according to Embodiment 11 also includes a positioning mechanism 21A that positions the plate member 15J on the mounting surface 4*c* and also restricts movement of the plate member 15J parallel to the mounting surface 4*c* by the fitting together of the first positioning pin 10*a* and the second positioning pin 10*b* with the first interfitting portion 25A and the second interfitting portion 26A.

In addition, the waveguide structure 1P includes plate member holding jigs 56 that press two edge portions in the curve direction of the second divided plate member 22*a* that constitutes the plate member 15J so as to generate reaction forces in the plate member 15J to hold the plate member 15J on the mounting surface 4*c* in a state of close contact.

Consequently, according to the waveguide structure 1P, similar effects to those of the waveguide structure 1A can be achieved.

Moreover, in Embodiments 10 and 11, the plate members 15I and 15J are explained as being held by the plate member holding jigs 56 in a state of close contact on the mounting surface 4*c* so as to generate reaction forces in the plate members 15I and 15J, but holders 11A may also be used instead of the plate member holding jigs 56 to hold the plate members 15I and 15J in a state of close contact on the mounting surface 4*c* so as to generate reaction forces in the plate members 15I and 15J.

Embodiment 12

Figure 46:
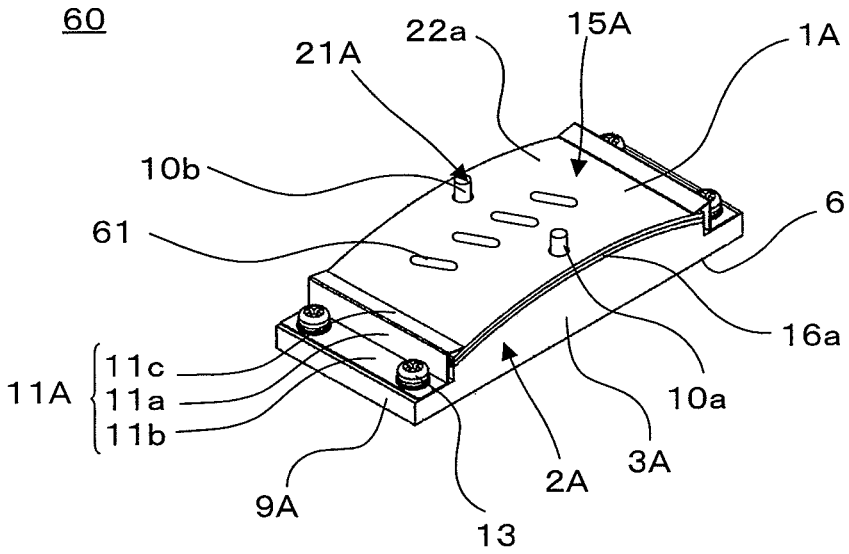
FIG. 46 is a perspective of a slot array antenna according to Embodiment 12 of the present invention.

FIG. 46 is a perspective of a slot array antenna according to Embodiment 12 of the present invention.

In FIG. 46, portions identical to those in Embodiment 1 above will be given identical numbering, and explanation thereof will be omitted.

A slot array antenna 60 that functions as an antenna apparatus is configured by forming slits 61 for high frequency signal emission on a second divided plate member 22*a* on a waveguide structure 1A. A plurality of the slits 61 are formed in a direction of extension of a waveguide 7*a* so as to communicate between internal and external portions of the waveguide 7*a*.

In a slot array antenna 60 that uses the waveguide structure 1A, because increases in energy transmission loss of high frequency signals propagating through the waveguide 7*a* can be suppressed, it is possible to transmit high frequency signals from the slits 61 while maintaining a signal level in high frequency signals that have been input through waveguide input and output passages 8*a* and 8*b* of the waveguide structure 1A.

Moreover, in Embodiment 12, the slot array antenna 60 is explained as being configured using a waveguide structure 1A, but may also be configured using one of the other waveguide structures 1B through 1P.

Embodiment 13

A high-performance vehicle radar apparatus can be achieved by using a waveguide structure 1A through 1P, or a slot array antenna 60, etc., in vehicle radar apparatuses that are mounted to an automotive vehicle such as an automobile, etc., for monitoring conditions in a vicinity of the automotive vehicle, and propagating electromagnetic waves that function as high frequency signals from the waveguide structure 1A through 1P or the slot array antenna 60, etc.

What is claimed is:

1. A waveguide structure comprising:

a base that has a mounting surface;

a metal plate member that has elasticity, that is stacked on said mounting surface, and that functions together with said base to constitute a waveguide;

a positioning mechanism that is constituted by:

a positioning member that protrudes from one of said base and said plate member, wherein said positioning member is integrally formed with the mounting surface associated with said one of said base and said plate member; and an interfitting portion that is formed on the other one of said base and said plate member, and that is fitted together with said positioning member, said positioning mechanism positioning said plate member on said mounting surface of said base and also restricting movement along said mounting surface by fitting together of said positioning member and said interfitting portion; and a holder that holds said plate member in a state of close contact with said mounting surface by pressing said plate member so as to generate a reaction force in said plate member.

2. A waveguide structure according to claim 1, wherein:

said mounting surface of said base is configured so as to have a curved surface that is obtained by sweeping in a sweep direction a deflection curve for a beam supported at two ends or for a cantilever; and said plate member is stacked on said mounting surface so as to be elastically deformed along said mounting surface by a pressing force from said holding means.

3. A waveguide structure according to claim 2, wherein said positioning mechanism is disposed on a portion of said mounting surface of said base at which a distance from a plane that includes two edge portions of said mounting surface in a curve direction is at a maximum.

4. A waveguide structure according to claim 2, wherein said positioning mechanism is disposed on a portion of said mounting surface at which a gradient is smallest.

5. A waveguide structure according to claim 2, wherein said positioning mechanism is disposed on a portion of said mounting surface near an edge portion in a curve direction.

6. A waveguide structure according to claim 1, wherein:

said mounting surface of said base is configured so as to be flat; and said plate member has front and rear surfaces that are configured so as to have curved surfaces that are obtained by sweeping in a sweep direction of a deflection curve for a beam supported at two ends or for a cantilever, and is stacked on said mounting surface so as to be elastically deformed along said mounting surface by a pressing force from said holding means.

7. A waveguide structure according to claim 1, wherein:

said positioning member is a single positioning pin that has an external shape other than a circle; and said interfitting portion is an interfitting aperture that has an internal shape that matches said external shape of said positioning pin.

8. A waveguide structure according to claim 7, wherein:

said positioning pin is disposed so as to project from said mounting surface;

said plate member is constituted by n divided plate members that are stacked on said mounting surface of said base, where n is an integer that is greater than or equal to 2;

n stacking sequence regulating pins that each have a height that corresponds to a respective number of stacked plates of said divided plate members from one plate to n plates are disposed so as to project from said mounting surface of said base so as to line up in a single column with said positioning pin in said sweep direction; and stacking sequence regulating interfitting portions that fit together with corresponding ones of said n stacking sequence regulating pins that have said height that corresponds to said respective number of stacked plates in said n divided plate members from said one plate to m plates are formed on a divided plate member of said n divided plate members that is stacked in an m-th layer on said mounting surface, where m is an integer that is greater than or equal to 1 and less than or equal to n.

9. A waveguide structure according to claim 8, wherein said positioning pins also function as said stacking sequence regulating pins that have said height that corresponds to said n stacked plates of said divided plate members.

10. A waveguide structure according to claim 7, wherein:

said positioning pin is disposed so as to project from said mounting surface;

said plate member is constituted by n divided plate members that are stacked on said mounting surface of said base, where n is an integer that is greater than or equal to 2;

a stacking sequence regulating member is disposed so as to project from said mounting surface so as to be separated from said positioning pin in said sweep direction such that first through (n−1)-th step portions in which a cross-sectional area that is perpendicular to a thickness direction is reduced sequentially are aligned in said thickness direction and configured integrally sequentially from said first through (n−1)-th step portions, wherein an m-th step portion of said first through n-th portions from said mounting surface has a height that corresponds to a respective number of stacked plates of said n divided plate members from one plate to m plates, where m is an integer that is greater than or equal to 1 and less than or equal to n−1; and a stacking sequence regulating interfitting portion that has a size that corresponds to a size of said cross-sectional area that is perpendicular to said thickness direction of said m-th step portion is formed on a divided plate member of said n divided plate members that is stacked on said mounting surface in an m-th layer.

11. A waveguide structure according to claim 10, wherein said stacking sequence regulating member is a multiple diameter pin comprising first through (n−1)-th step portions that have circular cross sections in which a diameter is reduced sequentially are integrated coaxially.

12. A waveguide structure according to claim 7, wherein:

said positioning pin is disposed so as to project from said mounting surface;

said plate member is constituted by n divided plate members that are stacked on said mounting surface of said base, where n is an integer that is greater than or equal to 2;

a stacking sequence regulating member is disposed so as to project from said mounting surface so as to be separated from said positioning pin in said sweep direction such that first through n-th step portions in which a cross-sectional area that is perpendicular to a thickness direction is reduced sequentially are aligned in said thickness direction and configured integrally sequentially from said first through n-th step portions, wherein an m-th step portion of said first through n-th portions from said mounting surface has a height that corresponds to a respective number of stacked plates of said n divided plate members from one plate to m plates, where m is an integer that is greater than or equal to 1 and less than or equal to n; and a stacking sequence regulating interfitting portion that has a size that corresponds to a size of said cross-sectional area that is perpendicular to said thickness direction of said m-th step portion is formed on a divided plate member of said n divided plate members that is stacked on said mounting surface in an m-th layer.

13. A waveguide structure according to claim 12, wherein said stacking sequence regulating member is a multiple diameter pin comprising first through n-th step portions that have circular cross sections in which a diameter is reduced sequentially are integrated coaxially.

14. A waveguide structure according to claim 12, wherein said stacking sequence regulating member also functions as said positioning pin.

15. A waveguide structure according to claim 1, wherein:

said positioning member is a pair of first and second positioning pins that are separated from each other in a sweep direction of a deflection curve for a beam supported at two ends or for a cantilever; and said interfitting portion is an interfitting aperture or a notch that has an internal shape that conforms to an external shape of one of said pair of the first and the second positioning pins that fits together therewith.

16. A waveguide structure according to claim 15, wherein the interfitting portion comprises a first interfitting portion and a second interfitting portion corresponding to the first and the second positioning pins, respectively, and a shape of the first interfitting portion is different than a shape of the second interfitting portion.

17. A waveguide structure according to claim 16, wherein:

an external shape of the first positioning pin is a circle;

said first interfitting portion is an interfitting aperture that has an internal shape that matches said external shape of said first positioning pin; and said second interfitting portion is a slot-shaped interfitting aperture or a notch that has a major axis that is oriented in said sweep direction, and that has a minor axial length that corresponds to a length of said second positioning pin in said curve direction.

18. A waveguide structure according to claim 15, wherein an opening end corner portion of said notch is relieved.

19. A waveguide structure according to claim 15, wherein a floor portion of said notch has a rounded shape.

20. A waveguide structure according to claim 15, wherein said notch has a rectangular shape.

21. A waveguide structure according to claim 15, wherein said first and second positioning pins are disposed on opposite sides of a center of said mounting surface in said sweep direction so as to be asymmetrical relative to said center in said sweep direction.

22. A waveguide structure according to claim 15, wherein:

said first and second positioning pins are disposed so as to project from said mounting surface;

said plate member is constituted by n divided plate members that are stacked on said mounting surface of said base, where n is an integer that is greater than or equal to 2;

n stacking sequence regulating pins that each have a height that corresponds to a respective number of stacked plates of said divided plate members from one plate to n plates are disposed so as to project from said mounting surface of said base so as to line up in a single column with said first and second positioning pins in said sweep direction; and stacking sequence regulating interfitting portions that fit together with corresponding ones of said n stacking sequence regulating pins that have said height that corresponds to said respective number of stacked plates in said n divided plate members from said one plate to m plates are formed on a divided plate member of said n divided plate members that is stacked in an m-th layer on said mounting surface, where m is an integer that is greater than or equal to 1 and less than or equal to n.

23. A waveguide structure according to claim 22, wherein said first and second positioning pins also function as said stacking sequence regulating pins that have said height that corresponds to said n stacked plates of said divided plate members.

24. A waveguide structure according to claim 15, wherein:

said first and second positioning pins are disposed so as to project from said mounting surface;

said plate member is constituted by n divided plate members that are stacked on said mounting surface of said base, where n is an integer that is greater than or equal to 2;

a stacking sequence regulating member is disposed so as to project from said mounting surface so as to be separated from said first and second positioning pins in said sweep direction such that said first through (n−1)-th step portions in which a cross-sectional area that is perpendicular to a thickness direction is reduced sequentially are aligned in said thickness direction and configured integrally sequentially from first through (n−1)-th step portions, wherein an m-th step portion of said first through n-th portions from said mounting surface has a height that corresponds to a respective number of stacked plates of said n divided plate members from one plate to m plates, where m is an integer that is greater than or equal to 1 and less than or equal to n−1; and a stacking sequence regulating interfitting portion that has a size that corresponds to a size of said cross-sectional area that is perpendicular to said thickness direction of said m-th step portion is formed on a divided plate member of said n divided plate members that is stacked on said mounting surface in an m-th layer.

25. A waveguide structure according to claim 24, wherein said stacking sequence regulating member is a multiple diameter pin comprising first through (n−1)-th step portions that have circular cross sections in which a diameter is reduced sequentially are integrated coaxially.

26. A waveguide structure according to claim 15, wherein:

said first and second positioning pins are disposed so as to project from said mounting surface;

said plate member is constituted by n divided plate members that are stacked on said mounting surface of said base, where n is an integer that is greater than or equal to 2;

a stacking sequence regulating member is disposed so as to project from said mounting surface so as to be separated from said first and second positioning pins in said sweep direction such that first through n-th step portions in which a cross-sectional area that is perpendicular to a thickness direction is reduced sequentially are aligned in said thickness direction and configured integrally sequentially from said first through n-th step portions, wherein an m-th step portion of said first through n-th portions from said mounting surface has a height that corresponds to a respective number of stacked plates of said n divided plate members from one plate to m plates, where m is an integer that is greater than or equal to 1 and less than or equal to n; and a stacking sequence regulating interfitting portion that has a size that corresponds to a size of said cross-sectional area that is perpendicular to said thickness direction of said m-th step portion is formed on a divided plate member of said n divided plate members that is stacked on said mounting surface in an m-th layer.

27. A waveguide structure according to claim 26, wherein said stacking sequence regulating member is a multiple diameter pin comprising first through n-th step portions that have circular cross sections in which a diameter is reduced sequentially are integrated coaxially.

28. A waveguide structure according to claim 26, wherein said stacking sequence regulating member also functions as said first and second positioning pins.

29. A waveguide structure according to claim 1, wherein said plate member is constituted by a plurality of divided plate members that are stacked on said mounting surface of said base.

30. An antenna apparatus that uses a waveguide structure according to claim 1, wherein said antenna apparatus has slits for high frequency signal emission that are formed so as to communicate between internal and external portions of said waveguide.

31. A vehicle radar apparatus that is configured using the waveguide structure according to claim 1.

* * * * *